US008007974B2

(12) United States Patent
Nakayama et al.

(10) Patent No.: US 8,007,974 B2
(45) Date of Patent: Aug. 30, 2011

(54) TONER, IMAGE FORMING APPARATUS USING THE SAME, IMAGE FORMING METHOD USING THE SAME, AND PROCESS CARTRIDGE

(75) Inventors: Shinya Nakayama, Numazu (JP); Akihiro Kotsugai, Numazu (JP); Yasuaki Iwamoto, Numazu (JP); Yasutada Shitara, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 506 days.

(21) Appl. No.: 11/943,929

(22) Filed: Nov. 21, 2007

(65) Prior Publication Data

US 2008/0261131 A1 Oct. 23, 2008

(30) Foreign Application Priority Data

Nov. 22, 2006 (JP) ..... 2006-315650

(51) Int. Cl.
*G03G 9/097* (2006.01)

(52) U.S. Cl. ..... 430/108.1; 430/108.3; 430/108.4; 430/109.4

(58) Field of Classification Search ..... 430/108.1, 430/108.3, 108.4, 109.4
See application file for complete search history.

(56) References Cited

U.S. PATENT DOCUMENTS 4,206,064 A 6/1980 Kiuchi et al.
4,981,939 A * 1/1991 Matsumura et al. ..... 527/604
5,853,940 A * 12/1998 Kido et al. ..... 430/108.4
6,025,107 A * 2/2000 Sekiguchi et al. ..... 430/108.4
6,946,229 B2 9/2005 Suzuki et al.
7,166,403 B2 1/2007 Ichikawa et al.
7,172,844 B2 2/2007 Umemura et al.
7,198,874 B2 4/2007 Saito et al.
7,261,989 B2 8/2007 Sugiura et al.
7,318,989 B2 1/2008 Kotsugai et al.
2002/0001766 A1* 1/2002 Higuchi et al. ..... 430/108.3
2002/0028402 A1* 3/2002 Matsuoka et al. ..... 430/137.1
2002/0042011 A1 4/2002 Anno et al.

(Continued)

FOREIGN PATENT DOCUMENTS

CN 1168899 12/1997

(Continued)

OTHER PUBLICATIONS

U.S. Appl. No. 12/297,952, filed Oct. 21, 2008, Iwamoto, et al.

(Continued)

*Primary Examiner* — Hoa V Le
(74) *Attorney, Agent, or Firm* — Oblon, Spivak, McClelland, Maier & Neustadt, L.L.P.

(57) ABSTRACT

A toner that is excellent in low-temperature fixing property, offset resistance, storage stability, charge rising property, charge stability with time and pulverizability and allows for forming high-quality images over a long period of time. The toner contains at least a binder resin, a colorant and a charge controlling agent, wherein the charge controlling agent contains an aromatic oxycarboxylic acid metal compound having a trivalent or more central metal, the binder resin comprises a polyester resin (A) having a softening point Tm (A) of 120° C. to 160° C. and a polyester resin (B) having a softening point Tm (B) of 80° C. to less than 120° C., and at least any one of the polyester resins (A) and (B) contains 1,2-propane diol at 65 mol % or more in a divalent alcohol component and can be obtained by condensation polymerizing an alcohol component substantially composed of only an aliphatic alcohol with a carboxylic acid component.

23 Claims, 14 Drawing Sheets

U.S. PATENT DOCUMENTS

| | | | | |
|---|---|---|---|---|
| 2002/0098434 | A1* | 7/2002 | Anno et al. | 430/108.8 |
| 2003/0162115 | A1* | 8/2003 | Uchinokura et al. | 430/108.22 |
| 2003/0180643 | A1* | 9/2003 | Suzuki et al. | 430/108.6 |
| 2004/0029031 | A1* | 2/2004 | Yamazaki et al. | 430/137.14 |
| 2004/0082714 | A1* | 4/2004 | Miyamoto et al. | 524/700 |
| 2005/0079433 | A1 | 4/2005 | Watanabe et al. | |
| 2005/0089786 | A1 | 4/2005 | Sugiura et al. | |
| 2005/0089787 | A1 | 4/2005 | Uchinokura et al. | |
| 2005/0277046 | A1 | 12/2005 | Sawada et al. | |
| 2006/0068312 | A1 | 3/2006 | Yamashita et al. | |
| 2006/0160011 | A1 | 7/2006 | Inoue et al. | |
| 2006/0165989 | A1 | 7/2006 | Takikawa et al. | |
| 2006/0172215 | A1 | 8/2006 | Kotsugai et al. | |
| 2006/0204883 | A1 | 9/2006 | Nakayama et al. | |
| 2006/0240349 | A1 | 10/2006 | Watanabe et al. | |
| 2007/0031752 | A1 | 2/2007 | Watanabe et al. | |
| 2007/0248380 | A1 | 10/2007 | Iwamoto et al. | |
| 2007/0281236 | A1 | 12/2007 | Watanabe et al. | |
| 2007/0281237 | A1 | 12/2007 | Iwamoto et al. | |

FOREIGN PATENT DOCUMENTS

| | | |
|---|---|---|
| JP | 55-42752 | 11/1980 |
| JP | 62-145255 | 6/1987 |
| JP | 63-313182 | 12/1988 |
| JP | 1-263679 | 10/1989 |
| JP | 1-309072 | 12/1989 |
| JP | 5-341617 | 12/1993 |
| JP | 7-230188 | 8/1995 |
| JP | 8-22206 | 1/1996 |
| JP | 9-325520 | 12/1997 |
| JP | 10-10785 | 1/1998 |
| JP | 2001-249500 | 9/2001 |
| JP | 2001-343787 | 12/2001 |
| JP | 2002-082484 | 3/2002 |
| JP | 2002-169331 | 6/2002 |
| JP | 2002-287427 | 10/2002 |
| JP | 2004-280084 | 10/2004 |
| JP | 2004-309745 | 11/2004 |
| JP | 2006-154686 | 6/2006 |

OTHER PUBLICATIONS

U.S. Appl. No. 11/755,484, filed May 30, 2007, Watanabe, et al.
U.S. Appl. No. 11/755,517, filed May 30, 2007, Iwamoto, et al.
U.S. Appl. No. 11/738,149, filed Apr. 20, 2007, Iwamato, et al.
U.S. Appl. No. 11/934,929, filed Nov. 21, 2007, Nakayama, et al.
U.S. Appl. No. 12/112,601, filed Apr. 30, 2008, Sabu, et al.
U.S. Appl. No. 12/118,006, filed May 9, 2008, Nakayama, et al.
U.S. Appl. No. 12/253,558, filed Oct. 17, 2008, Nakayama et al.
U.S. Appl. No. 12/142,311, filed Jun. 19, 2008, Nakayama, et al.
Office Action issued Oct. 19, 2010, in Japanese Patent Application No. 2006-315650, filed Nov. 22, 2006.
Office Action issued Nov. 1, 2010, in Chinese Patent Application No. 200710308200.3, filed Nov. 22, 2007, with English translation.

* cited by examiner

TONER, IMAGE FORMING APPARATUS USING THE SAME, IMAGE FORMING METHOD USING THE SAME, AND PROCESS CARTRIDGE

BACKGROUND OF THE INVENTION

1. Field of the Invention

The present invention relates to a toner used for electrophotographic image formation such as for copiers, electrostatic printing, printers, facsimiles, electrostatic recording and the like, and also relates to an image forming apparatus using the toner, an image forming method using the toner, and a process cartridge using the toner.

2. Description of the Related Art

Conventionally, various methods of electrophotographic image formation have been known in the art. Generally, the surface of a latent electrostatic image bearing member (hereinafter, may be referred to as "photoconductor", "electrophotographic photoconductor" or "image bearing member") is charged and the charged surface of the latent electrostatic image bearing member is exposed to form a latent electrostatic image. Next, the latent electrostatic image is developed to form a visible image on the latent electrostatic image bearing member. The visible image is directly transferred onto a recording medium or transferred via an intermediate transfer member onto a recording medium, and the transferred image is fixed by heating and/or pressurizing the transferred image, thereby obtaining a recorded material with an image formed on the recording medium. Then, a residual toner remaining on the surface of the latent electrostatic image bearing member after transfer of the visible image is removed by a known method using a cleaning blade, cleaning brush, cleaning roller or the like.

For a full-color image forming apparatus utilizing such an electrophotographic technique, typically, there are two methods known in the art. One method is called a single method (or single drum method). In the single method, one latent electrostatic image bearing member is mounted inside an image forming apparatus, and four developing units each corresponding to each four colors of cyan, magenta, yellow and black are mounted inside the image forming apparatus. In such a single method, four color visible images are formed on the latent electrostatic image bearing member or a recording medium. The single method enables to share a single charging unit, a single exposing unit, a single transfer unit, a single cleaning unit and the like that are arranged around a latent electrostatic image bearing member, and the single method allows an image forming apparatus to be designed compact at low-production cost, as compared to a tandem method, which will be described hereinafter.

Another method is called a tandem method (or tandem-drum method). In the tandem method, a plurality of latent electrostatic image bearing members are mounted inside an image forming apparatus (see Japanese Patent Application Laid-Open (JP-A) No. 5-341617). Typically, one charging unit, one developing unit, one transfer unit and one cleaning unit are arranged for one latent electrostatic image bearing member, all of them constitute one image forming constitutional element, and a plurality of the image forming constitutional elements (typically, four image forming constitutional elements) are mounted inside an image forming apparatus. In the tandem method, a one-color visible image is formed using one image forming constitutional element, and four-color visible images are sequentially transferred onto a recording medium to thereby form a full-color image. The tandem method enables to produce respective color-visible images by parallel processing, and thus it allows for high-speed image formation. Specifically, the tandem method requires only about one-fourth of the image forming processing time required for the single method and can form an image at a printing speed four-times as high as the printing speed of the single method. Further, the tandem method can virtually increase the durability of respective units such as a latent electrostatic image bearing member in an image forming constitutional element. This is because the tandem method requires just only one operation to perform the above-noted steps using one latent electrostatic image bearing member, in contrast to the single method, in which one latent electrostatic image bearing member goes through four times of respective steps of charging, exposing, developing and transferring to form a full-color image.

However, in the tandem method, it is necessary to arrange a plurality of image forming sections, and thus the method has a disadvantage in that there is a need to increase the size of the main body of an image forming apparatus, resulting in high-production cost.

To solve the aforementioned problem, there is a method of making a latent electrostatic image bearing member have a smaller diameter and down-sized respective units arranged around the latent electrostatic image bearing member, thereby reducing one image forming constitutional element in size. As a result, it is possible to obtain not only an effect of downsizing of the main body of an image forming apparatus but also an effect of reducing material cost, and overall cost-cutting of such an image forming apparatus has proceeded in some degree. With achievement of such compact and down-sized image forming apparatuses, the following new problems are introduced. Respective units to be mounted to an image forming constitutional element must be made to achieve high-performance and to achieve highly increased stability.

Further, recently, demands in the market for energy-saving and high-speed performance in image forming apparatuses, such as printers, copiers and facsimiles, have become strong. To achieve such high-performance in an image forming apparatus, it is important to improve thermal efficiency of a fixing unit.

Generally, in an image forming apparatus, an unfixed toner image is formed on a recording medium such as a recording sheet, printing paper, photosensitive paper and electrostatic printing paper through an image formation process such as electrophotographic recording, electrostatic recording and magnetic recording by an indirect transfer or direct transfer method. As a fixing unit to fix such an unfixed toner image, for example, contact heating methods such as heat roller method, film heating method and electromagnetic induction heating method are widely employed.

The heat roller type fixing unit is basically composed of a pair of rotation rollers of a fixing roller which has a thermal source, such as a halogen lamp, inside thereof to thermally control the temperature to a predetermined value and a pressurizing roller that is pressed against the fixing roller to make contact therewith. A recording medium is inserted into a contact portion (so-called nip portion) of the pair of rotation rollers to convey the recording medium, and an unfixed toner image is fused and fixed on the recording medium by heat and pressure from the fixing roller and the pressurizing roller.

Film heating type fixing units have been proposed, for example, in Japanese Patent Application Laid-Open (JP-A) Nos. 63-313182 and 1-263679. Such a film heating type fixing unit is configured to supply heat via a fixing thin film having heat resistance from a heater which is fixed to and supported with a supporting member by making a recording medium closely contact with the heater via the fixing thin film while sliding the fixing thin film against the heater and moving.

For the heater, for example, a ceramic heater having a heat resistant layer formed on a ceramic substrate made of alumina, aluminum nitride or the like, which has properties such as heat resistance, insulation and excellent thermal conductance, is used. In such a fixing unit, a fixing film which is thin and is of low heat capacity can be used, and it has higher heat transfer efficiency than the above-noted heat roller type fixing unit, enables to shorten warm-up time and allows for quick starting and energy-saving.

For the electromagnetic induction heating type fixing unit, for example, a technique of making a heater having a magnetic metal member electromagnetically induce and generate heat by generating Joule heat using an eddy current generated from an AC magnetic field in the magnetic metal member has been proposed (see Japanese Patent Application Laid-Open (JP-A) No. 8-22206).

In such an electromagnetic induction heating type fixing unit, to wrap around a visible image and to uniformly heat and fuse the visible image, a film having a rubber elastic layer on the surface thereof is placed in between a heater and a recording medium. When the rubber elastic layer is formed with a silicone rubber or the like, the heat responsiveness becomes poor due to its low thermal conductance, resulting in an extremely large temperature difference between the inner surface of the film heated from the heater and the outer surface of the film being contact with a toner. When a toner adhesion amount is large, the belt surface temperature is rapidly lowered, sufficient fixing ability cannot be ensured, and consequently so-called cold offset may occur.

Further, a fixing unit used in an electrophotographic image forming apparatus is required to have toner-releasing property (hereinafter, may be referred to as "offset resistance") to a heating member. Such offset resistance can be improved by making a releasing agent exist on the surface of the toner, however, when a predetermined toner is used or a used toner is reused, the amount of a releasing agent existing on the toner surface is reduced and the offset resistance of the toner may degrade.

Further, with achievement of an image forming apparatus allowing high-speed performance and energy saving, there is a need to use a toner that is excellent in low-temperature fixing property. In the meanwhile, a toner having offset resistance and storage stability (blocking resistance) conflicting with the low-temperature fixing property is required. To respond to the need, a toner using an aromatic polyester resin is proposed, however, the toner has a shortcoming of being poor in pulverizability in production process. To address the shortcoming, a method is proposed in which a low-molecular weight polyester using an aliphatic alcohol which is excellent in pulverizability as a monomer and a high-molecular weight polyester are blended. (see Japanese Patent Application Laid-Open (JP-A) No. 2002-287427). However, a low-molecular weight polyester using an aliphatic alcohol has a low glass transition temperature because of its structure, the storage stability of the toner degrades, and thus it is difficult to keep both offset resistance and storage stability at a high level. Furthermore, with speeding up of developing in recent years, a toner is required to have a high-charge rising property, however, the toner does not have sufficient charge rising property.

To improve charge rising property of a toner, adding a charge controlling agent in a toner is the most common method. For typical charge controlling agents, chelate compounds containing salicylic acid, oxysalicylic acid or the like as a ligand are exemplified. Metal complex salts of such salicylic acid derivatives are proposed in Japanese Patent Application Laid-Open (JP-A) Nos. 62-145255, 55-42752 and the like, however, in these proposals, the controlling agents respectively contain heavy metal such as Cr and Co, and accordingly it is unfavorable to use them in terms of environmental safety.

Then, in consideration of environmental safety, there have been a number of salicylic acid derivatives proposed which have Fe as a central metal and contains no heavy metals such as Cr and Co therein. For example, Japanese Patent Application Laid-Open (JP-A) No. 1-309072 discloses an effect of limiting controlling agents to be used to metal complexes of salicylic acid derivatives having a carboxyl group or a sulfoxylic group as a substituent group. Japanese Patent Application Laid-Open (JP-A) No. 9-325520 discloses an effect of using only a combination of specific resins and a combination of iron complexes of salicylic acid as ligands. Further, Japanese Patent Application Laid-Open (JP-A) Nos. 7-230188 and 10-10785 respectively disclose an effect of using a combination of iron complexes of specific resins and oxycarboxylic acid as ligands. However, the proposed techniques exert their effects only when limiting it to a combination of a specific resin and an iron complex of salicylic acid derivative.

Further, Japanese Patent Application Laid-Open (JP-A) No. 2001-343787 discloses an effect of using a combination of a non-linear polyester resin which specifies a hydroxy value and a metal complex of salicylic acid derivative, however, when using a polyester resin in which an aliphatic alcohol that is not particularly limited is used as a monomer, the charge amount distribution becomes wide to cause a variation in charge amount among toner particles. Furthermore, because of the structure of the monomer, the mechanical strength of the toner is weak, and the surface of the toner deteriorates by being stirred and shared in a developing device, and the charge amount of toner is significantly reduced with stirring time, which adversely affects quality of image, consequently.

Accordingly, the present situation is that it is desired to immediately provide a toner which is excellent in all the properties of low-temperature fixing property, offset resistance, storage stability, charge rising property, charge stability with time and pulverizability and allows for forming high-quality images over a long period of time, an image forming apparatus using the toner, an image forming method using toner as well as a process cartridge using the toner.

BRIEF SUMMARY OF THE INVENTION

The present invention aims to solve the conventional problems and achieve the following objects. Specifically, the present invention aims to provide a toner which is excellent in all the properties of low-temperature fixing property, offset resistance, storage stability, charge rising property, charge stability with time and pulverizability and allows for forming high-quality images over a long period of time, and to provide an image forming apparatus, an image forming method and a process cartridge each of which uses the toner and allows for forming extremely high-quality images over a long period of time without causing color tone change and abnormal images such as reduction in image density and background smear.

The means to solve the aforementioned problems are as follows.

<1> A toner containing a binder resin, a colorant, and a charge controlling agent, wherein the charge controlling agent contains an aromatic oxycarboxylic acid metal compound having a trivalent or more central metal, the binder resin contains a polyester resin (A) having a softening point Tm (A) of 120° C. to 160° C. and a polyester resin (B) having a softening point Tm (B) of 80° C. to less than 120° C., and at least any one of the polyester resins (A) and (B) contains 1,2-propane diol at a content of 65 mol % or more in a divalent alcohol component and can be obtained by condensation polymerizing an alcohol component substantially composed of only an aliphatic alcohol with a carboxylic acid component.

<2> The toner according to the item <1>, wherein the aromatic oxycarboxylic acid metal compound is represented by the following General Formula (1), General Formula (1)

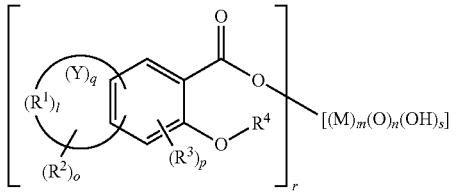

where, $R^1$ represents any one of a carbon atom, a methine group and a methylene group, the methine group and the methylene group may respectively contain a hetero atom selected from N, S and P; "Y" represents a ring structure linked by saturated bond(s) or unsaturated bond(s); $R^2$ and $R^3$ respectively represent a hydrogen atom, a halogen atom, a hydroxyl group, a nitro group, a nitroso group, a sulfonyl group, a cyano group, an alkyl group, alkenyl group, an alkoxy group, an aryl group, an aryloxy group, an aralkyl group, an aralkyloxy group, an amino group, a carboxyl group and a carbonyl group, and when "o" and "p" are respectively an integer of 1 or more, $R^2$ and $R^3$ may be the same to each other or different from each other, and $R^2$ and $R^3$ may be further substituted by a substituent group; $R^4$represents any one of a hydrogen atom and an alkyl group; "1" is zero or an integer of 3 to 12; "m" is an integer of 1 to 20; "n" is zero or an integer of 1 to 20; "o" is zero or an integer of 1 to 4; "p" is zero or an integer of 1 to 4; "q" is zero or an integer of 1 to 3; "r" is an integer of 1 to 20; "s" is zero or an integer of 1 to 20; and "M" is a trivalent or more central metal.

<3> The toner according to any one of the items <1> to <2>, wherein the central metal is iron.

<4> The toner according to any one of the items <1> to <2>, wherein the central metal is zirconium.

<5> The toner according to any one of the items <1> to <4>, wherein the content of the aliphatic alcohol in the alcohol component is 90 mol % or more.

<6> The toner according to any one of the items <1> to <5>, wherein the alcohol component contained in at least any one of the polyester resins (A) and (B) further contains glycerine.

<7> The toner according to any one of the items <1> to <6>, wherein the alcohol component contained in the polyester resin (A) further contains 1,3-propane diol.

<8> The toner according to any one of the items <1> to <7>, wherein the carboxylic acid component contained in at least any one of the polyester resins (A) and (B) contains an aliphatic dicarboxylic acid compound having 2 to 4 carbon atoms.

<9> The toner according to any one of the items <1> to <8>, wherein the carboxylic acid component contained in at least any one of the polyester resins (A) and (B) contains a purified rosin.

<10> The toner according to any one of the items <1> to <9>, wherein the mass ratio of the polyester resin (A) to the polyester resin (B) [(A)/(B)] is 1/9 to 9/1.

<11> The toner according to any one of the items <1> to <10>, wherein the difference in softening point (Tm) between the polyester resin (A) and the polyester resin (B) [Tm (A)–Tm (B)] is 10° C. or more.

<12> The toner according to any one of the items <1> to <11>, wherein the weight average particle diameter of the toner is 3μm to 10 μm.

<13> A developer containing a toner, wherein the toner contains a binder resin, a colorant and a charge controlling agent; the charge controlling agent contains an aromatic oxycarboxylic acid metal compound having a trivalent or more central metal, the binder resin contains a polyester resin (A) having a softening point Tm (A) of 120° C. to 160° C. and a polyester resin (B) having a softening point Tm (B) of 80° C. to less than 120° C., and at least any one of the polyester resins (A) and (B) contains 1,2-propane diol at a content of 65 mol % or more in a divalent alcohol component and can be obtained by condensation polymerizing an alcohol component substantially composed of only an aliphatic alcohol with a carboxylic acid component.

<14> A toner container filled with a toner, wherein the toner is a toner according to any one of the items <1> to <12>.

<15> An image forming apparatus having a latent electrostatic image bearing member, a charging unit configured to charge the surface of the latent electrostatic image bearing member, an exposing unit configured to expose the charged surface of the latent electrostatic image bearing member to form a latent electrostatic image, a developing unit configured to develop the latent electrostatic image using a toner to form a visible image, a transfer unit configured to transfer the visible image onto a recording medium, and a fixing unit configured to fix the transferred image on the recording medium, wherein the toner is a toner according to any one of the items <1> to <12>.

<16> The image forming apparatus according to the item s<15>, wherein the charging unit is configured to charge the surface of the latent electrostatic image bearing member in non-contact with the latent electrostatic image bearing member.

<17> The image forming apparatus according to the item <15>, wherein the charging unit is configured to charge the surface of the latent electrostatic image bearing member in contact with the latent electrostatic image bearing member.

<18> The image forming apparatus according to any one of the items <15> to <17>, wherein the developing unit has a magnetic field generating unit fixed inside the developing unit and a developer carrier that carries a two-component developer composed of a magnetic carrier and the toner on the surface of the developing unit, and the developing unit is rotatable.

<19> The image forming apparatus according to any one of the items <15> to <17>, wherein the developing unit has a developer carrier to which the toner is supplied and a layer thickness controlling member that forms a toner-thin layer on the surface thereof.

<20> The image forming apparatus according to any one of the items <15> to <19>, wherein the transfer unit is configured to transfer a visible image formed on the latent electrostatic image bearing member onto a recording medium.

<21> The image forming apparatus according to any one of the items <15> to <20>, wherein a plurality of image forming sections are arranged, each of which has at least a latent electrostatic image bearing member, a charging unit, a developing unit and a transfer unit, and the transfer unit is configured to sequentially transfer visual images formed on each of the respective latent electrostatic image bearing members onto a recording medium whose surface moves so as to pass a transfer position that faces the respective latent electrostatic image bearing members.

<22> The image forming apparatus according to any one of the items <15> to <19>, wherein the transfer unit has an intermediate transfer member on which a visible image formed on the latent electrostatic image bearing member is primarily transferred and a secondary transfer unit configured to secondarily transfer the visible image carried by the intermediate transfer member onto a recording medium.

<23> The image forming apparatus according to any one of the items <15> to <22>, further having a cleaning unit, wherein the cleaning unit has a cleaning blade that makes contact with the surface of the latent electrostatic image bearing member.

<24> The image forming apparatus according to any one of the items <15> to <22>, wherein the developing unit has a developer carrier that makes contact with the surface of the latent electrostatic image bearing member and is configured to develop a latent electrostatic image formed on the latent electrostatic image bearing member and collect a residual toner remaining on the surface of the latent electrostatic image bearing member.

<25> The image forming apparatus according to any one of the items <15> to <24>, wherein the fixing unit has at least any one of a roller and a belt and is configured to fix a transferred image on a recording medium by heating the transferred image from the surface of at least any one of the roller and the belt that does not make contact with the toner and pressurizing the transferred image on the recording medium.

<26> The image forming apparatus according to any one of the items <15> to <24>, wherein the fixing unit has at least any one of a roller and a belt and is configured to fix a transferred image on a recording medium by heating the transferred image from the surface of at least any one of the roller and the belt that makes contact with the toner and pressurizing the transferred image on the recording medium.

<27> An image forming method including charging the surface of a latent electrostatic image bearing member, exposing the charged surface of the latent electrostatic image bearing member to form a latent electrostatic image, developing the latent electrostatic image using a toner to form a visible image, transferring the visible image onto a recording medium, and fixing the transferred image on the recording medium, wherein the toner is a toner according to any one of the items <1> to <12>.

<28> The image forming method according to the item <27>, wherein the surface of the latent electrostatic image bearing member is charged in non-contact with the latent electrostatic image bearing member.

<29> The image forming method according to the item <27>, wherein the surface of the latent electrostatic image bearing member is charged in contact with the latent electrostatic image bearing member.

<30> The image forming method according to any one of the items <27> to <29>, wherein the latent electrostatic image is developed using a rotatable developing unit that has a magnetic field generating unit fixed inside the developing unit and a developer carrier that carries a two-component developer composed of a magnetic carrier and the toner on the surface of the developing unit.

<31> The image forming method according to any one of the items <27> to <29>, wherein the latent electrostatic image is developed using a developing unit that has a developer carrier to which the toner is supplied and a layer thickness controlling member that forms a toner-thin layer on the surface thereof.

<32> The image forming method according to any one of the items <27> to <31>, wherein in the transferring, a visible image formed on the latent electrostatic image bearing member is transferred onto a recording medium.

<33> The image forming method according to any one of the items <27> to <32>, wherein an image is formed using a plurality of image forming sections are arranged, each of which has at least a latent electrostatic image bearing member, a charging unit, a developing unit and a transfer unit, and the transfer unit is configured to sequentially transfer visual images formed on each of the respective latent electrostatic image bearing members onto a recording medium whose surface moves so as to pass a transfer position that faces the respective latent electrostatic image bearing members.

<34> The image forming method according to any one of the items <27> to <31>, wherein in the transferring, a transfer unit is used which has an intermediate transfer member on which a visible image formed on the latent electrostatic image bearing member is primarily transferred and a secondary transfer unit configured to secondarily transfer the visible image carried by the intermediate transfer member onto a recording medium.

<35> The image forming method according to any one of the items <27> to <34>, further including cleaning the surface of the latent electrostatic image bearing member using a cleaning blade that makes contact with the surface of the latent electrostatic image bearing member.

<36> The image forming method according to any one of the items <27> to <34>, wherein in the developing, a developing unit is used which has a developer carrier that makes contact with the surface of the latent electrostatic image bearing member and is configured to develop a latent electrostatic image formed on the latent electrostatic image bearing member and collect a residual toner remaining on the surface of the latent electrostatic image bearing member.

<37> The image forming method according to any one of the items <27> to <36>, wherein in the fixing, a transferred image is fixed on a recording medium using a fixing unit that has at least any one of a roller and a belt and is configured to fix a transferred image on a recording medium by heating the transferred image from the surface of at least any one of the roller and the belt that does not make contact with the toner and pressurizing the transferred image on the recording medium.

<38> The image forming method according to any one of the items <27> to <36>, wherein in the fixing, a transferred image is fixed on a recording medium using a fixing unit that has at least any one of a roller and a belt and is configured to fix a transferred image on a recording medium by heating the transferred image from the surface of at least any one of the roller and the belt that makes contact with the toner and pressurizing the transferred image on the recording medium.

<39> A process cartridge detachably mountable to an image forming apparatus main body including a latent electrostatic image bearing member, and a developing unit configured to develop a latent electrostatic image formed on the latent electrostatic image bearing member using a toner to form a visible image, wherein the toner is a toner according to any one of the items <1> to <12>.

The toner of the present invention contains at least a binder resin, a colorant and a charge controlling agent, wherein the charge controlling agent contains an aromatic oxycarboxylic acid metal compound having a trivalent or more central metal, the binder resin contains a polyester resin (A) having a softening point Tm (A) of 120° C. to 160° C. and a polyester resin (B) having a softening point Tm (B) of 80° C. to less than 120° C., and at least any one of the polyester resins (A) and (B) contains 1,2-propane diol at a content of 65 mol % or more in a divalent alcohol component and can be obtained by condensation polymerizing an alcohol component substantially composed of only an aliphatic alcohol with a carboxylic acid component. In the toner of the present invention, the polyester resin (A) having a high-softening point contributes to enhancement of offset resistance, the polyester resin (B) having a low-softening point contributes to enhancement of low-temperature fixing property, and the use of a combination thereof is effective to obtain both of the low-temperature fixing property and the offset resistance. The 1,2-propane diol which is a branched-chain alcohol having 3 carbon atoms is more effective in enhancing the low-temperature fixing property of the toner while maintaining its offset resistance than use of an alcohol having 2 or less carbon atoms and allows for fixing an image at an extremely low temperature and improving storage stability of the toner. The aromatic oxycarboxylic acid metal compound having a trivalent or more central metal can be extremely excellently dispersed in a polyester resin containing 1,2-propane diol as an alcohol component and is excellent in charge rising property. Then, by synergistic action of these compounds, it is possible to produce a toner which is excellent in all the properties of low-temperature fixing property, offset resistance, storage stability, charge rising property, charge stability with time and pulverizability and also possible to form a high-quality image.

The developer of the present invention contains the toner of the present invention. Therefore, when an image is formed through an electrophotographic process using the developer, a high-quality image can be obtained because the toner is excellent in all the properties of low-temperature fixing property, offset resistance, storage stability, charge rising property, charge stability with time and pulverizability.

A toner container according to the present invention houses the toner of the present invention therein. Therefore, when an image formed through an electrophotographic process using the toner housed in the toner container, a highly fine image can be favorably formed because the toner is excellent in all the properties of low-temperature fixing property, offset resistance, storage stability, charge rising property, charge stability with time and pulverizability.

The image forming apparatus of the present invention has at least a latent electrostatic image bearing member, a charging unit configured to charge the surface of the latent electrostatic image bearing member, an exposing unit configured to expose the charged surface of the latent electrostatic image bearing member to form a latent electrostatic image, a developing unit configured to develop the latent electrostatic image using a toner to form a visible image, a transfer unit configured to transfer the visible image onto a recording medium and a fixing unit configured to fix the transferred image on the recording medium, in which for the toner, the toner of the present invention is used.

In the image forming apparatus of the present invention, the charging unit uniformly charges the surface of the latent electrostatic image bearing member. The exposing unit exposes the surface of the latent electrostatic image bearing member to form a latent electrostatic image. The developing unit develops the latent electrostatic image formed on the latent electrostatic image bearing member using a toner to form a visible image. The transfer unit transfers the visible image onto a recording medium. The fixing unit fixes a transferred image on the recording medium. In the image formation process, since the toner of the present invention is used, it is possible to form an extremely high-quality image over a long period of time without substantially causing a change in color tone and abnormal images such as reduction in image density and background smear.

The image forming method of the present invention includes at least charging the surface of a latent electrostatic image bearing member, exposing the charged surface of the latent electrostatic image bearing member to form a latent electrostatic image, developing the latent electrostatic image using a toner to form a visible image, transferring the visible image onto a recording medium and fixing the transferred image on the recording medium, in which for the toner, the toner of the present invention is used.

In the image forming method of the present invention, the surface of the latent electrostatic image bearing member is uniformly charged in the charging step. The surface of the latent electrostatic image bearing member is exposed to form a latent electrostatic image in the exposing step. The latent electrostatic image formed on the latent electrostatic image bearing member is developed using a toner to form a visible image in the developing step. The visible image is transferred onto a recording medium in the transferring step. The transferred image is fixed on the recording medium in the fixing step. In the image formation process, since the toner of the present invention is used, it is possible to form extremely high-quality images over a long period of time without substantially causing a change in color tone and abnormal images such as reduction in image density and background smear.

The process cartridge of the present invention has at least a latent electrostatic image bearing member and a developing unit configured to develop a latent electrostatic image formed on the latent electrostatic image bearing member using a toner to form a visible image. Because the process cartridge is detachably mounted to a main body of an image forming apparatus and is excellent in convenience, and the toner of the present invention is used, it is possible to form extremely high-quality images over a long period of time without substantially causing a change in color tone and abnormal images such as reduction in image density and background smear.

The present invention can solve the aforementioned conventional problems and provide a toner which is excellent in all the properties of low-temperature fixing property, offset resistance, storage stability, charge rising property, charge stability with time and pulverizability and allows for forming high-quality images over a long period of time. The present invention can also provide an image forming apparatus, an image forming method and a process cartridge each of which uses the toner and allows for forming extremely high-quality images over a long period of time without substantially causing a change in color tone and abnormal images such as reduction in image density and background smear.

Because the toner of the present invention is excellent in all the properties of low-temperature fixing property, offset resistance, storage stability, charge rising property, charge stability with time and pulverizability, it is suitably used in electrophotographic image forming apparatuses, image forming methods, developers, toner containers and process cartridges.

Because the image forming apparatus, the image forming method and the process cartridge of the present invention respectively use the toner of the present invention and respectively allow for forming extremely high-quality images over a long period of time without substantially causing a change in color tone and abnormal images such as reduction in image density and background smear, they can be widely used for, for example, laser printers, direct digital photoengraving machines, full-color copiers based on a direct or indirect electrophotographic multi-color image developing method, full-color laser printers and full-color regular paper facsimiles and the like.

DETAILED DESCRIPTION OF THE INVENTION (Toner)

Figure 1:
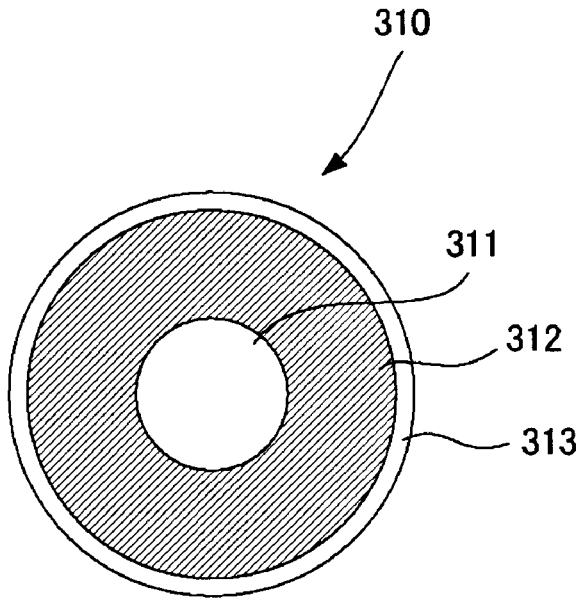
FIG. 1 is a cross-sectional view schematically showing one example of a charging roller used in an image forming apparatus of the present invention.

The toner of the present invention contains at least a binder resin, a colorant and a charge controlling agent and contains a releasing agent, external additive and other components in accordance with necessity.

<Binder Resin>

The binder resin contains a polyester resin (A) having a softening point Tm (A) of 120° C. to 160° C. and a polyester resin (B) having a softening point Tm (B) of 80° C. to less than 120° C., and these polyester resins (A) and (B) can be obtained by condensation polymerizing an alcohol component with a carboxylic acid component.

The softening point Tm (A) of the polyester resin (A) is 120° C. to 160° C., preferably 130° C. to 155° C., and more preferably 135° C. to 155° C.

The softening point Tm (B) of the polyester resin (B) is 80° C. to less than 120° C., preferably 85° C. to 115° C., and more preferably 90° C. to 110° C.

The difference in Tm (A) and Tm (B) [ΔTm; Tm (A)−Tm (B)] is preferably 10° C. or more, more preferably 15° C. to 55° C., and still more preferably 20° C. to 50° C.

The mass ratio [(A)/(B)] of the polyester resin (A) to the polyester resin (B) is preferably 1/9 to 9/1, more preferably 2/8 to 8/2, and still more preferably 3/7 to 7/3.

The polyester resin (A) having a high-softening point provided with the above-noted physical properties contributes to enhancement of offset resistance, and the polyester resin (B) having a low-softening point provided with the above-noted physical properties contributes to enhancement of low-temperature fixing property. Thus, the use of a combination of the polyester resin (A) with the polyester resin (B) is effective to obtain both low-temperature fixing property and offset resistance.

In the present invention, at least any one of the polyester resin (A) and the polyester resin (B) contains 1,2-propane diol at a content of 65 mol % or more in a divalent alcohol component and can be obtained by condensation polymerizing an alcohol component substantially composed of only an aliphatic alcohol with a carboxylic acid component.

-Alcohol Component-

The 1,2-propane diol which is a branched-chain alcohol having 3 carbon atoms used in the alcohol component is more effective in enhancing the low-temperature fixing property of the toner while maintaining its offset resistance than use of an alcohol having 2 or less carbon atoms and is more effective in preventing storage stability degradation associated with a reduction in glass transition temperature than use of a branched-chain alcohol having 4 or more carbon atoms. The 1,2-propane diol can exert effects that it allows for fixing an image at an extremely low temperature and improving storage stability of the toner. Further, a polyester rein containing 1,2-propane diol as an alcohol component has excellent dispersibility with the aromatic oxycarboxylic acid metal compound having a trivalent or more central metal, and is excellent in charge rising property. A study of the present inventors showed that particularly when 1,2-propane diol is contained at a content of 65 mol % or more in a divalent alcohol component, the dispersibility of the 1,2-propane diol is extremely excellent and the charge amount distribution of toner is extremely sharp, the mechanical strength of the toner is improved, and it is also possible to prevent a reduction in charging property with time that could be caused by being stirred and shared in a developing device. The reason can be presumed as follows: because the aromatic oxycarboxylic acid metal compound is finely dispersed in the polyester resin, a filler-effect is exerted and consequently, the mechanical strength of the toner is improved.

The alcohol component may contain alcohols other than 1,2-propane diol to such an extent not to impair the purpose and effects of the present invention, however, the content of 1,2-propane diol in a divalent alcohol component is 65 mol % or more, preferably 70mol % or more, more preferably 80 mol % or more, and still more preferably 90 mol % or more. Examples of the divalent alcohol components other than 1,2-propane diol include 1,3-propane diol, ethylene glycols each having a different carbon atoms, hydrogenated bisphenol A or aliphatic dialcohols such as alkylene (having 2 to 4carbon atoms) oxide adducts (the average addition number of moles: 1to 16).

The content of the divalent alcohol component is preferably 60mol % to 95 mol %, and more preferably 65 mol % to 90 mol %.

It is preferable that the alcohol component of the polyester resin (A) contain 1,3-propane diol from the perspective of offset resistance. The molar ratio of 1,2-propane diol to 1,3-propane diol (1,2-propane diol/1,3-propane diol) in the polyester resin (A) is preferably 99/1 to 65/35, more preferably 95/5 to 70/30, still more preferably 90/10 to 75/25, and particularly preferably 85/15 to 77/23.

The alcohol component of any one of the polyester resins (A) and (B) may contain aromatic alcohol such as bisphenol A alkylene oxide adducts of polyoxypropylene (2,2)-2,2-bis (4-hydroxyphenyl) propane, polyoxyethylene (2,2)-2,2-bis (4-hydroxyphenyl) propane or the like, however, the alcohol component of at least any one of the polyester resins (A) and (B) is virtually composed of only aliphatic alcohol(s), and preferably both alcohol components of the polyester resins (A) and (B) are virtually composed of only aliphatic alcohols.

Here, in the present invention, the terms "alcohol component virtually composed of only aliphatic alcohol(s)" means that the content of aliphatic alcohol(s) is 90 mol % or more in the alcohol component, and the content of aliphatic alcohol(s) is more preferably 95 mol % or more, still more preferably 98 mol % or more, and particularly preferably 99 mol % or more in the alcohol component.

-Carboxylic Acid Component-

The carboxylic acid component is not particularly limited and may be suitably selected in accordance with the intended use, however, it is preferred that the carboxylic acid component contains an aliphatic dicarboxylic acid compound having 2 to 4 carbon atoms. Examples of the aliphatic dicarboxylic acid compound having 2 to 4carbon atoms include adipic acids, maleic acids, malic acids, succinic acids, fumaric acids, citraconic acids, itaconic acids or anhydrides of these acids. Of these, from the perspective of effectiveness of enhancing low-temperature fixing property, at least one aliphatic dicarboxylic acid compound selected from succinic acids, fumaric acids, citraconic acids and itaconic acids is preferable, and an aliphatic dicarboxylic acid compound of itaconic acid is particularly preferable.

The content of the aliphatic dicarboxylic acid having 2 to 4carbon atoms is preferably 0.5 mol % to 20 mol % and more preferably 1 mol % to 10 mol % in the carboxylic acid component from the perspective of enhancing low-temperature fixing property and preventing a reduction in glass transition temperature. Because a polyester resin that can be obtained by condensation polymerizing such an aliphatic carboxylic acid compound having no aromatic ring with 1,2-propane diol has excellent solubility with releasing agents, the use of the polyester resin together with a releasing agent can further improve the toner filming resistance.

Further, it is preferable that the carboxylic component contain rosin. By using a rosin having a polycyclic aromatic ring, water-absorbing property of conventional aliphatic alcohol polyesters can be lowered, and an effect of preventing reductions in charge amount of toner under high-temperature and high-humidity conditions is further improved.

The rosin is a natural resin obtainable from pines, and the main component is a resin acid such as abietic acid, neoabietic acid, palustric acid, pimaric acid, isopimaric acid, sandaracopimaric acid and dehydroabietic acid or a mixture thereof.

The rosins are broadly classified into tall rosins obtainable from tall oils that can be obtained as by-products in a pulp manufacturing process, gum rosins obtainable from crude pine tar and wood rosins obtainable from pine strains. The rosin used in the present invention is preferably tall rosin from the perspective of low-temperature fixing property.

The rosin may be a modified rosin such as disproportionated rosin and hydrogenated rosin, however, in the present invention, it is preferable to use an unmodified rosin, a so-called crude rosin, from the perspective of low-temperature fixing property and storage stability.

The rosin is preferably purified from the perspective of enhancing storage stability and deodorization.

The purified rosin is a rosin whose impurities are removed in a purification process. Examples of major impurities 2-methylpropane, acetaldehyde, 3-methyl-2-butanone, 2-methyl propanoic acid, butanoic acid, pentanoic acid, n-hexanal, octane, hexanoic acid, benzaldehyde, 2-pentylfuran, 2,6-dimethyl cyclohexanone, 1, methyl-2-(1-methylethyl)benzene, 3,5-dimethyl 2-cyclohexane and 4-(1-methylethyl)benzaldehyde. In the present invention, of these impurities, peak intensities in three types of impurities of 2-methyl propane, pentanoic acid and benzaldehyde detected as volatile components in the Head-Space GC-MS analysis can be used as indicators of purified rosins. The reason why the volatile component of impurities is used as an indicator instead of using those absolute amounts is that a purified rosin is used to deodorize conventional polyester resins using rosin and the deodorization therefrom is addressed as one of the problems to solve in the present invention.

In the present invention, a purified rosin means a rosin that has a peak intensity of hexanoic acid of $0.8\times10^7$ or less, a peak intensity of pentanoic acid of $0.4\times10^7$ or less and a peak intensity of benzaldehyde of $0.4\times10^7$ or less under the following measurement conditions for the Head-Space GC-MS analysis. From the viewpoint of storage stability and deodorization of the polyester resin, a peak intensity of hexanoic acid is preferably $0.6\times10^7$ or less and more preferably $0.5\times10^7$ or less. The peak intensity of pentanoic acid is preferably $0.3\times10^7$ or less and more preferably $0.2\times10^7$ or less. The peak intensity of benzaldehyde is preferably $0.3\times10^7$ or less and more preferably $0.2\times10^7$ or less.

From the viewpoint of storage stability and deodorization of the polyester resin, besides the content of the above-noted three impurities, it is preferable that the content of n-hexanal and 2-pentylfuran be reduced. The peak intensity of n-hexanal is preferably $1.7\times10^7$ or less, more preferably $1.6\times10^7$ or less, and still more preferably $1.5\times10^7$ or less. The peak intensity of 2-pentylfuran is preferably $1.0\times10^7$ or less, more preferably $0.9\times10^7$or less, and still more preferably $0.8\times10^7$ or less.

A purification method of the rosin is not particularly limited and conventional methods can be utilized. Examples of thereof include distillation, re-crystallization, and extraction. It is preferable to purify a crude rosin by distillation. For the distillation method, for example, the methods described in Japanese Patent Application Laid-Open (JP-A) No. 7-286139 can be utilized, and reduced-pressure distillation, molecular distillation and steam distillation are exemplified. It is preferable to purify a crude rosin by distillation under reduced pressure. For example, distillation is generally carried out under a pressure of 6.67 kPa or less and a still temperature of 200° C. to 300° C., and simple distillation is commonly used, and other methods such as thin-film distillation and rectification distillation are used. Under a typical distillation condition, 2% by mass to 10% by mass of high-molecular weight material to the content of the placed rosin is removed as a pitch and 2% by mass to 10% by mass of an initial distillate is removed at the same time.

The softening point of the purified rosin is preferably 50° C. to 100° C., more preferably 60° C. to 90° C., and still more preferably 65° C. to 85° C. Impurities contained in the rosin can be removed by subjecting a rosin to a purification treatment. The softening point of the purified rosin in the present invention means a softening point that is measured when the purified rosin is once fused by the following method and thereafter naturally cooled under the condition of a temperature of 25° C. and a relative humidity of 50% for 1 hour.

The acidic value of the purified rosin is preferably 100 mgKOH/g to 200 mgKOH/g, more preferably 130 mgKOH/g to 180 mgKOH/g, and still more preferably 150 mgKOH/g to 170 mgKOH/g. The content of the purified rosin in the carboxylic acid component is preferably 2 mol % to 50 mol %, more preferably 5 mol % to 40 mol %, and still more preferably 10 mol % to 30 mol %.

The carboxylic acid component may contain carboxylic acid compounds other than the aliphatic carboxylic acid compound and the rosin to such an extent not to impair the effects of the present invention. From the perspective of ensuring the glass transition temperature of the carboxylic acid component, it is preferable that aromatic dicarboxylic acids such as phthalic acid, isophthalic acid and terephthalic acid be contained in the carboxylic acid component. The content of the aromatic dicarboxylic acid in the carboxylic acid component is preferably 40 mol % to 95 mol %, more preferably 50 mol % to 90 mol %, and still more preferably 60 mol % to 80 mol %.

It is preferred that the polyester resins are respectively a crosslinked polyester resin, and a trivalent or more raw material monomer is contained as a crosslinking agent in at least any one of the alcohol component and the carboxylic acid component. The content of the trivalent or more raw material monomer in the total amount of the alcohol component and the carboxylic acid component is preferably 0 mol % to 40 mol % and more preferably 5 mol % to 30mol %.

For trivalent or more of polyvalent carboxylic acid compounds used for the trivalent or more raw material monomers, for example, trimellitic acids or derivatives thereof are preferably exemplified. Examples of trivalent or more polyvalent alcohols include glycerine, pentaerythritol, trimethylolpropane, sorbitol or alkylene (having 2 to 4 carbon atoms) oxide adducts (the average addition number of moles: 1 to 16). Of these, glycerine is particularly preferable because it functions as a crosslinking agent but is also effective in enhancing low-temperature fixing property. From these viewpoints, it is preferable that the alcohol component of at least any one of the polyester resins (A) and (B) contain glycerine. The content of the glycerine in the alcohol component is preferably 5 mol % to 40 mol % and more preferably 10 mol % to 35 mol %.

-Esterified Catalyst-

Condensation polymerization of the alcohol component with the carboxylic acid component is preferably carried out in the presence of an esterification catalyst. Examples of the esterification catalyst include Lewis acids such as p-toluene sulfonate, titanium compounds, and tin (II) compounds having no Sn—C bond, and each of these esterification catalysts may be used alone or in combination with two or more. Of these, a titanium compound and a tin (II) compound having no Sn—C bond are particularly preferable.

For the titanium compound, a titanium compound having a Ti—O bond is preferable, and a compound having an alkoxy group, an alkenyloxy group or an acyloxy group each having the total number of carbon atoms of 1 to 28 is more preferable.

Examples of the titanium compound include titanium diisopropylate bis triethanolaminate [Ti $(C_6H_{14}O_3N)_2(C_3H_7O)_2$], titanium diisopropylate bis diethanolaminate [Ti $(C_4H_{10}O_2N)_2(C_3H_7O)_2$], titanium dipentylate bis triethanolaminate [$Ti(C_6H_{14}O_3N)_2(C_5H_{10})_2$], titanium diethylate bis triethanolaminate [$Ti(C_6H_{14}O_3N)_2(C_2H_5O)_2$], titanium dihydroxyoctylate bis triethanolaminate [$Ti(C_6H_{14}O_3N)_2(OHC_8H_{16}O)_2$], titanium distearate bis triethanolaminate [Ti $(C_6H_{14}O_3N)_2(C_{18}H_{37}O)_2$], titanium triisopropylate triethanolaminate [$Ti(C_6H_{14}O_3N)_1(C_3H_7O)_3$] and titanium monopropylate tris(triethanolaminate) [$Ti(C_6H_{14}O_3N)_3(C_3H_7O)_1$]. Of these, titanium diisopropylate bis triethanolaminate, titanium diisopropylate bis diethanolaminate and titanium dipentylate bis triethanolaminate are particularly preferable. These titanium compounds are commercially available, for example, from Matsumoto Trading Co., Ltd.

Examples of other preferred titanium compounds include tetra-n-butyl titanate [$Ti(C_4H_9O)_4$], tetrapropyl titanate [Ti $(C_3H_7O)_4$], tetrastearyl titanate [$Ti(C_{18}H_{37}O)_4$], tetramyristyl titanate [$Ti(C_{14}H_{29}O)_4$], tetraoctyl titanate [$Ti(C_8H_{17}O)_4$], dioctyldihydroxyoctyl titanate [$Ti(C_8H_{17}O)_2(OHC_8H_{16}O)_2$] and dimyristyl dioctyl titanate [Ti $(C_{14}H_{29}O)_2(C_8H_{17}O)_2$]. Of these, tetrastearyl titanate, tetramyristyl titanate, tetraoctyl titanate and dioctyldihydroxyoctyl titanate are preferable. These titanium compounds can be obtained by reacting a halogenated titanium to the corresponding alcohol, however, commercially products thereof are available from Nisso Co., Ltd.

The presence amount of the titanium compound to 100 parts by mass of the total amount of the alcohol component and the carboxylic acid component is preferably 0.01 parts by mass to 1.0 part by mass and more preferably 0.1 parts by mass to 0.7 parts by mass.

For the tin (II) compound having no Sn—C bond include, a tin (II) compound having an Sn—O bond and a tin (II) compound having an Sn—X bond ("X" represents a halogen atom) are preferable, and a tin (II) compound having an Sn—O bond is more preferable.

Examples of the tin (II) compound having an Sn—O bond include tin (II) carboxylates having a carboxy acid group that has 2 to 28 carbon atoms such as tin (II) oxalate, tin (II) diacetate, tin (II) octanoate, tin (II) lauryl acid, tin (II) distearates and tin (II) dioleate; dialkoxy tin (II) having an alkoxy group that has 2 to 28 carbon atoms such as dioctyloxy tin (II); dilauloxy tin (II), distearloxy tin (II) and dioleyloxy tin (II); tin (II) oxides; and tin (II) sulfates.

Examples of the compound having an Sn—X bond ("X" represents a halogen atom) include halogenated tins (II) such as tin (II) chlorides and tin (II) bromides. Of these, from the viewpoints of charge rising effect and catalytic ability, fatty acid tin (II) represented by $(R^1COO)_2Sn$ ($R^1$ represents an alkyl group or an alkenyl group having 5 to 19 carbon atoms), dialkoxy tin (II) represented by $(R^2O)_2Sn$ ($R^2$ represents an alkyl group or an alkenyl group having 6 to 20 carbon atoms), and tin (II) oxide represented by SnO are preferable. Fatty acid tin (II) represented by $(R^1COO)_2Sn$ and tin (II) oxide are more preferable. Tin (II) octanoate, tin (II) distearate and tin (II) oxide are more preferable.

The presence amount of the tin (II) compound having no Sn—C bond to 100 parts by mass of the total amount of the alcohol component and the carboxylic acid component is preferably 0.01 parts by mass to 1.0 part by mass and more preferably 0.1 parts by mass to 0.7 parts by mass.

When the titanium compound is used together with the tin (II) compound having no Sn—C bond, the total presence amount of the titanium compound and the tin (II) compound is preferably 0.01 parts by mass to 1.0 part by mass and more preferably 0.1 parts by mass to 0.7 parts by mass to 100 parts by mass of the total amount of the alcohol component and the carboxylic acid component.

The condensation polymerization of the alcohol component with the carboxylic acid component can be carried out, for example, in the presence of the esterification catalyst, in an inert gas atmosphere and at a temperature of 180° C. to 250° C. The softening point of the polyester resin can be controlled by the reaction time.

The grass transition temperature of the polyester resins (A) and (B) is preferably 45° C. to 75° C., more preferably 50° C. to 70° C. and still more preferably 50° C. to 65° C. from the perspective of fixing ability, storage stability and durability. The acidic value of the polyester resins (A) and (B) is preferably 1 mgKOH/g to 80 mgKOH/g and more preferably 10 mgKOH/g to 50 mgKOH/g.

In the present invention, it is preferable that the polyester resins (A) and (B) be respectively an amorphous polyester, which differs from crystalline resins. In the present invention, the term "amorphous polyester" means a polyester of which the softening point temperature is 30° C. or higher or 30° C. or lower than the glass transition temperature.

The polyester resins (A) and (B) may by a modified polyester resin. The modified polyester resin means a polyester resin that is grafted or blocked with phenol, urethane or the like.

In the binder resin, conventionally known binder resins, for example, vinyl resin such as styrene-acrylic resin and other resins such as epoxy resin, polycarbonate and polyurethane may be used in combination, however, the total content of the polyester resin (A) and the polyester resin (B) in the binder resin is preferably 70% by mass or more, more preferably 80% by mass or more, still more preferably 90% by mass or more, and particularly preferably 100% by mass.

<Charge Controlling Agent>

The charge controlling agent contains an aromatic oxycarboxylic acid metal compound having a trivalent or more central metal.

For the aromatic oxycarboxylic acid metal compound having a trivalent or more central metal, for example, a compound represented by the following General Formula (1) is preferable.

General Formula (1)

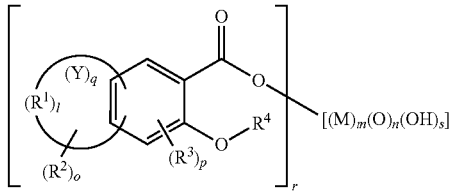

In the General Formula (1), $R^1$ represents any one of a carbon atom, a methine group and a methylene group, the methine group and the methylene group may respectively contain a hetero atom selected from N, S and P; "Y" represents a ring structure linked by saturated bond(s) or unsaturated bond(s); $R^2$ and $R^3$ respectively represent a hydrogen atom, a halogen atom, a hydroxyl group, a nitro group, a nitroso group, a sulfonyl group, a cyano group, an alkyl group, alkenyl group, an alkoxy group, an aryl group, an aryloxy group, an aralkyl group, an aralkyloxy group, an amino group, a carboxyl group and a carbonyl group, and when "o" and "p" are respectively an integer of 1or more, $R^2$ and $R^3$ may be the same to each other or different from each other, and $R^2$ and $R^3$ may be further substituted by a substituent group; $R^4$ represents any one of a hydrogen atom and an alkyl group; "1" is zero or an integer of 3 to 12; "m" is an integer of 1 to 20; "n" is zero or an integer of 1 to 20; "o" is zero or an integer of 1 to 4; "p" is zero or an integer of 1 to 4; "q" is zero or an integer of 1 to 3; "r" is an integer of 1 to 20; "s" is zero or an integer of 1 to 20; and "M" is a trivalent or more central metal.

The alkyl group in the $R^2$, $R^3$ and $R^4$ preferably has 1 to 18carbon atoms, and examples thereof include methyl group, ethyl group, propyl group, isopropyl group, butyl group, isobutyl group, sec-butyl group, tert-butyl group, pentyl group, isopentyl group, neopentyl group, hexyl group, heptyl group, octyl group, nonyl group, decyl group, undecyl group, dodecyl group, vinyl group, benzyl group, phenethyl group, styryl group, cyclopentyl group, cyclohexyl group, cycloheptyl group and cyclohexenyl group.

Examples of the aryl group include phenyl group, tolyl group, xylyl group, styryl group, naphthyl group, anthryl group and biphenyl group.

Examples of the alkoxy group include methoxy group, ethoxy group, butoxy group, propyoxy group, butoxy group, hexyloxy group, cyclohexyloxy group, heptyloxy group, octyloxy group, tertiary octyloxy group, 2-ethylhexyloxy group, decyloxy group, dedecyloxy group and octadecyloxy group.

Examples of the aryloxy group include phenyloxy group, naphthyloxy group and anthranyloxy group.

Examples of the aralkyl group include benzyl group, phenylethyl group and phenylpropyl group.

Examples of the alkenyl group include vinyl group, allyl group, propenyl group, isopropenyl group, butenyl group, hexenyl group, cyclohexenyl group and octenyl group.

Examples of the substituent group that is represented by the $R^2$ or $R^3$ and may be further substituted by a substituent group include alkyl group such as halogen atom, nitro group, cyano group, methyl group and ethyl group, alkoxy group such as methoxy group and ethoxy group, aryl oxy group such as phenoxy group, aryl group such as phenyl group and nephthyl group, and aralkyl groups.

Examples of the ring structure represented by Y include aliphatic rings, aromatic rings and heterocyclic rings.

When $R^4$ is a hydrogen atom, the aromatic oxycarboxylic acid metal compound sometimes contains a structure represented by the following General Formula (3), and such an aromatic oxycarboxylic acid metal compound can also be used without causing problems.

General Formula (3)

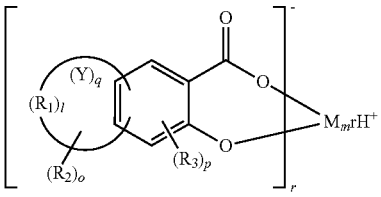

In the General Formula (3), $R^1$, $R^2$, $R^3$, Y, M, "l", "m", "n", "o", "p", "q" and "r" respectively have the same meaning as those described in the General Formula (1).

The central metal "M" is not particularly limited and any trivalent or more metal can be used, however, preferred examples thereof are Fe, Ni, Al, Ti and Zr. Of these metals, Fe and Zr are particularly preferable because of the excellent charge rising property. Further, Fe is preferably used in terms of safety, and Zr is preferably used in terms that the compound is white and suitable for color toner. When the aromatic oxycarboxylic acid metal compound has a trivalent or more central metal, it is extremely excellently dispersible in a polyester resin containing 1,2-propane diol as an alcohol component and is also excellent in charge rising property. In contrast, when the aromatic oxycarboxylic acid metal compound has a divalent central metal, it cannot be excellently dispersed in such a polyester resin, although it is excellent in charge resizing property. Therefore, it is impossible to obtain an effect of preventing a reduction in charge amount that could be caused by time degradation of toner. Thus, the aromatic oxycarboxylic acid metal compound having a trivalent or more central metal is preferably a compound represented by the General Formula (1).

The aromatic oxycarboxylic acid site in the aromatic oxycarboxylic acid metal compound having a trivalent or more central metal can be represented by the following General Formula (2).

General Formula (2)

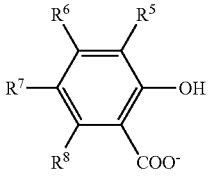

In the General Formula (2), it is preferable that $R^5$, $R^6$, $R^7$ and $R^8$ respectively represent a hydrogen atom, a straight chain alkyl group having 1 to 18 carbon atoms, a branched alkyl group having 1to 18 carbon atoms or an aryl group, and $R^5$, $R^6$, $R^7$ and $R^8$ may be the same to each other or different from each other, further, $R^5$ and $R^6$, $R^6$ and $R^7$, $R^7$ and $R^8$ may be respectively linked to each other to form an aromatic ring that may have a substituent group or an aliphatic ring that may have a substituent group.

Examples of the alkyl group and aryl group in the General Formula (2) are those described in the General Formula (1).

Hereinafter, specific examples of the aromatic oxycarboxylic acid site represented by the General Formula (2) will be described, however, the examples thereof are not limited to the disclosed examples.

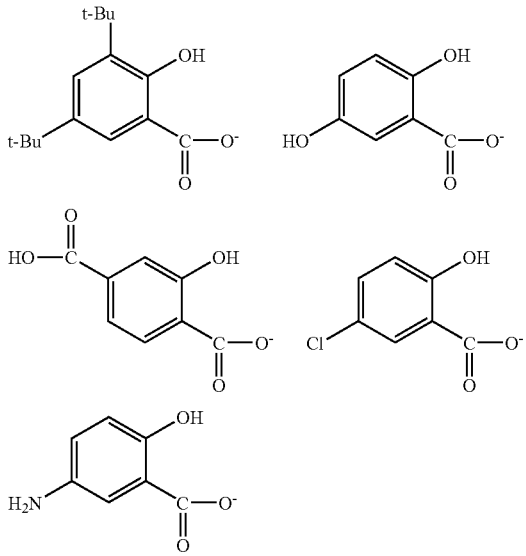

In the above-noted structural formulas, "t-Bu" represents a tertiary butyl group.

Hereinafter, specific examples of the aromatic oxycarboxylic acid metal compound represented by the General Formula (1) will be described, however, the examples thereof are not limited to the disclosed examples. Each of these compounds may be used alone or in combination with two or more. In the following structural formulas, "t-Bu" represents a tertiary butyl group.

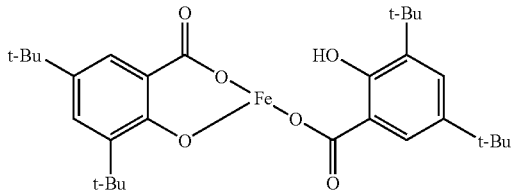

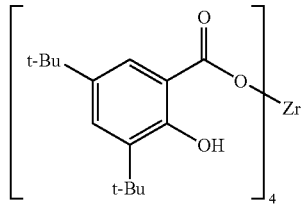

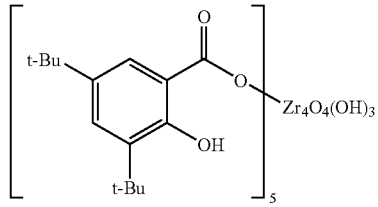

-continued

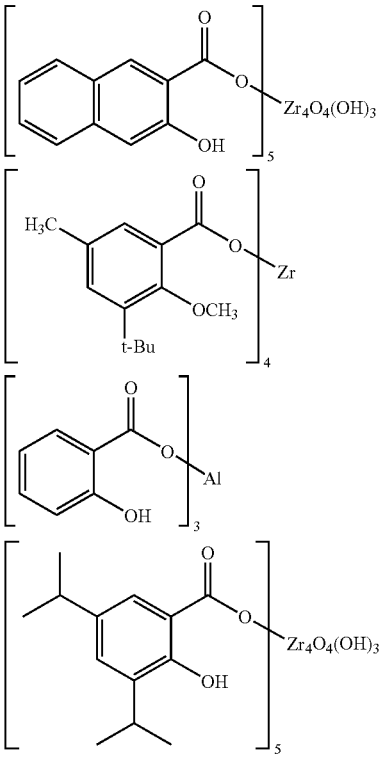

The content of the aromatic oxycarboxylic acid metal compound having a trivalent or more central metal in the toner cannot be unequivocally described because it is determined by the toner production method used including the composition of resins and dispersion method, however, it is preferably 0.1 parts by mass to 10parts by mass, more preferably 0.5 parts by mass to 5 parts by mass, and still more preferably 0.5 parts by mass to 2 parts by mass to 100 parts by mass of the binder resin. When the content of the aromatic oxycarboxylic acid metal compound having a trivalent or more central metal is less than 0.1 parts by mass, an effect of obtaining excellent charge rising property and an effect of preventing a reduction in charge stability with time are hardly obtained, and when the content is more than 10 parts by mass, it may result in an excessively charged amount of toner and/or impaired low-temperature fixing property of the toner.

In the toner of the present invention, conventionally known charge controlling agents may be used in combination in accordance with necessity. The charge controlling agents are not particularly limited and may be suitably selected in accordance with the intended use, and examples thereof include triphenylmethane dyes, molybdenum acid chelate pigments, Rhodamine dyes, alkoxy amines, quaternary ammonium salts (including fluorine-modified quaternary ammonium salts), alkyl amides, phosphorous monomers or compounds thereof, tungsten monomers or compounds thereof, fluorine activators, metal salts of salicylic acid and metal salts of salicylic acid derivatives. Each of these charge controlling agents may be used alone or in combination with two or more.

The charge controlling agents may be fused and kneaded with the masterbatch and thereafter dissolved or dispersed in the masterbatch, or may be directly dissolved or dispersed together with the respective toner components in the organic solvent or may be fixed on the toner surface after toner particles are produced.

-Colorant-

The colorant is not particularly limited and may be suitably selected from among conventional dyes and pigments in accordance with the intended use. Examples thereof include carbon black, nigrosine dye, iron black, naphthol yellow S, Hansa yellow (10G, 5G, and G), cadmium yellow, yellow iron oxide, yellow ocher, yellow lead, titanium yellow, polyazo yellow, oil yellow, Hansa yellow (GR, A, RN, R), pigment yellow L, benzidine yellow (G, GR), permanent yellow (NCG), vulcan fast yellow (5G, R), tartrazinelake yellow, quinoline yellow lake, anthrasan yellow BGL, isoindolinon yellow, colcothar, red lead, lead vermilion, cadmium red, cadmium mercury red, antimony vermilion, permanent red 4R, parared, fiser red, parachloroorthonitro aniline red, lithol fast scarlet G, brilliant fast scarlet, brilliant carmine BS, permanent red (F2R, F4R, FRL, FRLL, F4RH), fast scarlet VD, vulcan fast rubine B, brilliant scarlet G, lithol rubine GX, permanent red F5R, brilliant carmine 6B, pigment scarlet 3B, bordeaux 5B, toluidine Maroon, permanent bordeaux F2K, Helio bordeaux BL, bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, victoria blue lake, metal-free phthalocyanine blue, phthalocyanine blue, fast sky blue, indanthrene blue (RS, BC), indigo, ultramarine, iron blue, anthraquinon blue, fast violet B, methylviolet lake, cobalt purple, manganese violet, dioxane violet, anthraquinon violet, chrome green, zinc green, chromium oxide, viridian green, emerald green, pigment green B, naphthol green B, green gold, acid green lake, malachite green lake, phthalocyanine green, anthraquinon green, titanium oxide, zinc flower, lithopone, and mixtures thereof. Each of these colorants may be used alone or in combination with two or more.

The color of the colorant is not particularly limited, may be suitably selected in accordance with the intended use, and examples thereof include colorants for black and colorants for color. Each of these colorants may be used alone or in combination with two or more.

Examples of the colorants for black include carbon black pigments (C.I. Pigment Black 7) such as Furness black, lamp black, acetylene black and channel black; metal pigments such as copper, iron (C.I. Pigment Black 11), and titanium oxide; and organic pigments such as aniline black (C.I. Pigment Black 1).

Examples of magenta colorant pigments include C.I. Pigments Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 48:1, 49, 50, 51, 52, 53, 53:1, 54, 55, 57, 57:1, 58, 60, 63, 64, 68, 81, 83, 87, 88, 89, 90, 112, 114, 122, 123, 163, 177, 179, 202, 206, 207, 209 and 211; C.I. Pigment Violet 19; C.I. Bat Red pigments 1, 2, 10, 13, 15, 23, 29 and 35.

Examples of cyan colorant pigments include C.I. Pigments Blue 2, 3, 15, 15:1, 15:2, 15:3, 15:4, 15:6, 16, 17 and 60; C.I. Bat Blue 6; C.I. Acid Blue 45 or copper phthalocyanine pigments in which 1 to 5phthalimide methyl groups are substituted to a phthalocyanine skeleton, Green 7 and Green 36.

Examples of yellow colorant pigments include C.I. Pigments Yellow 0-16, 1, 2, 3, 4, 5, 6, 7, 10, 11, 12, 13, 14, 15, 16, 17, 23, 55, 65, 73, 74, 83, 97, 110, 151, 154 and 180; C.I. Bat Yellow pigments 1, 3and 20; and Orange 36.

The content of the colorant(s) in the toner is not particularly limited and may be suitably selected in accordance with the intended use, however, it is preferably 1% by mass to 15% by mass and more preferably 3% by mass to 10% by mass. When the content of the colorant(s) is less than 1% by mass, a reduction in coloring power of the toner is observed, and when more than 15% by mass, the pigment is not sufficiently dispersed in the toner and this may cause a reduction in coloring power of the toner and/or a reduction in electric properties of the toner.

The colorant(s) may be used as a masterbatch that is complexed with resin(s). The resin is not particularly limited and may be suitably selected from among conventional resins in accordance with the intended use. Examples of the resin include styrenes or polymers of the substituents thereof, styrene copolymers, polymethyl methacrylate resins, polybutyl methacrylate resins, polyvinyl chloride resins, polyvinyl acetate resins, polyethylene resins, polypropylene resins, polyester resins, epoxy resins, epoxy polyol resins, polyurethane resins, polyamide resins, polyvinyl butyral resins, polyacrylic acid resins, rosins, modified rosins, terpene resins, aliphatic hydrocarbon resins, cycloaliphatic hydrocarbon resins, aromatic petroleum resins, chlorinated paraffins and paraffins. Each of these resins may be used alone or in combination with two or more.

Examples of the styrenes or polymers of substituents thereof include polyester resins, polystyrene resins, poly-p-chlorostyrene resins and polyvinyl toluene resins. Examples of the styrene copolymers include styrene-p-chlorostyrene copolymers, styrene-propylene copolymers, styrene-vinyltoluene copolymers, styrene-vinylnaphthaline copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-α-chloromethyl methacrylate copolymers, styrene-acrylonitrile copolymers, styrene-methyl vinyl ketone copolymers, styrene-butadiene copolymers, styrene-isoprene copolymers, styrene-acrylonitrile-indene copolymers, styrene-maleic acid copolymers and styrene-maleic acid ester copolymers.

The masterbatch can be produced by mixing or kneading the resin(s) for masterbatch with the colorant under a high-shearing force. At the time of the mixing or kneading, to promote mutual interaction between the colorant and the resin(s), it is preferable to add an organic solvent. Further, a wet cake of a colorant can also be directly used in a so-called flashing process, which is preferably used in terms that it requires no need to dry the colorant wet cake. In the flashing process, a colorant-water-paste containing water is mixed and kneaded with resins and an organic solvent to transfer the colorants to the resins and then to remove the moisture and the organic solvent components. For the mixing and kneading, a high shearing dispersion unit such as a triple roll mill is preferably used.

-Releasing Agent-

The releasing agent is not particularly limited and may be suitably selected from among conventional releasing agents in accordance with the intended use. Examples of the releasing agent include carbonyl group-containing waxes, polyolefine waxes and waxes such as long-chain hydrocarbons. Each of these may be used alone or in combination with two or more. Of these, carbonyl group-containing waxes are preferable.

Examples of the carbonyl group-containing waxes include polyalkane esters, polyalkanol esters, polyalkane amides, polyalkylamides and dialkylketones. Examples of the polyalkane esters include carnauba wax, montan wax, trimethylol propane tribehenate, pentaerythritol tetrabehenate, pentaerythritol diacetate dibehenate, glycerine tribehenate and 1,18-octadecanediol distearate. Examples of the polyalkanol esters include trimellitic tristearyl and distearyl maleate. Examples of the polyalkane amides include dibehenylamide. Examples of the polyalkylamide include trimellitic acid tristearylamide. Examples of the dialkylketone include distearyl ketone. Of these carbonyl group-containing waxes, polyalkane esters are particularly preferable.

Examples of the polyolefine waxes include polyethylene waxes and polypropylene waxes.

Examples of the long-chain hydrocarbons include paraffin waxes and sazol waxes.

The melting point of the releasing agent is not particularly limited and may be suitably adjusted in accordance with the intended use, however, it is preferably 40° C. to 160°, more preferably 50° C. 120°, and still more preferably 60° C. to 90° C. When the melting point of the releasing agent is lower than 40° C., it may adversely affect the heat resistance/storage stability of the toner, and when higher than 160° C., cold-offset may easily occur at the time of fixing an image at a low-temperature.

The melting point of the releasing agent can be determined, for example, by the following method. The temperature of a sample is increased to 200° C. using a differential scanning calorimetry (DSC210, manufactured by Seiko Electronics Industries Co., Ltd.), the sample is cooled down from that temperature to 0° C. at a temperature decreasing rate of 10° C./min and then increased at a temperature increasing rate of 10° C./min, and the maximum peak of heat-melting temperature can be determined as the melting point of the sample.

The melt viscosity of the releasing agent as a value measured at a temperature 20° C. higher than the melting point of the wax, is preferably 5 cps to 1,000 cps and more preferably 10 cps to 100 cps. When the melt viscosity of the releasing agent is lower than 5 cps, the releasing property of the toner may degrade, and when higher than 1,000 cps, an effect of promoting hot-offset resistance and low-fixing property may not be obtained.

The content of the releasing agent in the toner is not particularly limited and may be suitably selected in accordance with the intended use, however, it is preferably 0% by mass to 40% by mass and more preferably 3% by mass to 30% by mass.

When the content of the releasing agent is more than 40% by mass, the flowability of the toner may degrade.

-External Additives-

The external additives are not particularly limited and may be suitably selected from among conventional external additives in accordance with the intended use. Examples thereof include silica fine particles, hydrophobized silica fine particles, fatty acid metal salts (for example, zinc stearate and aluminum stearate); metal oxides (for example, titania, alumina, tin oxide and antimony oxide) or hydrophobized products thereof; and fluoropolymers. Of these, hydrophobized silica fine particles, titania particles, hydrophobized titania fine particles are preferably exemplified.

Examples of the silica fine particle include HDK H 2000, HDK H 2000/4, HDK H 2050EP, HVK21 and HDK H1303 (all manufactured by Hochst Corporation); and R972, R974, RX200, RY200, RY200, R202, R805 and R812 (all manufactured by Nippon AEROSIL CO., LTD.). Examples of the titania fine particle include P-25 (manufactured by Nippon AEROSIL CO., LTD.); STT-30 and STT-65C-S (both manufactured by Titanium Industry Co., Ltd.); TAF-140(manufactured by Fuji titanium Industry Co., Ltd.); and MT-150W, MT-500B, MT-600B and MT-150A (all manufactured by TAYCA CORPORATION). Examples of the hydrophobized titanium oxide fine particle include T-805 (manufactured by Nippon AEROSIL CO., LTD.); STT-30A and STT-65S-S (both manufactured by Titanium Industry Co., Ltd.); TAF-500T and TAF-1500T (both manufactured by Fuji Titanium Industry Co., Ltd.); MT-100S and MT-100T (both manufactured by TAYCA CORPORATION); and IT-S (manufactured by ISHIHARA INDUSTRY CO., LTD.).

The hydrophobized silica fine particle, hydrophobized titania fine particle or hydrophobized alumina fine particle can be obtained by subjecting a hydrophilic fine particles to a hydrophobizing treatment with the use of a silane coupling agent as hydrophobizing agent such as methyl trimethoxy silane, methyl triethoxy silane and octyl trimethoxy silane.

Examples of the hydrophobizing agent include silane coupling agents such as dialkyl dihalogenated silane, trialkyl halogenated silane and alkyl trihalogenated silane and hexaalkyl disilazane; silylation agents, silane coupling agents having an alkyl fluoride group, organic titanate coupling agents, aluminum coupling agents, silicone oils and silicone varnishes.

Further, an inorganic fine particle treated with silicone oil of which an inorganic fine particle is hydrophobized by application of heat if necessary is preferably used as the hydrophobizing treatment agent.

Examples of the inorganic fine particle include silica, alumina, titanium oxide, barium titanate, magnesium titanate, calcium titanate, strontium titanate, iron oxide, copper oxide, zinc oxide, tin oxide, silica sand, clay, mica, wallastonite, silious earth, chromium oxide, cerium oxide, colcothar, antimony trioxide, magnesium oxide, zirconium oxide, barium sulfate, barium carbonate, calcium carbonate, silicon carbide, and silicon nitride. Of these, silica and titanium dioxide are particularly preferable.

Examples of the silicone oil include dimethyl silicone oil, methylphenyl silicone oil, chlorophenyl silicone oil, methylhydrogen silicone oil, alkyl-modified silicone oil, fluorine-modified silicone oil, polyether-modified silicone oil, alcohol-modified silicone oil, amino-modified silicone oil, epoxy-modified silicone oil, epoxy-polyether-modified silicone oil, alcohol-modified silicone oil, amino-modified silicone oil, epoxy-modified silicone oil, epoxy-polyether-modified silicone oil, phenol-modified silicone oil, carboxyl-modified silicone oil, mercapto-modified silicone oil, acrylic-modified or methacrylic-modified silicone oil, and α-methylstyrene-modified silicone oil.

The average primary particle diameter of the inorganic fine particle is preferably 1 nm to 100 nm and more preferably 3 nm to 70nm. When the average particle diameter is less than 1 nm, the inorganic fine particle is embedded in the toner and the function is sometimes rarely exerted efficiently, and when more than 100 nm, the surface of a latent electrostatic image bearing member may be damaged nonuniformly. For the external additives, it is possible to use an inorganic fine particle with a hydrophobized inorganic fine particle, however, the average primary particle diameter of the hydrophobized inorganic fine particle is preferably 1 nm to 100 nm and more preferably 5 nm to 70 nm. It is preferable that the external additives contain at least two types of hydrophobized inorganic fine particles each having an average primary particle diameter of 20 nm or less and at least one inorganic fine particle having an average primary particle diameter of 30 nm or more. The specific surface area of the inorganic fine particle measured by the BET method is preferably 20 $m^2/g$ to 500 $m^2/g$.

The additive amount of the external additives to the amount of the toner is preferably 0.1% by mass to 5% by mass and more preferably 0.3% by mass to 3% by mass.

A resin fine particle can also be added as the external additive. Examples of the resin fine particle include polystyrene that can be obtained, for example, by soap-free emulsification polymerization, suspension polymerization or dispersion polymerization; copolymers of methacrylic acid esters and acrylic acid esters; condensation-polymerized fine particles composed of silicone, benzoguanamine, nylon or the like; and polymer particles composed of thermosetting resin. By using such a resin fine particle in combination, the charge property of the toner can be enhanced, the amount of reversely charged toner can be reduced and the occurrence of background smear can be reduced. The additive amount of the resin fine particle to the amount of the toner is preferably 0.01% by mass to 5% by mass and more preferably 0.1% by mass to 2% by mass.

-Other Components-

The other components are not particularly limited and may be suitably selected in accordance with the intended use, and examples thereof include flowability improving agents, cleaning ability improving agents, magnetic materials and metal soaps.

The flowability improving agent is used in surface treatment of the toner to increase the hydrophobic property of the toner and enables to prevent degradation of the flowability and charge property of the toner even under a high-humidity condition. Examples of the flowability improving agent include silane coupling agents, silylation agents, silane coupling agents having an alkyl fluoride group, organic titanate coupling agents, aluminum coupling agents, silicone oils and modified silicone oils.

The cleaning improving agent is added to the toner to remove a residual developer remaining on a latent electrostatic image bearing member and an intermediate transfer member after transferring the toner. Examples of the cleaning improving agent include fatty acid metal salts of zinc stearates, calcium stearates, stearic acids and the like; and polymer fine particles produced by soap-free emulsion polymerization such as polymethyl methacrylate fine particles and polystyrene fine particles. For the polymer fine particle, it is preferable to use a polymer fine particle having a relatively narrow particle size distribution and a volume average particle diameter of 0.01 μm to 1 μm.

The magnetic material is not particularly limited and may be suitably selected from among conventional magnetic materials in accordance the intended use. Examples thereof include iron powders, magnetites and ferrites. Of these, white ones are preferable in terms of color tone.

-Toner Production Method-

The toner production method is not particularly limited and may be suitably selected from conventionally known toner production methods in accordance with the intended use. For example, kneading pulverization method, polymerization method, dissolution suspension method and spray granulation method are exemplified.

Of these, kneading-pulverizing method is particularly preferable from the perspective of dispersibility of the aromatic oxycarboxylic acid metal compound and colorants and the productivity.

Kneading Pulverization Method

In the kneading pulverization method, for example, a toner material containing at least a binder resin and a colorant is melted and kneaded, and the obtained kneaded product is pulverized and classified to thereby produce a base particle of the toner.

In the melting and kneading of the toner material, the toner material is mixed and the mixture is placed in a melting kneader to melt and knead the mixture. For the melting kneader, for example, a uniaxial or biaxial continuous kneader or a batch type kneader such as a roller mill can be used. For example, KTK type biaxial extruder manufactured by KOBE STEEL., LTD.; TEM type biaxial extruder manufactured by TOSHIBA MACHINE CO., LTD.; biaxial extruder manufactured by KCK Co., Ltd.; PCM type biaxial extruder manufactured by IKEGAI, LTD. and continuous type uniaxial extruder such as Co-kneader manufactured by BUSS are preferably used. It is preferable that the melting and kneading be carried out under such appropriate conditions not to cut molecular chains of the binder resin.

Specifically, the melting kneading temperature is set in reference to the softening point of the binder resin. When the melting kneading temperature is excessively higher than the softening point, the molecular chains of the binder resin are severely cut off, and when excessively lower than the softening point, the dispersion of the toner material may not proceed.

In the pulverization, the kneaded product obtained in the kneading is pulverized. In the pulverization, it is preferred that first the kneaded product be coarsely crushed and then finely pulverized. It is also preferred that the toner material mixture be pulverized by making particles collide with a collision plate or making particles collide with each other in a jet stream or pulverizing the toner mixture particles in a narrow gap between a mechanically rotatable rotor and a stator.

In the classification of particles, the pulverized material obtained in the pulverization is classified to prepare particles having predetermined particle diameters. The classification can be carried out by removing fine particles using, for example, a cyclone, a decanter, a centrifugal separator or the like.

After completion of the pulverization and classification, the pulverized material is classified in a stream by applying a centrifugal force thereto, thereby producing a toner base particle having predetermined particle diameters.

Next, external additives are externally added to the toner base particle. By mixing and stirring the toner base particle and the external additives using a mixer, the toner base particle surface is coated with the external additives with the external additive being dissolved and pulverized. Here, it is important to make the external additives such as an inorganic fine particle, a resin fine particle and the like uniformly and strongly adhere on the toner base particle in terms of the durability of the toner.

-Polymerization Method-

In the toner production method based on the polymerization method, for example, a toner can be produced by dissolving or dispersing a toner material containing at least a modified polyester resin that can form a urea bonding or urethane bonding and a colorant in an organic solvent, dispersing the dissolved or dispersed material in an aqueous medium, applying a polymerization addition reaction thereto, and removing the solvent of the dispersion liquid and washing the dispersion.

For the modified polyester resin that can form a urea bonding or urethane bonding, a polyester prepolymer having an isocyanate group in which a carboxyl group, a hydroxyl group or the like is reacted with a polyvalent isocyanate compound (PIC) is exemplified. Then, a modified polyester resin that can be obtained by crosslinking and/or elongating the molecular chains in a reaction between the polyester prepolymer and amines or the like can improve the hot offset property of the toner while maintaining the low-temperature fixing property.

Examples of the polyvalent isocyanate compound (PIC) include fatty acid polyvalent isocyanate (such as tetramethylene diisocyanate, hexamethylene diisocyanate, and 2,6-diisocyanate methyl caproate); cycloaliphatic polyisocyanate (such as isophorone diisocyanate, and cyclohexyl methane diisocyanate); aromatic diisocyanate (such as tolylene diisocyanate, and diphenyl methane diisocyanate); aromatic aliphatic diisocyanate ($\alpha,\alpha,\alpha',\alpha'$-tetramethyl xylene diisocyanate, etc.); isocyanates; and the polyisocyanates blocked with a phenol derivative, oxime, caprolactam or the like. Each of these may be used alone or in combination with two or more.

The mixture ratio of the polyvalent isocyanate compound (PIC), for example, the equivalent ratio [NCO]/[OH] of isocyanate group [NCO] content in the polyisocyanate (PIC) to hydroxyl group [OH] content in the hydroxyl group-containing polyester is preferably 5/1 to 1/1, more preferably 4/1 to 1.2/1, and still more preferably 2.5/1 to 1.5/1.

The number of isocyanate groups contained in one molecule in the polyester prepolymer (A) having an isocyanate group is preferably one, more preferably 1.5 to 3 on the average, and still more preferably 1.8 to 2.5 on the average.

Examples of the amines (B) to be reacted to the polyester prepolymer include divalent amine compounds (B1), trivalent or more polyvalent amine compounds (B2), amino alcohols (B3), aminomercaptans (B4), amino acids (B5) and blocked amines of which amino groups of B1 to B5 are blocked (B6).

Examples of the divalent amine compound (B1) include aromatic diamine (such as phenylene diamine, diethyl toluene diamine, and 4,4'-diaminodiphenyl methane); cycloaliphatic diamine (such as 4,4'-diamino-3,3'-dimethyldicyclohexylmethane, diamine cyclohexane, and isophorone diamine); and aliphatic amine (such as ethylene diamine, tetramethylene diamine, and hexamethylene diamine).

Examples of the trivalent or more polyvalent amine compound (B2) include diethylene triamine and triethylene tetramine.

Examples of the amino alcohol (B3) include ethanol amine and hydroxyethyl aniline.

Examples of the aminomercaptan (B4) include aminoethyl mercaptan and aminopropyl mercaptan.

Examples of the amino acid (B5) include amino propionate and amino caproate.

Examples of the blocked amines of which amino groups of B1to B5 are blocked (B6) include ketimine compounds obtainable from the amines of B1 to B5 and ketones (such as acetone, methylethylketone, and methylisobutylketone), and oxazolidine compounds. Of these amines (B), a mixture of amines of B1 and B1and a small amount of amine B2 is particularly preferable.

The mixture ratio of the amines (B), for example, the equivalent ratio of [NCO]/[NHx] of isocyanate group [NCO] content in the polyester prepolymer (A) having an isocyanate group to amino group [NHx] content in the amines (B) is preferably 1.2 to 2/1, more preferably 1.5/1 to 1/1.5, and more preferably 1.2/1 to 1/1.2.

According to a toner production method based on the polymerization method stated above, it is possible to produce a spherically shaped toner having small particle diameter at a low cost without having a significant impact on environment.

Color of the toner is not particularly limited and may be suitably selected in accordance with the intended use and may be suitably selected in accordance with the intended use. For example, at least one selected from black toners, cyan toners, magenta toners and yellow toners can be used. Each color of toners can be selected by suitably selecting the types of the colorants, and the color toner is preferably a color toner.

The weight average particle diameter of the toner is not particularly limited and may be suitably adjusted in accordance with the intended use. To obtain a high-quality image that is excellent in granulation degree, image sharpness and thin-line reproductivity, the weight average particle diameter is preferably 3 μm to 10 μm and more preferably 4 μm to 7 μm. When the weight average particle diameter is less than 3 μm, the flowability and transferring property of the toner may degraded, although the image sharpness and thin-line reproductivity of images are excellent.

Here, the weight average particle diameter of the toner can be measured, for example, as follows.

- Measurement device: COULTER MULTISIZER III (manufactured by Beckman Coulter Co.)
- Aperture diameter: 100 μm
- Analysis software: BECKMAN COULTER MULTISIZER 3Ver. 3.51 (manufactured by Beckman Coulter Co.)
- Electrolyte: ISOTON III diluent (manufactured by Beckman Coulter Co.)
- Dispersion liquid: 10% by mass of surfactant (alkylbenzene sulfonate, NEOGEN SC-A, manufactured by Daiichi Kogyo Seiyaku Co., Ltd.)
- Dispersion conditions: 10 milligrams of a measurement sample was added to 5 mL of the dispersion liquid, and the dispersion liquid was dispersed in a ultrasonic dispersion device for 1 minute, and then 25 mL of the electrolyte was added to the dispersion liquid, and the dispersion liquid was further dispersed in the ultrasonic dispersion device for 1 minute.
- Measurement conditions: 100 mL of the electrolyte and the dispersion liquid were added to a beaker, 30,000 pieces of particles of the sample were measured at such a concentration that the particle diameter of 30,000 pieces of particles could be measured for 20 seconds, and the weight average particle diameter of the sample is determined from the particle size distribution.

(Developer)

The developer of the present invention contains at least the toner of the present invention and contains suitably selected other components such as carrier. The developer may be a one-component developer or a two-component developer, however, when used in a high-speed printer or the like which can respond to recent improvements in information processing high-speed performance, it is preferable to use the two-component developer in terms of improvement in operating life of the printer.

When the one-component developer using the toner is used, there are little changes in toner particle diameter, causing less occurrence of toner filming to a developing roller serving as a developer carrier and less occurrence of toner fusion to a layer thickness controlling member such as a blade to make a toner layer thin even when toner inflow/outflow is performed, and it is possible to obtain excellent developing property and excellent images with stability even when a developing unit is used for long hours, i.e., even when the developer is stirred for long hours. Further, when the two-component developer using the toner is used, there are little changes in toner particle diameter of the toner in the developer, and it is possible to obtain excellent developing property with stability even when the developer is stirred for long hours in a developing unit.

-Carrier-

The carrier is not particularly limited and may be suitably selected in accordance with the intended use, however, a carrier having a core and a resin layer to cover the core is preferable.

Material used for the core is not particularly limited and may be suitably selected from conventional core materials. For example, a manganese-strontium (Mn—Sr) material or a manganese-magnesium (Mn—Mg) material of 50 emu/g to 90 emu/g is preferably used. In terms of ensuring image density, iron powder (100 emu/g or more), or a ferromagnetic material such as magnetite (75 emu/g to 120 emu/g) is preferably used. Further, in terms that a contact force applied to a latent electrostatic image bearing member on which a toner is standing can be weakened and it is advantageous in obtaining high-quality images, a feebly magnetic material such as copper-zinc (Cu—Zn) material (30 emu/g to 80 emu/g) is preferably used. Each of these may be used alone or in combination with two or more.

For the particle diameter of the core, the average particle diameter thereof (volume average particle diameter ($D_{50}$)) is preferably 10 μm to 200 μm and more preferably 40 μm to 100 μm. When the average particle diameter (volume average particle diameter ($D_{50}$)) is less than 10 μm, a large amount of fine powder particles is observed in the carrier particle distribution, the magnetization intensity per one particle is lowered, and carrier scattering may occur. When the average particle diameter (volume average particle diameter ($D_{50}$)) is more than 200 μm, the specific surface area of the toner is decreased, toner scattering may occur. In a full-color image having a large area ratio of solid parts, the reproductivity of particularly in the solid parts may degrade.

Material used for the resin layer is not particularly limited and may be suitably selected from among conventional resins in accordance with the intended use. Examples of the material of the resin layer include amino resins, polyvinyl resins, polystyrene resins, halogenated olefin resins, polyester resins, polycarbonate resins, polyethylene resins, polyvinyl fluoride resins, polyvinylidene fluoride resins, polytrifluoroethylene resins, polyhexafluoro-propylene resins, copolymers of vinylidene fluoride with acrylic monomer, copolymers of vinylidene fluoride with vinyl fluoride, fluoroterpolymer (triple (multiple)-fluoride copolymers) such as terpolymer of tetrafluoroethylene, vinylidene fluoride and non-fluorinated monomer, and silicone resins. Each of these may be used alone or in combination with two or more. Of these, silicone resins are particularly preferable.

The silicone resin is not particularly limited and may be suitably selected from among commonly known silicone resins in accordance with the intended use. Examples thereof include straight silicone resins formed from only organosiloxane bonding; and silicone resins modified with an alkyd resin, polyester resin, epoxy resin, acrylic resin, urethane resin or the like.

For the silicone resin, a commercially available product can be used. Specific examples of the commercially available products of the straight silicone resin include KR271, KR255 and KR152manufactured by Shin-Etsu Chemical Co., Ltd.; and SR2400, SR2406and SR2410 manufactured by DOW CORNING TORAY SILICONE CO., LTD.

For the modified silicone resin, a commercially available production can be used. Specific examples thereof include KR206(alkyd modified), KR5208 (acrylic modified), ES1001N (epoxy modified) and KR305 (urethane modified) manufactured by Shin-Etsu Chemical Co., Ltd.; SR2115 (epoxy modified) and SR2110 (alkyd modified) manufactured by DOW CORNING TORAY SILICONE CO., LTD.

In addition, it is also possible to singularly use a silicone resin, and also possible to use a silicone resin in combination with crosslinkable component(s) and/or charge amount controllable component(s) and the like.

To the resin layer, a conductive powder etc. may be added in accordance with necessity. Examples of the conductive powder include metal powder, carbon black, titanium oxide, tin oxide and zinc oxide. The average particle diameter of the conductive powder is preferably 1 μm or less. When the average particle diameter of the conductive powder is larger than 1 μm, it may be difficult to control electric resistance of the toner.

The resin layer can be formed, for example, by dissolving the silicone resin and the like in a solvent to prepare a coating solution, uniformly coating the surface of the core with the coating solution by a known coating method, drying the applied coating solution and then baking the surface. Examples of the coating method include immersion coating method, spray coating method and brush-coating method.

The solvent is not particularly limited and may be suitably selected in accordance with the intended use, and examples thereof include toluene, xylene, methylethylketone, methylisobutylketone, cellosolve and butyl acetate.

The backing method is not particularly limited and may be an external heating method or an internal heating method. Examples thereof include methods using a fixed type electric furnace, a flowing-type electric furnace, a rotary electric furnace or a burner furnace or the like, and methods using a microwave.

The amount of the resin layer in the carrier is preferably 0.01% by mass to 5.0% by mass. When the amount of the resin layer is less than 0.01% by mass, the resin layer may not be uniformly formed on the core surface, and when more than 5.0% by mass, granulation of carrier particles occurs due to the excessively thick resin layer and a uniform carrier particle may not be obtained.

When the developer is a two-component developer, the content of the carrier in the two-component developer is not particularly limited and may be suitably adjusted in accordance with the intended use. For example, it is preferably 90% by mass to 98% by mass and more preferably 93% by mass to 97% by mass.

Generally, the mixture ratio of the toner to the carrier in the two-component developer is preferably 10.0 parts by mass of the toner to 100 parts by mass to the carrier.

(Image Forming Apparatus and Image Forming Method)

The image forming apparatus of the present invention has at least a latent electrostatic image bearing member, a charging unit, an exposing unit, a developing unit, a transfer unit and a fixing unit, has a cleaning unit and further has suitably selected other units in accordance with necessity, for example, a charge eliminating unit, a recycling unit and a controlling unit. A combination of a charging unit with an exposing unit may be referred to as a latent electrostatic image forming unit.

The image forming method of the present invention includes at least a charging step, an exposing step, a developing step, a transferring step and a fixing step, includes a cleaning step and further includes suitably selected other steps in accordance with necessity, for example, a charge eliminating step, a recycling step and a controlling step. A combination of a charging step with an exposing step may be referred to as a latent electrostatic image forming step.

The image forming method of the present invention can be favorably carried out by using the image forming apparatus of the present invention, the charging step can be carried out using the charging unit, the exposing step can be carried out using the exposing unit, the developing step can be carried out by the developing unit, the transferring step can be carried out using the transfer unit, the fixing step can be carried out using the fixing unit, the cleaning step can be carried out using the cleaning unit, and the other steps can be carried out by using the other units.

<Latent Static Image Bearing Member>

The latent electrostatic image bearing member is not particularly limited as to the material, shape, structure, size and the like, and may be suitably selected in accordance with the intended use. For the shape of the latent electrostatic image bearing member, for example, drum shape, sheet shape and endless belt shape are exemplified. The structure thereof may be a single-layered structure or multi-layered structure, and the size thereof can be suitably selected in accordance with the size and the specifications or the like of the image forming apparatus. Examples of the material used for the latent electrostatic image bearing member include inorganic photoconductors composed of amorphous silicon, selenium, CdS, ZnO or the like; organic photoconductors (OPCs) composed of polysilane, phthalopolymethine or the like.

The amorphous silicon photoconductor is formed, for example, by heating a substrate to 50° C. to 400° C. and forming a photosensitive layer composed of a-Si on the substrate by vacuum evaporation method, sputtering method, ion-plating method, heat-CVD method, optical CVD method, plasma CVD or the like. Of these methods, plasma CVD method is particularly preferable. Specifically, the following method is preferable. Specifically, raw material gases are decomposed by a direct current, a high-frequency wave or a microwave glow discharge and a photosensitive layer composed of a-Si is formed on a substrate.

The organic photoconductors (OPCs) are widely used for the following reasons: (1) optical properties such as a wide light absorptive wavelength region and the size of light absorption amount, (2) electric properties such as highly sensitive and stable charge properties, (3) wide selection range of materials, (4) easy manufacturing, (5) low-cost performance, and (6) non-toxicity. The layer structure of such organic photoconductors is broadly classified into single-layered structure and multi-layered structure.

A photoconductor having a single-layered structure has a substrate and a single-layered photosensitive layer formed on the substrate and further has a protective layer, an intermediate layer and other layers in accordance with necessity.

A photoconductor having a multi-layered structure has a substrate, and at least a charge generating layer and a charge transporting layer formed in this order on the substrate and further has a protective layer, an intermediate layer and other layers in accordance with necessity.

<Charging Step and Charging Unit>

The charging step is a step in which the surface of a latent electrostatic image bearing member is charged and is carried out using the charging unit.

The charging unit is not particularly limited and may be suitably selected in accordance with the intended use, as long as it can uniformly charge the surface of the latent electrostatic image bearing member by applying a voltage thereto. The charging units are broadly classified into (1) contact type charging unit configured to charge a latent electrostatic image bearing member in a contact manner, and (2) non-contact type charging unit configured to charge a latent electrostatic image bearing member in a non-contact manner.

-Contact Type Charging Unit-

Examples of the (1) contact type charging unit include conductive or semi-conductive charging rollers, magnetic brushes, fur brushes, films and rubber blades. Of these, charging rollers are preferred because a charge roller allows for substantially reduce ozone generation amount as compared to corona discharge type chargers, is excellent in storage stability even when a latent electrostatic image bearing member is repetitively used and is effective to prevent image degradation.

The magnetic brush is composed, for example, of a non-magnetic conductive sleeve that bears various ferrite particles such as Zn—Cu ferrite and a magnet roller that is incorporated into the sleeve. The fur brush is formed, for example, by twisting or pasting a conduction-treated fur with carbon, copper sulfide, metal, metal oxide or the like around a conduction-treated cored bar.

Here, FIG. 1 is a cross-sectional view showing one example of a charging roller. A charging roller 310 has a cored bar 311 which is a cylindrical and serves as a conductive substrate, a resistance controlling layer 312 formed on the outer circumferential surface of the cored bar 311 and a protective layer 313 which covers the surface of the resistance controlling layer 312 to prevent leakage.

The resistance controlling layer 312 can be formed by extrusion molding a thermoplastic resin composition containing at least a thermoplastic resin and a high-molecular weight ion conductive agent on the circumferential surface of the cored bar 311.

The volume resistivity value of the resistance controlling layer 312 is preferably $10^6$ Ω·cm to $10^9$ Ω·cm. When the volume resistivity value is more than $10^9$ Ω·cm, the charged amount is insufficient and it may be impossible for a photoconductor drum to obtain such a sufficient charge potential enough to form an image without causing nonuniformity, and when the volume resistivity value is less than $10^6$ Ω·cm, leakage possibly occurs over the whole of the photoconductor drum.

The thermoplastic resin used for the resistance controlling layer 312 is not particularly limited and may be suitably selected in accordance with the intended use. Examples thereof include polyethylene (PE), polypropylene (PP), methyl polymethacrylate (PMMA), polystyrene (PS) or copolymers thereof (such as AS and ASB).

For the high-molecular weight ion conductive agent, an ion conductive agent that has a resistivity value of about $10^6$ Ω·cm to $10^{10}$ Ω·cm alone and is capable of easily reducing the resistance value of the resin is used. For one example thereof, a compound containing a polyether ester amide component is exemplified. To control the resistance value of the resistance controlling layer 312 to a value within the above-noted range, the blending amount of the compound containing a polyether ester amide component is preferably 30 parts by mass to 70 parts by mass to 100 parts by mass of the thermoplastic resin.

Further, as the high-molecular weight ion conductive agent, it is also possible to use a high-molecular weight compound containing a quaternary ammonium base. For the high-molecular weight compound containing a quaternary ammonium base, for example, a polyolefin containing a quaternary ammonium base is exemplified.

To control the resistance value of the resistance controlling layer 312 to a value within the above-noted range, the blending amount of the polyolefin containing a quaternary ammonium base is preferably 10 parts by mass to 40 parts by mass to 100 parts by mass of the thermoplastic resin.

The high-molecular weight ion conductive agent can be dispersed in the thermoplastic resin by using a biaxial kneader, a kneader or the like. Because the high-molecular ion conductive agent can be uniformly dispersed in a thermoplastic resin composition at a molecular level, variations in resistance value associated with a dispersion defect of the conductive material, which can be seen in a resistance controlling layer with a conductive pigment dispersed therein, do not occur in the resistance controlling layer 312. Further, since the high-molecular weight ion conductive agent is a polymer compound, it can be uniformly dispersed and fixed in the thermoplastic resin composition, and bleed-out hardly occurs.

The protective layer 313 is formed so as to have a greater resistance value than that of the resistance controlling layer 312. With this configuration, leakage to defective parts of the photoconductor drum can be avoided. However, when the protective layer 313 has an excessively high resistance value, the charge efficiency is lowered, and thus the difference in resistance value between the protective layer 313 and the resistance controlling layer 312 is preferably $10^3$ Ω·cm or less.

For material used for the protective layer 313, a resin material is preferable in terms of its excellent formability. For the resin material, for example, fluorine resins, polyamide resins, polyester resins, polyvinyl acetal resins are preferable from the perspective of excellence in non-adhesiveness and capability of preventing toner adhesion. Further, because a resin material generally has electric insulation prosperities, properties of the charging roller are not satisfied when the protective layer 313 is formed with a resin material alone. Then, by dispersing various conductive agents in the resin material, the resistance value of the protective layer 313 is controlled. To improve adhesion property between the protective layer 303 and the resistance controlling layer 302, a reactive curing agent such as isocyanate may be dispersed in the resin material.

The charging roller 310 is connected to a light source and a given voltage is applied thereto. The voltage may be only a direct current (DC) voltage, however, it is preferable to use a voltage in which an alternative current (AC) voltage is superimposed on a direct current (DC) voltage. By applying an AC voltage to the charging roller 310, the surface of the photoconductor drum can be uniformly charged.

Figure 2:
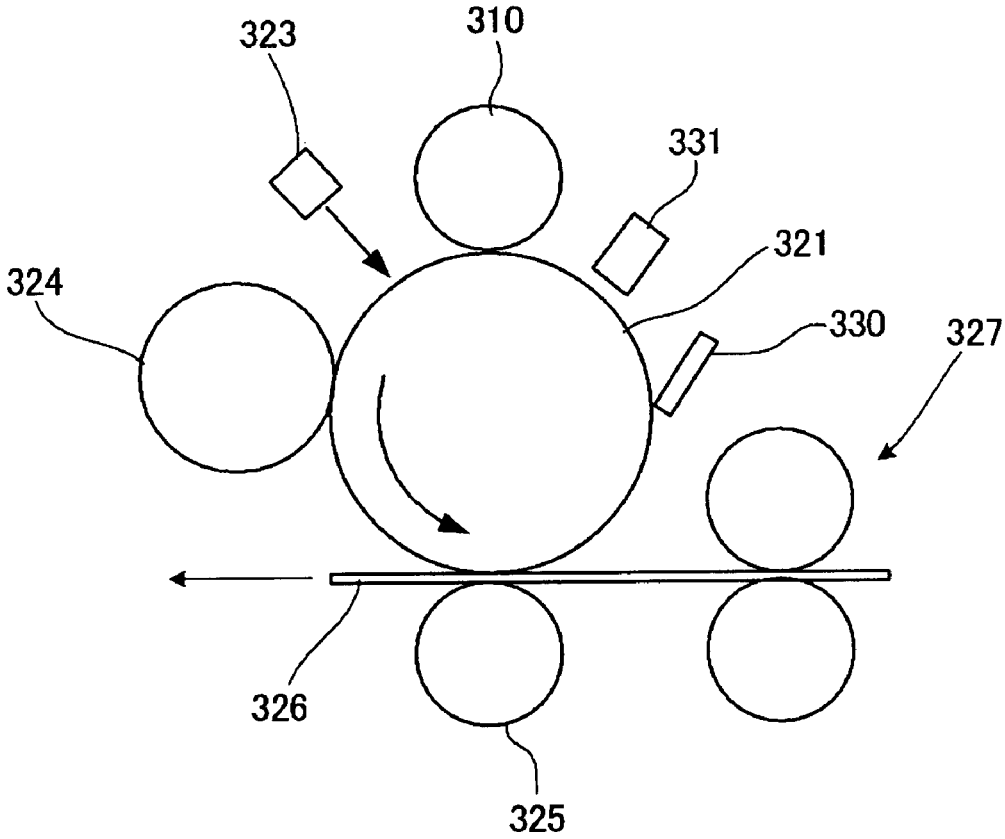
FIG. 2 is a schematic view showing one example of using a contact type charging roller used in an image forming apparatus of the present invention.

Here, FIG. 2 is a schematic view showing one example of using a contact type charging roller i.e., the charge roller 310 as shown in FIG. 1, as a charging unit in an image forming apparatus. In FIG. 2, around a photoconductor drum 321 serving as a latent electrostatic image bearing member, a charging unit 310 configured to charge the surface of the photoconductor drum 321, an exposing unit configured to expose the charged surface of the photoconductor drum 321 to form a latent electrostatic image, a developing unit 324 configured to develop the latent electrostatic image on the photoconductor drum surface by making a toner adhered on the latent electrostatic image to form a visible image, a transfer unit 325 configured to transfer the visible image formed on the photoconductor drum 321 onto a recording medium 326, a fixing unit 327 configured to fix the transferred image on the recording medium 326, a cleaning unit 330 configured to clean the surface of the photoconductor drum 321 and collect a residual toner remaining on the photoconductor drum 321 by removing the residual toner, and a charge eliminating device 331 configured to eliminate a residual potential on the photoconductor drum 321 are arranged. For the charging unit 310, a contact type charging roller 310 as shown in FIG. 1 is provided, and the surface of the photoconductor drum 321 is uniformly charged by the charging roller 310.

-Non-Contact Type Charging Unit-

For the (2) non-contact type charging unit, for example, a non-contact type charger utilizing a corona discharge, a needle electrode device, a solid discharge devices; and a conductive or semi-conductive charging roller placed with a minute gap to a latent electrostatic image bearing member are exemplified.

The corona discharge is a charging method in which a positive or negative ion generated by a corona discharge in the air is given to the surface of a latent electrostatic image bearing member. The corona discharge chargers are classified into corotoron chargers having a characteristic that a constant charge amount is given to a latent electrostatic image bearing member, and scorotoron charges having a characteristic that a constant electric potential is given to a latent electrostatic image bearing member.

The corotoron charger is composed of casing electrodes occupying the half-space thereof around a discharge wire which is positioned roughly in the center of the casing electrodes.

The scorotoron charger is a charger of which grid electrodes are added to the corotoron charger, and the grid electrodes are positioned 1.0 mm to 2.0 mm away from the surface of a latent electrostatic image bearing member.

Figure 3:
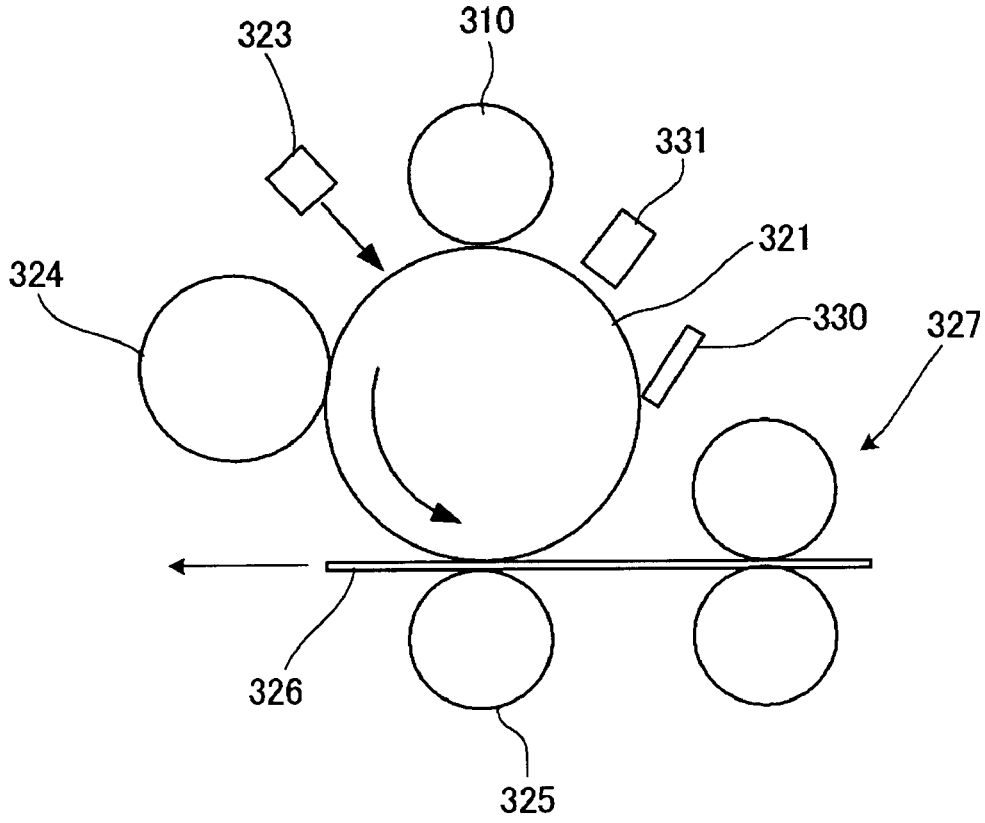
FIG. 3 is a schematic view showing one example of using a non-contact type corona charger in an image forming apparatus of the present invention.

Here, FIG. 3 is a schematic view showing one example of using a non-contact type corona charger as a charging unit in an image forming apparatus. Note that in FIG. 3, the same components as shown in FIG. 2 are denoted at the same numerals.

For the charging unit, a non-contact type corona charger 311 is provided, and the surface of a photoconductor drum 321 is uniformly charged by the corona charger 311.

For the above-noted charging roller placed with a minute gap to a latent electrostatic image bearing member, the charging roller is remodeled so as to have a minute gap to the latent electrostatic image bearing member. The minute gap formed therebetween is preferably 10 μm to 200 μm and more preferably 10 μm to 100 μm.

Figure 4:
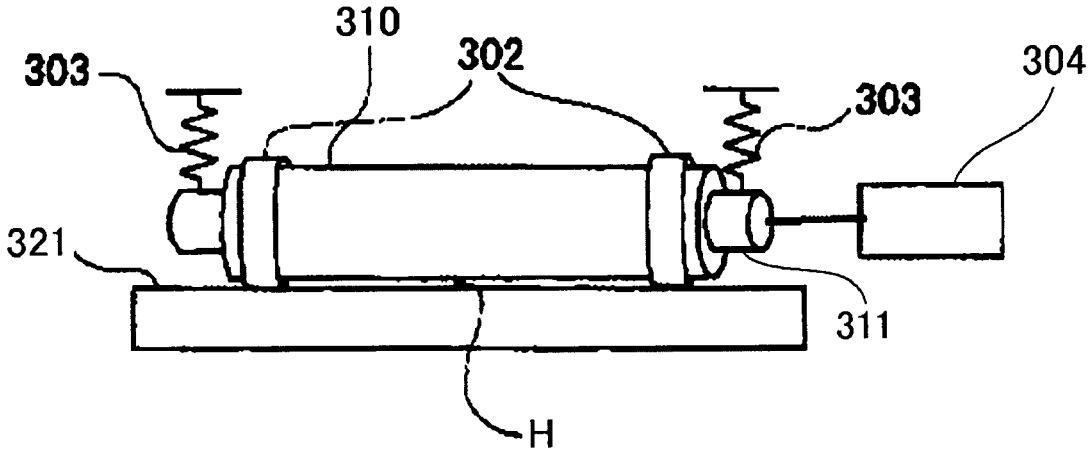
FIG. 4 is a schematic view showing one example of a non-contact charging roller in an image forming apparatus of the present invention.

Here, FIG. 4 is a schematic view showing one example of a non-contact type charging roller. In FIG. 4, a charging roller 310 is placed with a minute gap H to a photoconductor drum 321. The minute gap can be set, for example, by twisting a spacer member having a certain thickness around non-image forming areas in both ends of the charging roller 310 to make the surface of the spacer member contact with the surface of the photoconductor drum 321. In FIG. 4, a reference numeral 304 denotes a light source.

In FIG. 4, as a method of maintaining a minute gap H, a film 302 is twisted around both ends of the charging roller 310 to form a spacer member. A spacer 302 is to be made contact with the photosensitive surface of the latent electrostatic image bearing member and is formed so as to ensure a certain length of minute gap H between the charging roller and image areas in the latent electrostatic image bearing member. For the application bias, an alternative current (AC) superimposing type voltage, and the latent electrostatic image bearing member is charged by an effect of an electric discharge generated in the minute gap H between the charging roller and the latent electrostatic image bearing member. As shown in FIG. 4, the maintaining accuracy of the minute gap H can be improved by pressurizing a charging roller axis 311 with a spring 303.

The spacer member may be combined with a charging roller to integrally form one unit. In this case, at least the surface of the gap portion must be formed of an insulating material. With this, it is possible to reduce an electric discharge at the gap portion and to prevent an electric discharge product from accumulating at the gap portion, to prevent a toner from being fixed to the gap portion due to surface tackiness of the electric discharge product, and to prevent the gap from outspreading.

For the spacer member, a heat shrinkable tube may be used. Examples of such a heat shrinkable tube include SUMITUBE for 105° C. (product name: F105° C., manufactured by Sumitomo Chemical Co., Ltd.).

<Exposing Step and Exposing Unit>

The exposing step is a step in which the charged surface of the latent electrostatic image bearing member is exposed by using the exposing unit.

The exposure can be carried out, for example, by exposing the surface of the latent electrostatic image bearing member imagewisely using the exposing unit.

Optical systems to be used for the exposure are broadly classified into analogue optical systems and digital optical systems. The analogue optical system is the one that directly projects an original document on a latent electrostatic image bearing member from an optical system, and in the digital optical system, image information is given as electrical signals, the electrical signals are converted into optical signals, a latent electrostatic image bearing member is exposed to thereby form an image.

The exposing unit is not particularly limited and may be suitably selected in accordance with the intended use, as long as it can imagewisely expose the latent electrostatic image bearing member surface that has been charged by the charging unit. Examples of the exposing unit include reproducing optical systems, rod lens array systems, laser optical systems, liquid crystal shutter optical systems and LED optical systems.

In the present invention, the back light method may be employed in which exposure is performed imagewisely from the back side of the photoconductor.

<Developing Step and Developing Unit>

The developing step is a step in which the latent electrostatic image is developed using the toner of the present invention or the developer to form a visible image by means of the developing unit.

The developing unit is not particularly limited and may be suitably selected from among conventional developing units, as long as it can develop a latent electrostatic image using a toner or a developer. For example, a developing unit having at least a developing device which houses the toner or the developer and supplies the toner or the developer to the latent electrostatic image in a contact or non-contact manner is preferably exemplified.

The developing device may employ a dry-developing process or a wet-developing process. It may be a monochrome color image developing device or a multi-color image developing device. Preferred examples thereof include a developing device having a stirrer by which the toner or the developer is frictionally stirred to be charged, and a rotatable magnet roller.

In the developing device, for example, the toner and a carrier are mixed and stirred, the toner is charged by a frictional force at that time to be held in a state where the toner is standing on the surface of the rotating magnet roller to thereby form a magnetic brush. Because the magnet roller is located near the latent electrostatic image bearing member, a part of the toner constituting the magnetic brush formed on the surface of the magnet roller moves to the surface of the latent electrostatic image bearing member by an electric attraction force. As the result, the latent electrostatic image is developed using the toner to form a visible toner image on the surface of the latent electrostatic image bearing member.

A developer to be housed in the developing unit is a developer containing the toner, however, the developer may be a one-component developer or a two-component developer.

[One-Component Developing Unit]

For the one-component developing unit, for example, a one-component developing device having a developer carrier to which a toner is supplied and a layer thickness controlling member that forms a toner thin layer on the surface of the developer carrier is preferably used.

Figure 5:
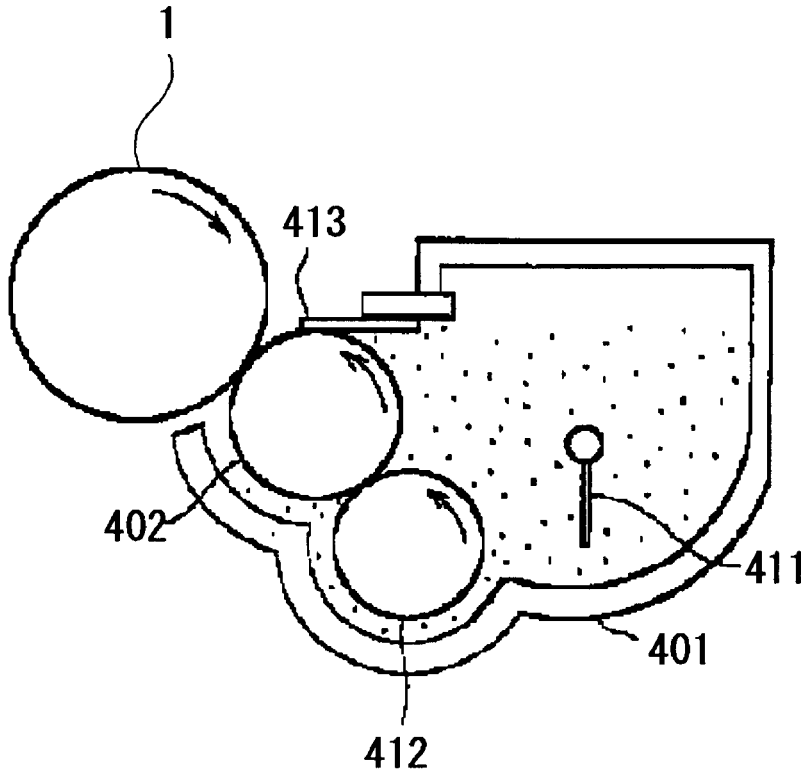
FIG. 5 is a schematic view showing one example of a one-component developing unit in an image forming apparatus of the present invention.

FIG. 5 is a schematic view showing one example of a one-component developing device. In the one-component developing device, a one-component developer composed of only a toner is used. The one-component developing device allows for developing a latent electrostatic image on a photoconductor drum 1 using the one-component developer in a contact manner by forming a toner layer on a developing roller 402 as a developer carrier and conveying the toner layer on the developing roller 401 so as to make contact with the photoconductor drum 1.

In FIG. 5, a toner in a casing 401 is stirred by rotation of an agitator 411 as an agitating unit and is mechanically supplied to a supplying roller 412 as a toner supplying member. The supplying roller 412 is formed of foamed polyurethane or the like and has flexibility and a cell diameter of 50 μm to 500 μm to be formed in such a structure to easily hold a toner on the surface thereof. The JIS-A hardness of the supplying roller 412 is relatively low of 10° to 30°, and thus it can be made evenly contact with the developing roller 402 as well.

The supplying roller 412 is driven to rotate in the same direction as the developing roller 402 rotates, i.e., the supplying roller 412 is driven to rotate such that the surface of the supplying roller 412 and the surface of the developing roller 402 rotate and move in the opposite direction from each other at the portion where both of the rollers face to each other. A linear speed ratio of the supplying roller to the developing roller (supplying roller/developing roller) is preferably 0.5 to 1.5. Also, the supplying roller 412 may be driven to rotate in the opposite direction from the direction in which the developing roller 402 rotates, i.e., may be driven to rotate such that the surface of the supplying roller 412 and the surface of the developing roller 402 rotate and move in the same direction with each other at the portion where both of the rollers face to each other. In this embodiment, the supplying roller 412 was set so as to rotate in the same direction as the developing roller 402 rotates, and the linear speed ratio was set to 0.9. The biting amount of the supplying roller 412 into the developing roller 402 was set to 0.5 mm to 1.5 mm. In this embodiment, when the unit effective width is 240 mm (A4 size, vertical), a necessary torque is 14.7 N·cm to 24.5 N·cm.

The developing roller 402 has a surface layer composed of a rubber material on a conductive substrate and has a diameter of 10 mm to 30 mm. The surface thereof is roughly formed so as to have a surface roughness Rz of 1 μm to 4 μm. The surface roughness Rz is preferably set at 13% to 80% to the average particle diameter of the toner. With this configuration, the toner is conveyed without being embedded in the surface of the developing roller 402. Particularly, the surface roughness Rz of the developing roller 402 is preferably controlled to be a value ranging 20% to 30% of the average particle diameter of the toner so as not to hold a significantly low-charge toner on the surface of the developing roller 402.

Examples of the rubber material include silicone rubbers, butadiene rubbers, NBR rubbers, hydrin rubbers and EPDM rubbers. Further, it is preferable to coat the surface of the developing roller 402 with a coating layer to stability the quality with time, particularly. Examples of material used for the coating layer include silicone materials, TEFLON (registered) materials. The silicone materials are excellent in toner charging property, and the TEFLON (registered) materials are excellent in releasing property. To obtain conductivity, a conductive material such as carbon black may be suitably added to the coating layer. The thickness of the coating layer is preferably 5 μm to 50 μm. When the thickness of the coating layer deviates the range, it is likely to cause a problem that it breaks easily.

A toner having a specific polarity (in this embodiment, negative polarity) residing on or inside the supplying roller 412 is sandwiched in a contact point with the developing roller 402, in the contact point where the supplying roller 412 and the developing roller 402 rotate in the opposite direction from each other because of rotation thereof, and the toner obtains a negatively charged charge by a frictional charging effect and is then held on the surface of the developing roller 402 by an electrostatic force and a conveying effect of the surface roughness of the developing roller 402. A toner layer formed on the developing roller 402 at this point in time is not uniformly formed and an excessive amount of toner adheres thereon (1 mg/cm$^2$ to 3 mg/cm$^2$). To solve the problem, a controlling blade 413 as a layer thickness controlling member is made contact with the developing roller, thereby forming a toner thin layer having a uniform thickness on the developing roller 402. The controlling blade 413 is placed so that the tip of the controlling blade 413 faces the downstream of the rotational direction of the developing roller 402 and the center part of the controlling blade 413 makes contact with the developing roller 402. This state is generally called a belly contact state, however, it is also possible to set the tip in the opposite direction from the above-noted direction, and also possible to set the controlling blade 413 in an edge contact state.

Material used for the controlling blade 413 is preferably metal such as SUS304, the thickness is ranging from 0.1 mm to 0.15 mm. Besides metals, a rubber material such as polyurethane rubber, having a thickness of 1 mm to 2 mm, and a resin material having a relatively high hardness such as silicone resin are usable. Even with the use of a material other than metal, it is possible to form a controlling blade having a low-resistivity by mixing carbon black in the material, and thus it is also possible to form an electric field in between the controlling blade 413 and the developing roller 402 by connecting the controlling blade 413 to a bias light source.

The controlling blade 413 serving as the layer thickness controlling member preferably has a free end length of 10 mm to 15 mm from a holder thereof. When the free end length is longer than 15 mm, it results in a large size developing unit, and it is impossible to compactly install the developing unit in an image forming apparatus. When the free end length is shorter than 10 mm, it is likely to cause vibration when the controlling blade 413 makes contact with the surface of the developing roller 402, and abnormal images such as image nonuniformity in lateral tiers easily occur on images.

The contact pressure of the controlling blade 413 is preferably ranging from 0.049 N/cm to 2.45 N/cm. When the contact pressure is more than 2.45 N/cm, the amount of the toner adhered on the developing roller 402 is reduced and the toner charge amount excessively increases, and therefore, the developing amount is decreased and the image density may be reduced. When the contact pressure is less than 0.049 N/cm, a thin layer is not uniformly formed, a toner agglomerate may pass by the controlling blade 413, and the image quality may be significantly degraded. In this embodiment, for the developing roller 402, a developing roller having a JIS-A hardness of 30° was used, for the controlling blade 413, a SUS plate of 0.1 mm in thickness was used, and the contact pressure was set to 60 gf/cm. In this case, an intended toner adhesion amount could be obtained on the developing roller 402.

The contact angle of the controlling blade 413 as a layer thickness controlling member formed with a tangent line of the developing roller 402, in the direction where the tip of the controlling blade 413 faces the downstream of the developing roller 402, is preferably 10° to 45°. A toner amount of the toner not required to form a toner thin layer sandwiched in between the controlling blade 413 and the developing roller 402 is striped off from the developing roller 402, and then it is possible to form a thin layer having a uniform thickness of a weight per unit area of 0.4 mg/cm$^2$ to 0.8 mg/cm$^2$, which is within the target range. In this embodiment, the charged amount of the toner at this point in time is within the range of −10 μC/g to −30 μC/g, and the toner is developed at a position that faces the latent electrostatic image on the photoconductor drum 1.

Therefore, with the use of the one-component developing device of the embodiment, the distance between the surface of the photoconductor drum 1 and the surface of the developing roller 402 becomes narrower than that in a conventional two-component developing unit, and the developing ability is increased to allow for developing even with a lower electric potential.

(Two Component Developing Unit)

For the two-component developing unit, a two component developing device is preferable which has a magnetic field generating unit fixed inside thereof and a developer carrier that carries a two component developer containing a magnetic carrier and a toner and is rotatable.

Figure 6:
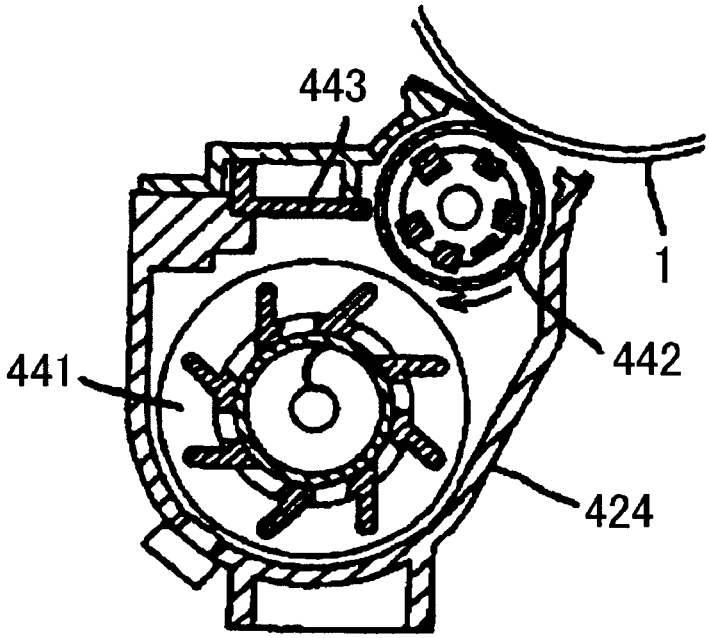
FIG. 6 is a schematic view showing one example of a two-component developing unit in an image forming apparatus of the present invention.

Here, FIG. 6 is a schematic view showing one example of a two component developing device using a two component developer which contains a toner and a magnetic carrier. In the two component developing device shown in FIG. 6, a two component developer is stirred and conveyed by a screw 441 and supplied to a developing sleeve 442 serving as a developer carrier. The two component developer supplied to the sleeve 442 is controlled by a doctor blade 443 serving as a layer thickness controlling member, and the supplied amount of the developer is controlled by a doctor gap which is an interval between the doctor blade 443 and the developing sleeve 442. When the doctor gap is excessively small, the image density becomes insufficient due to an excessively small amount of the developer. In contrast, when the doctor gap is excessively large, the amount of the developer is excessively supplied thereto, which causes a problem that the carrier adheres on a photoconductor drum 1 serving as a latent electrostatic image bearing member. To prevent this problem, inside the developing sleeve 442, a magnet is provided which serves as a magnetic field generating unit configured to form a magnetic field so that the developer is standing on the circumferential surface. Then, the developer stands chain-likely on the developing sleeve 442 along magnetic field lines in normal line which are generated from the magnetic to thereby form a magnetic brush.

The developing sleeve 442 and the photoconductor drum 1 are disposed so as to closely contact each other with a certain space (developing gap) therebetween, and a developing region is formed at a position where both the developing sleeve 442 and the photoconductor drum 1 face to each other. The developing sleeve 442 is made of a non-magnetic material such as aluminum, brass, stainless steel, and conductive resin and is formed in a cylindrical shape and is driven to rotate by a revolution drive mechanism (not shown). The magnetic brush is conveyed to the developing region by rotation of the developing sleeve 442. To the developing sleeve 442, a developing voltage is applied from a developing light source (not shown), a toner on the magnetic brush is separated from the carrier by a developing electric field formed between the developing sleeve 442 and the photoconductor drum 1 and developed on a latent electrostatic image on the photoconductor drum 1.

The size of the developing gap is preferably 5 times to 30 times the particle diameter of the developer. When the particle diameter of the developer is 50 μm, it is preferable that the developing gap be set to 0.5 mm to 1.5 mm. A developing gap wider than 1.5, desired image density may be rarely obtained.

The doctor gap is preferably as large as the developing gap or slightly larger than the developing gap. The drum diameter and drum linear speed of the photoconductor drum 1 and the sleeve diameter and the sleeve linear speed of the developing sleeve 442 are determined depending on restrictions such as copying speed and size of an image forming apparatus used. The ratio of the sleeve linear speed to the drum linear speed is preferably set to 1.1 or more to obtain necessary image density. Further, processing conditions can be controlled by installing a sensor at a position that has gone through developing and detecting the toner adhesion amount from optical reflectance.

<Transferring Step and Transfer Unit>

The transferring step is a step in which the visible image is transferred onto a recording medium by using a transfer unit. The transfer unit is broadly classified into a transfer unit configured to directly transfer a visible image on a latent electrostatic image bearing member onto a recording medium, and a secondary transfer unit configured to primarily transfer a visible image on an intermediate transfer member and then secondarily transfer the visible image onto a recording medium.

The transferring can be accomplished by charging the latent electrostatic image bearing member using a transfer-charger by means of the transfer unit. For the transfer unit, an aspect of the transfer unit is preferable which has a primary transfer unit configured to transfer a visible image on an intermediate transfer member to form a complex transfer image and a secondary transfer unit configured to transfer the complex transfer image onto a recording medium.

-Intermediate Transfer-

The intermediate transfer member is not particularly limited and may be suitably selected from among conventional transfer members in accordance with the intended use. Preferred examples thereof include transfer belts and transfer rollers.

The static friction coefficient of the intermediate transfer member is preferably 0.1 to 0.6 and more preferably 0.3 to 0.5. The volume resistivity of the intermediate transfer member is preferably several ohm-centimeters to 10 Ω·cm. By adjusting the volume resistivity of the intermediate transfer member to several ohm-centimeters to 10 Ω·cm, it is possible to prevent the intermediate transfer member itself being charged and a charge given to a charge providing unit rarely remain on the intermediate transfer member, and thus transfer nonuniformity at the time of secondary transfer can be prevented. Also, a transfer bias can be easily applied at the time of secondary transfer.

Material used for the intermediate transfer member is not particularly limited and may be suitably selected from among conventional materials in accordance with the intended use, however, the following materials are preferably used.

(1) Materials with a high Young's modulus (tension elasticity) used as a single layer belt. Examples thereof includes polycarbonates (PC), polyvinylidene fluoride (PVDF), polyalkylene terephthalate (PAT), blend materials of PC/PAT, ethylene tetrafluoroethylene copolymer (ETFE)/PC, and ETFE/PAT, and thermosetting polyimides of carbon black dispersion. These single layer belts having a high Young's modulus are small in their deformation against stress during image formation and are particularly advantageous in that misalignment of rib does not easily occur when forming a color image.

(2) A double or triple layer belt using the above-noted belt having a high Young's modulus as a base layer, formed with a surface layer and an optional intermediate layer around the peripheral surface of the base layer. The double or triple layer belt has a capability to prevent print defect of unclear center portion in a line image that is caused by the hardness of the single layer belt.

(3) A belt with a relatively low Young's modulus formed by using a rubber or an elastomer. This belt has an advantage that there is almost no print defect of unclear center portion in a line image due to its softness. Additionally, by making the width of the belt wider than driving and tension rollers and thereby using the elasticity of the edge portions that extend over the rollers, it can prevent snaky move of the belt. Therefore, it can reduce cost without the need for ribs and a device to prevent the snaky move.

Of these belts, the (3) elastic belt is particularly preferable.

The elastic belt becomes deformed, in a transfer portion, according to the surface form of a toner layer and/or a recording medium which is poor in surface smoothness. In other words, since such an elastic belt is deformed, following local convexoconcaves or irregularities, it is possible to obtain excellent adhesiveness without excessively increasing a transfer pressure to a toner layer and to obtain a transfer image which is excellent in uniformity without causing print defect of unclear center portion in a line image even on a recording medium which is poor in surface planality.

Resin used for the elastic belt is not particularly limited and may be suitably selected in accordance with the intended use. Examples thereof include polycarbonate resins, fluorine resins (ETFE, PVDF), polystyrene resins, chloro-polystyrene resins, poly-α-methylstyrene resins, styrene-butadiene copolymers, styrene-vinyl chloride copolymers, styrene-vinyl acetate copolymers, styrene-maleic acid copolymers, styrene-acrylic acid ester copolymers (for example, styrene-methyl acrylate copolymer, styrene-ethyl acrylate copolymer, styrene-butyl acrylate copolymer, styrene-octyl acrylate copolymer, styrene-phenyl acrylate copolymer and the like), styrene-methacrylic acid ester copolymers (for example, styrene-methyl methacrylate copolymer, styrene-ethyl methacrylate copolymer, styrene-ethyl methacrylate copolymer, styrene-phenyl methacrylate copolymer and the like), styrene resins such as styrene-α-chloromethyl acrylate copolymers, and styrene-acrylonitrile-acrylic acid ester copolymers (single polymer or copolymer containing styrene or a styrene substitution product), methyl methacrylate resins, butyl methacrylate resins, ethyl acrylate resins, butyl acrylate resins and modified acrylic resins (for example, silicone-modified acrylic resin, vinyl chloride resin-modified acrylic resin, acryl-urethane resins and the like), vinyl chloride resins, styrene-vinyl acetate copolymers, vinyl chloride-vinyl acetate copolymers, rosin-modified maleic acid resins, phenol resins, epoxy resins, polyester resins, polyethylene resins, polypropylene resins, polybutadiene, polyvinylidene chloride resins, ionomer resins, polyurethane resins, silicone resins, ketone resins, ethylene-ethyl acrylate copolymers, xylene resins, polyvinyl butyral resins, polyamide resins and modified polyphenylene oxide resins. Each of these resins may be used alone or in combination with two or more.

Rubber used for the elastic belt is not particularly limited and may be suitably selected in accordance with the intended use. Examples thereof include natural rubbers, butyl rubbers, fluorine rubbers, acrylic rubbers, EPDM rubbers, NBR rubbers, acrylonitrile-butadiene-styrene rubbers, isoprene rubbers, styrene-butadiene rubbers, butadiene rubbers, ethylene-propylene rubbers, ethylene-propylene terpolymers, chloroprene rubbers, chlorosulfonated polyethylenes, chlorinated polyethylenes, urethane rubbers, syndiotactic 1,2-polybutadiene, epichlorohydrin rubbers, silicone rubbers, fluorine rubbers, polysulfide rubbers, polynorbornene rubbers and hydrogenated nitrile rubbers. Each of these rubbers may be used alone or in combination with two or more.

Elastomer used for the elastic belt is not particularly limited and may be suitably selected in accordance with the intended use. Examples thereof include polystyrene thermoplastic elastomers, polyolefin thermoplastic elastomers, polyvinyl chloride thermoplastic elastomers, polyurethane thermoplastic elastomers, polyamide thermoplastic elastomers, polyurea thermoplastic elastomers, polyester thermoplastic elastomers and fluorine thermoplastic elastomers. Each of these elastomers may be used alone or in combination with two or more.

A conductive agent for controlling resistivity used for the elastic belt is not particularly limited and may be suitably selected in accordance with the intended use. Examples thereof include metal powders of carbon black, graphite, aluminum, nickel and the like; and conductive metal oxides such as tin oxide, titanium oxide, antimony oxide, indium oxides, potassium titanate, antimony oxide-tin oxide composite oxide (ATO) and indium oxide-tin oxide composite oxide (ITO). For the conductive metal oxide, the one coated with an insulating fine particle such as barium sulfate, magnesium silicate and calcium carbonate may be used.

For the surface layer of the elastic belt, such a layer that allows for preventing contamination from an elastic material to a latent electrostatic image bearing member, reducing frictional resistance of a belt surface to reduce the toner-adhesive force and improving cleaning ability and secondary transfer properties is preferable. It is preferable that the surface layer contain a binder resin such as polyurethane resin, polyester resin and epoxy resin, and a material that can reduce the surface energy and increase the lubricating property of the surface layer, for example, a powder or a particle of fluorine resin, fluorine compound, fluorocarbon, titanium dioxide, silicon carbide or the like. Further, the surface layer may be a fluorine-rich surface layer which is heat-treated like fluorine rubber material to thereby reduce the surface energy.

A method of producing the elastic belt is not particularly limited and may be suitably selected in accordance with the intended use. The following methods are exemplified. Specifically, (1) centrifugal forming method in which a material is poured into a rotating cylindrical die, thereby forming a belt, (2) spray coating method in which a liquid coating material is sprayed to form a film, (3) dipping method in which a cylindrical die is dipped in a solution and then lifted therefrom, (4) casting method in which a material is poured into an inner die or an outer die, and (5) a method in which a compound is twisted around a cylindrical die and the surface is vulcanized and polished.

A method of preventing extension or stretch of the elastic belt is not particularly limited and may be suitably selected in accordance with the intended use. The following methods are exemplified. For example, (1) a method of adding a material capable of preventing extension or stretch to a core layer, and (2) a method of forming a rubber layer on a core layer that is less extensible or stretchable.

The material capable of preventing extension or stretch is not particularly limited and may be suitably selected in accordance with the intended use. Examples thereof include natural fibers such as cotton and silk; synthetic fibers such as polyester fibers, nylon fibers, acrylic fibers, polyolefin fibers, polyvinyl alcohol fibers, polyvinyl chloride fibers, polyvinyl chloride fibers, polyvinylidene chloride fibers, polyurethane fibers, polyacetal fibers, polyfluoroethylene fibers and phenol fibers; and inorganic fibers such as carbon fibers, glass fibers, boron fibers; and metal fibers such as iron fibers and copper fibers. Fabrics or threads formed using these materials are preferably used.

A method of forming the core layer is not particularly limited and may be suitably selected in accordance with the intended use. The following methods are exemplified. For example, (1) a method in which a die etc. is covered with a fabric woven into a tube-shape, and a coating layer is formed on the die, (2) a method in which a fabric woven into a tube-shape is immersed in a liquid rubber etc., and a coating layer is formed on one surface or both surfaces of the core layer, and (3) a thread is spirally twisted around a die etc. at an arbitrarily determined pitch, and a coating layer is formed on the die.

When the coating layer is excessively thick, stretchability of the surface is increased to easily cause cracks on the surface layer, although it depends on the hardness of the coating layer. It is not preferred to use an excessively thick coating layer having a thickness of about 1 mm or more because the stretched amount will be large, resulting in large amount of extension and shrinkage of image.

It is preferable that the transfer units (the primary transfer unit and the secondary transfer unit) have at least an image transfer device capable of peeling off and charging the visual image formed on the latent electrostatic image bearing member and transferring it onto a recording medium. One image transfer device or two or more image transfer devices may be used. Examples of the image transfer device include corona image transfer device utilizing corona discharge, transfer belts, transfer rollers, pressure-transfer rollers and tacky image transfer devices.

For a recording medium, regular paper is typically used, however, it is not particularly limited and may be suitably selected in accordance with the intended use, as long as it can transfer unfixed images after developing process. PET-base materials for OHP can also be used.

-Transfer Unit for Tandem-type Image Forming Apparatus-

In the tandem-type image forming apparatus, at least a plurality of elements including latent electrostatic image bearing members, charging units, developing units and transfer units are arrayed. In the tandem-type image forming apparatus, four image forming sections of yellow, magenta, cyan and black therein are installed therein, individual color visual images are produced using the four image forming sections in parallel, and the color visual images are superimposed on a recording medium or an intermediate transfer member, and thus it can form a full-color image at higher speed.

Figure 7:
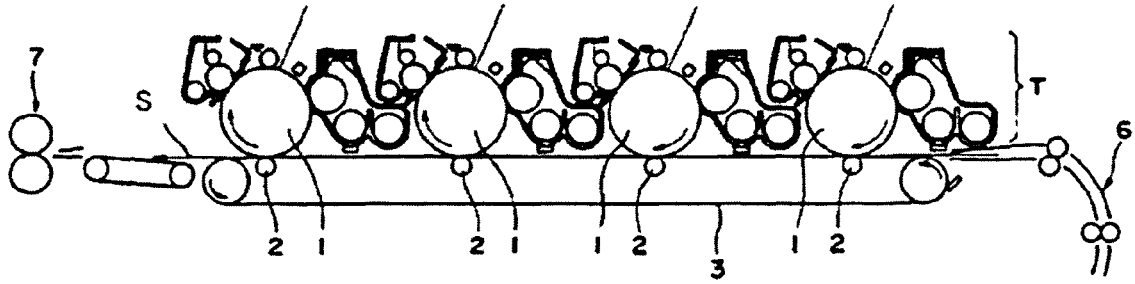
FIG. 7 is a schematic view showing one example of a direct transfer tandem-type image forming apparatus of the present invention.
Figure 8:
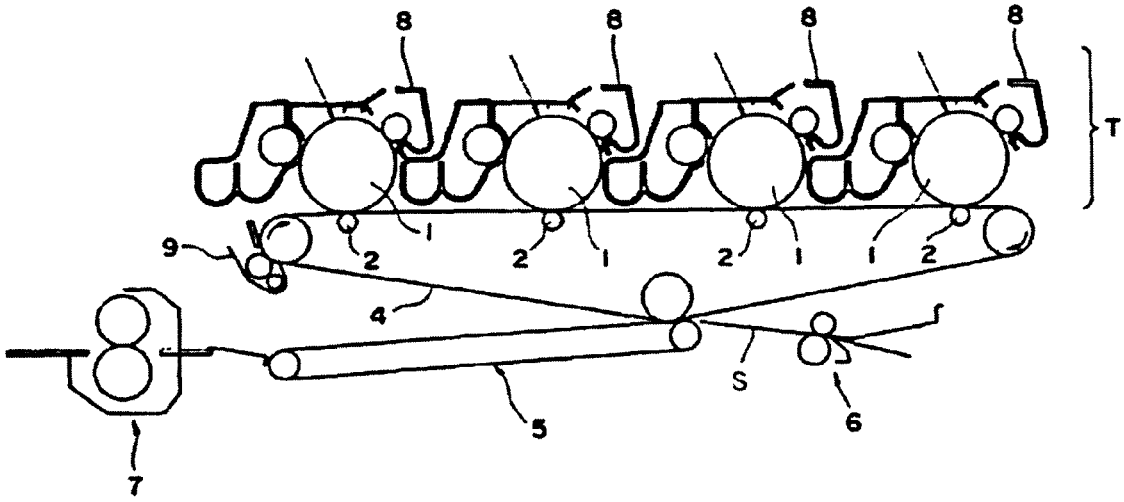
FIG. 8 is a schematic view showing one example of an indirect transfer tandem-type image forming apparatus of the present invention.

For the tandem-type image forming apparatus, there are the following type apparatuses: (1) as shown in FIG. 7, a direct-transfer type image forming apparatus, in which visual images formed on respective latent electrostatic image bearing members 1 are sequentially transferred by means of transfer units 2 onto a recording medium S whose surface moves so as to pass a transfer position that faces the respective latent electrostatic image bearing members 1 in a plurality of image forming sections; and (2) as shown in FIG. 8, an indirect-transfer type image forming apparatus, in which visual images formed on respective latent electrostatic image bearing members 1 in a plurality of image forming sections are sequentially transferred on an intermediate transfer member 4 once by transfer units (primary transfer units) 2, and then the images on the intermediate transfer member 4 are transferred onto a recording medium S at a time by a secondary transfer unit 5. Note that in FIG. 8, a transfer conveying belt is used as the secondary transfer unit, however, it may be formed in a roller shape.

When the (1) direct-transfer type image forming apparatus is compared with the (2) indirect-transfer type image forming apparatus, in the (1) direct-transfer type image forming apparatus, a sheet feeder 6 must be placed upstream of a tandem-type image forming section T and a fixing device 7 must be placed downstream of the tandem-type image forming section T, and thus the image forming apparatus must be made in a large size in the recording medium conveying direction. In contrast, the (2) indirect-transfer type image forming apparatus is advantageous in that a secondary transfer position is relatively freely located, a sheet feeder 6 and a fixing device 7 can be vertically arrayed with a tandem-type image forming section T and it allows for compactness in size.

Further, in the (1) direct-transfer type image forming apparatus, to avoid making the apparatus large in size in the recording medium conveying direction, it is necessary to place the fixing device 7 close to the tandem-type image forming section T. Therefore, it is impossible to place the fixing device 7 with a sufficient margin where the recording medium S can sag, and the fixing device 7 easily affects image formation upstream thereof due to an impact given when one end of the recording medium S enters the fixing device 7 (particularly conspicuous with a thick recording medium), a speed difference between the conveying speed of the recording medium S at the time of passing through the fixing device 7 and the conveying speed of the recording medium S by means of the transfer conveying belt. In contrast, since the (2) indirect-type transfer image forming apparatus allows for installation of the fixing device 7 with a sufficient margin where the recording medium S can sag, the fixing device 7 rarely affect image formation.

For the above noted reasons, recently, indirect-transfer type image forming apparatuses have become a focus of attention, particularly. In such a color image forming apparatus, as shown in FIG. 8, a transfer residual toner remaining on the surface of the latent electrostatic image bearing members 1 after primary transfer is removed using cleaning devices 8 as cleaning units to thereby clean the respective surfaces of the latent electrostatic image bearing members 1 and provide for next image formation. Further, a transfer residual toner remaining on the intermediate transfer member 4 after secondary transfer is removed using an intermediate transfer member cleaning device 9 to thereby clean the surface of the intermediate transfer member 4 and provide for next image formation.

<Fixing Step and Fixing Unit>

The fixing step is a step in which the transferred visual image is fixed on a recording medium using a fixing unit.

The fixing unit is not particularly limited and may be suitably selected in accordance with the intended use, however, a fixing device having a fixing member and a heat source to heat the fixing member is preferably used.

The fixing member is no particularly limited and may be suitably selected in accordance with the intended use, as long as a pair of members can make contact with each other to form a nip portion. Examples of thereof include a combination of an endless belt and a roller and a combination of a roller and another roller. It is preferable to use a combination of an endless belt and a roller or to use a heating method of heating from the surface of the fixing member by induction heating, etc., in terms of capability of shortening warm-up time and achievement of energy-saving.

Examples of the fixing member include conventional heating-pressurizing units (a combination of a heating unit and a pressurizing unit) are exemplified. For the heating-pressurizing unit, in the case of a combination of an endless belt and a roller, for example, a combination of a heating roller, a pressurizing roller and an endless belt is exemplified. In the case of a combination of a roller and another roller, for example, a combination of a heating roller and a pressurizing roller is exemplified.

When the fixing member is an endless belt, the endless belt is preferably formed with a material having small heat capacity. For example, an aspect in which an offset-preventing layer is formed on a base is exemplified. Examples of material used for forming the base include nickels and polyimides. For material used to form the offset-preventing layer, silicone rubbers and fluorine resins are exemplified.

When the fixing member is a roller, the cored bar of the roller is preferably formed with a non-elastic member to prevent deformation (flexure) that could be caused by high-pressure. Material used for the non-elastic member is not particularly limited and may be suitably selected in accordance with the intended use. Preferred examples thereof include high-thermal conductive materials such as aluminum, iron, stainless steel and brass. Further, the roller is preferably covered with an offset-preventing layer. Material used to form the offset-preventing layer is not particularly limited and may be suitably selected in accordance with the intended use. Examples thereof include RTV silicone rubbers, tetrafluoroethylene-perfluoroalkyl vinyl ether (PFA) and polytetrafluoroethylene (PTFE).

In the fixing step, an image formed with the toner may be fixed on the recording medium by transferring the toner image onto the recording medium and passing the recording medium bearing the image through the nip portion, or the transferring of the toner image onto the recording medium and the fixing thereof may be performed at the nip portion at the same timing.

The fixing may be performed for each of color toners every time each of the color toners is transferred to the recording medium, or respective color-toner images may be fixed at a time in a state where the color-toner images are superimposed on the recording medium.

The nip portion is formed by bringing at least two fixing members into contact with each other.

The contact pressure of the nip portion is not particularly limited and may be suitably selected in accordance with the intended use, however, it is preferably 5 N/cm$^2$ or more, more preferably 7 N/cm$^2$ to 100 N/cm$^2$, and still more preferably 10 N/cm$^2$ to 60 N/cm$^2$. When the contact pressure of the nip portion is excessively high, the durability of the roller may degrade. When the contact pressure of the nip portion is less than 5 N/cm$^2$, the offset resistance may become insufficient.

The temperature when the toner image is fixed on the recording medium i.e., the surface temperature of the fixing member from the heating unit, is not particularly limited and may be suitably selected in accordance with the intended use, however, it is preferably 120° C. to 170° C. and more preferably 120° C. to 160° C. When the fixing temperature is lower than 120° C., the fixing property may become insufficient, and when higher than 170° C., it is unfavorable in terms of achievement of energy-saving.

The fixing unit is broadly classified into the following two types: (1) an aspect of a fixing unit that has at least one of a roller and a belt and is configured to fix a transferred image on a recording medium by heating the transferred image from the surface of at least any one of the roller and the belt that does not make contact with the toner and pressurizing the transferred image on the recording medium (internal heating method), and (2) an aspect of a fixing unit that has at least any one of a roller and a belt and is configured to fix a transferred image on a recording medium by heating the transferred image from the surface of at least any one of the roller and the belt that makes contact with the toner and pressurizing the transferred image on the recording medium (external heating method). It is also possible to use a combination of both of the methods.

For a fixing unit based on the (1) internal heating method, for example, the one that the fixing member itself has a heating unit inside thereof is exemplified. Examples of such a heating unit include heat sources such as heater and halogen lamp.

For a fixing unit based on the (2) external heating method, for example, an aspect is preferable in which at least a part of at least one surface of the fixing member is heated by a heating unit. Such a heating unit is not particularly limited and may be suitably selected in accordance with the intended use. For example, electromagnetic induction heating units are exemplified.

The electromagnetic induction heating unit is not particularly limited and may be suitably selected in accordance with the intended use, however, an aspect is preferable which has a unit configured to generate a magnetic field and a heat generating unit configured to generate heat by electromagnetic induction.

For the electromagnetic induction heating unit, for example, an aspect is preferable which has an induction coil located close to the fixing member (for example, a heating roller), a shielding layer formed on the induction coil and an insulating layer formed on the opposite surface of the shielding layer from the surface with the induction coil formed thereon. In this case, for the heating roller, an aspect is preferable which is made of a magnet or a heat pipe.

It is preferable that the induction coil be located at the opposite side of a contact position between the heating roller and the fixing member (for example, a pressurizing roller, an endless belt, etc.) in a condition where the induction coil wraps at least a half cylinder part of the heating roller.

-Fixing Unit Based on Internal Heating Method-

Figure 9:
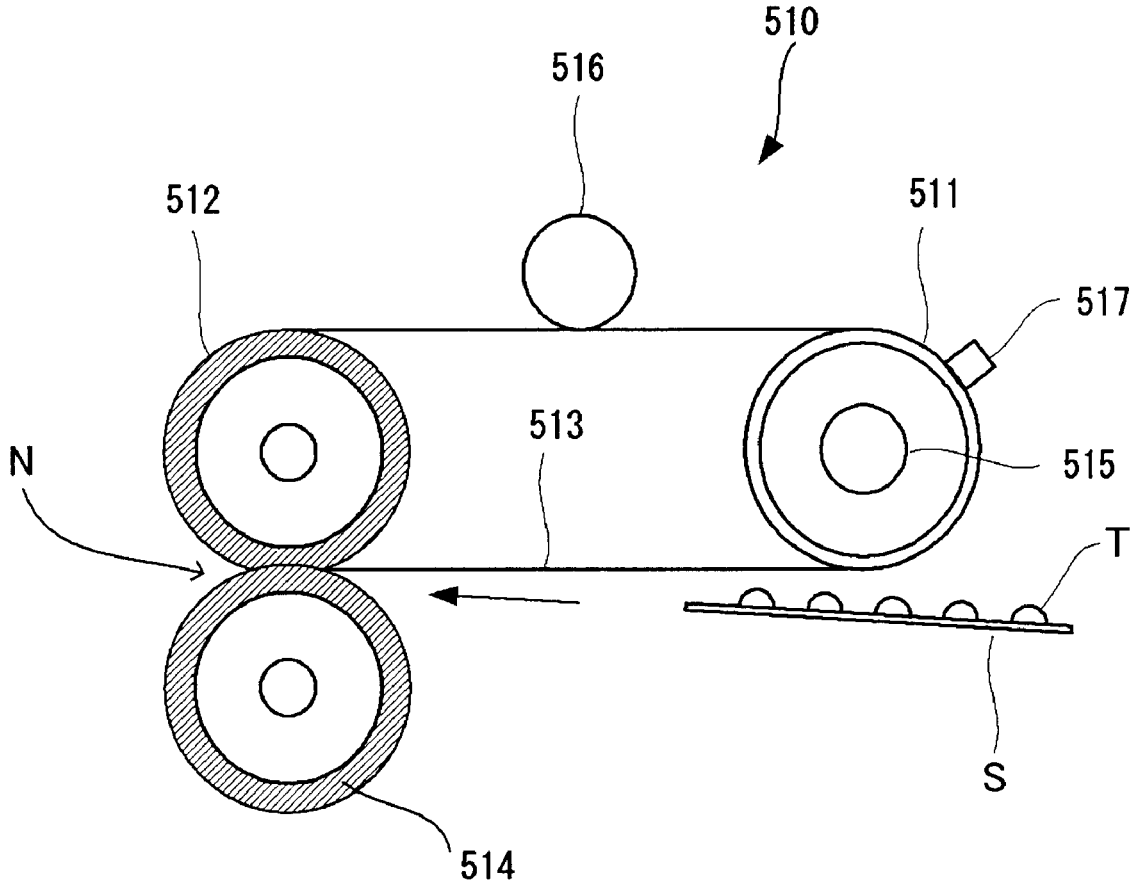
FIG. 9 is a schematic view showing one example of a belt fixing unit in an image forming apparatus of the present invention.

FIG. 9 is a belt type fixing device showing one example of a fixing unit based on internal heating method. A belt type fixing device 510 shown in FIG. 9 is equipped with a heating roller 511, a fixing roller 512, a fixing belt 513 and a pressurizing roller 514.

The fixing belt 513 is spanned over the heating roller 511 and the fixing roller 512 that are rotatably located inside the fixing belt 513 and is heated to a predetermined temperature by the heating roller 511. The heating roller 511 incorporates a heating source 515 inside thereof and is designed such that temperature is adjustable by a temperature sensor 517 closely mounted to the heating roller 511. The fixing roller 512 is rotatably located inside the fixing belt 513 while making contact with the inner surface of the fixing belt 513. The pressurizing roller 514 is rotatably located outside the fixing belt 513 so as to make contact with the outer surface of the fixing belt 513 with pressure. The surface hardness of the fixing belt 513 is lower than the surface hardness of the pressurizing roller 514. In a nip portion N formed between the fixing roller 512 and the pressurizing roller 514, an intermediate area positioned between the introduction end of a recording medium S and the injection end of the recording medium S nearer the fixing roller 512 than the introduction end and the injection end of the recording medium S.

In the belt type fixing device 510 shown in FIG. 9, the recording medium S with a toner image T to be subjected to a fixing step formed thereon is conveyed to the heating roller 511. The toner image T on the recording medium S is heated to a molten state by the heating roller 511 and the fixing belt 513 that are heated to a predetermined temperature by effect of the heating source 515 that is incorporated into the heating roller 511. In this state, the recording medium S is inserted into the nip portion N formed between the fixing roller 512 and the pressurizing roller 514. The recording medium S inserted into the nip portion N is made contact with the surface of the fixing belt that is linked with rotation of the fixing roller 512 and the pressurizing roller 514 to rotate and is pressured at the time of passing through the nip portion N, thereby the toner image is fixed on the recording medium S.

Next, the recording medium S with the toner image T fixed thereon passes through between the fixing roller 512 and the pressurizing roller 514 and is peeled off from the fixing belt 513 to be conveyed to a tray (not shown). At that time, the recording medium S is ejected toward the pressurizing roller 514 to prevent the recording medium S from being wound around the fixing belt 513. The outer surface of the fixing belt 513 is cleaned by a cleaning roller 516.

Figure 10:
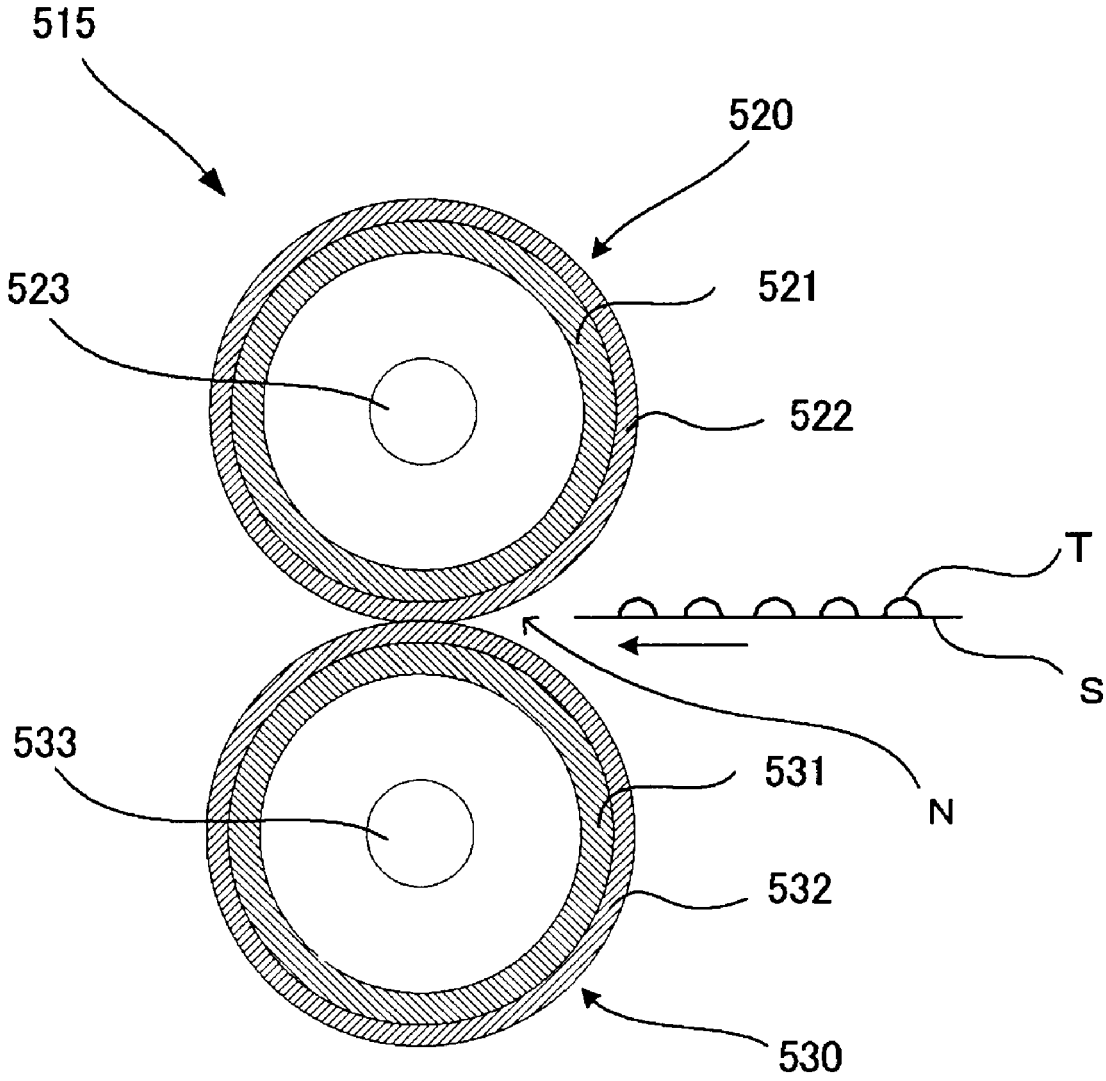
FIG. 10 is a schematic view showing one example of a heat roller fixing unit in an image forming apparatus of the present invention.

A heat roller type fixing device 515 shown in FIG. 10 is equipped with a heating roller 520 serving as the fixing member and a pressurizing roller 530 located so as to make contact with the heating roller 520.

The heating roller 520 has a hollow metal cylinder 521 and is coated with an offset prevention layer 522 on the surface thereof, and at the inner part, a heating lamp 523 is placed. The pressurizing roller 530 has a metal cylinder 531 and is coated with an offset prevention layer 532 on the surface thereof. The metal cylinder 531 is formed in a hollow shape, and at the inner part of the pressurizing roller 530, a heating lamp 533 may be placed. The heating roller 520 and the pressurizing roller 530 are biased by a spring (not shown), thereby being rotatably provided so as to contact with pressure each other and form a nip portion N. The surface hardness of the offset prevention layer 522 in the heating roller 520 is lower than the surface hardness of the offset prevention layer 532 in the pressurizing roller 530. In a nip portion N formed between the heating roller 520 and the pressurizing roller 530, an intermediate area positioned between the introduction end of a recording medium S and the injection end of the recording medium S nearer the heating roller 520 than the introduction end and the injection end of the recording medium S.

In the heating roller type fixing device 515 shown in FIG. 10, first, the recording medium S with a toner image T to be subjected to a fixing step formed thereon is conveyed to the nip portion N between the heating roller 520 and the pressurizing roller 530. A toner T on the recording medium S is heated to a molten state by the heating roller 520 that is heated to a predetermined temperature by effect of the heating lamp 523 that is incorporated into the heating roller 520, and at the same time, is pressed by a pressing force of the pressurizing roller 530, thereby a toner image T is fixed on the recording medium S.

Next, the recording medium S with the toner image T fixed thereon passes through between the heating roller 520 and the pressurizing roller 530 and is conveyed to a tray (not shown). At that time, the recording medium S is ejected toward the pressurizing roller 530 to prevent the recording medium S from being wound around the pressurizing roller 530. The heating roller 520 is cleaned by a cleaning roller 516.

-Fixing Unit Based on External Heating Method-

Figure 11:
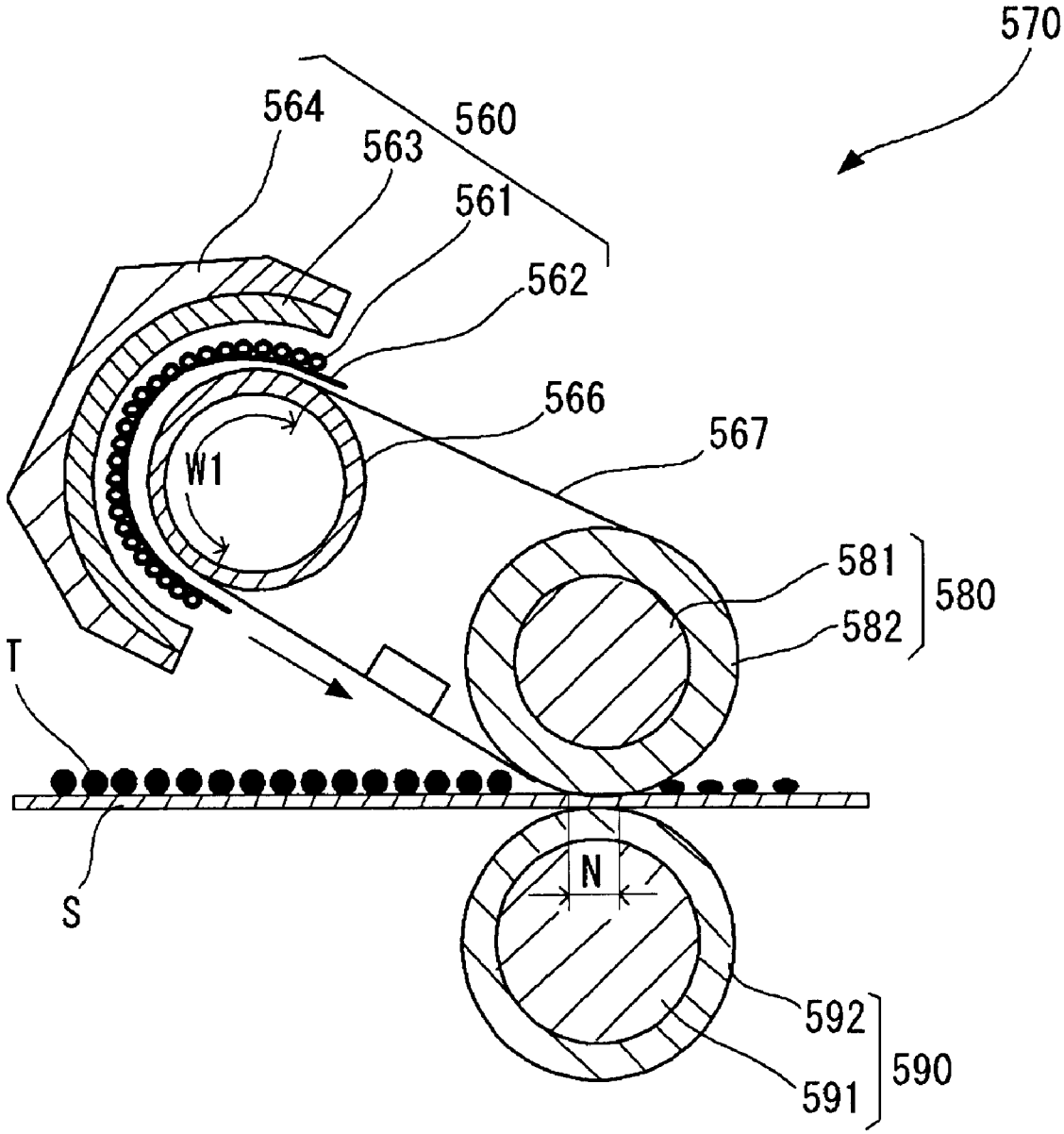
FIG. 11 is a schematic view showing one example of an electromagnetic induction heating type fixing unit in an image forming apparatus of the present invention.

FIG. 11 is an electromagnetic induction heating type fixing device 570 that is exemplarily showing one example of a fixing unit based on external heating method. The electromagnetic induction heating type fixing device 57 is equipped with a heating roller 566, a fixing roller 580, a fixing belt 567, a pressurizing roller 590 and an electromagnetic induction heating unit 560.

The fixing belt 567 is spanned over the heating roller 566 and the fixing roller 580 that are rotatably located inside the fixing belt 567 and is heated to a predetermined temperature by the heating roller 566.

The heating roller 566 is formed, for example, into a hollow cylindrical shape of a magnetic metal material such as iron, cobalt, nickel or a metal alloy thereof, and has an eternal diameter of 20 mm to 40 mm and a wall thickness of 0.3 mm to 1.0 mm, and has a structure that allows for a high-speed temperature increase with low thermal capacity.

The fixing roller 580 has, for example, a cored bar 581 made of a stainless steel or the like, and the surface thereof is covered with an elastic layer 582 that is formed with a silicone rubber having heat resistance into a solid or foam formation. The fixing roller 580 is rotatably located while making contact with the inner surface of the fixing belt 567 inside the fixing belt 567. The fixing roller 580 is designed to have an external diameter of about 20 mm to 40 mm, which is larger than the external diameter of the heating roller 566 in order to form a nip portion N having a predetermined width between the pressurizing roller 590 and the fixing roller 580 by a pressing force from the pressurizing roller 590. The elastic layer 582 has a wall thickness of around 4 mm to 6 mm and is formed such that the thermal capacity of the heating roller 566 is smaller than the thermal capacity of the fixing roller 580, thereby shortening the warm-up time of the heating roller 566.

The pressurizing roller 590 has a cored bar 591 formed of a cylindrical member with a metal which has high-thermal conductivity, for example, copper and aluminum, and the pressurizing roller 590 has a surface that is covered with an elastic layer 592 having a high-thermal resistance and high-toner releasing property has is rotatably located on the outer surface of the fixing belt 567 while contacting with the fixing roller 580 with pressure. For the cored bar 591, SUS may be used, besides the above-noted metal materials.

An electromagnetic induction heating unit 560 is located near the heating roller 566 and is formed in the axial direction of the heating roller 566. The electromagnetic induction heating unit 560 has an exciting coil 561 serving as a magnetic field generating unit and a coil guide plate 562 around which the exciting coil 561 is wound. The coil guide plate 562 is formed in a half-cylinder shape and is located closely to the outer circumferential surface of the heating roller 566. The exciting coil 561 is formed by alternatively winding a long exciting coil rod along the coil guide plate 562 in the axial direction of the heating roller 566. In the exciting coil 561, an oscillation circuit is connected to a driving source (not shown) which is variable in frequency. On the outside of the exciting coil 561, an exciting coil core 563 that is formed in a half cylinder shape and is of a ferromagnetic material such as ferrite is located closely to the exciting coil 561 in a state where it is fixed at an exciting coil core supporting member 564.

In the electromagnetic induction heating type fixing device 570 shown in FIG. 11, the exciting coil 561 of the electromagnetic induction heating unit 560 is electrified, an alternating magnetic field is formed around the electromagnetic induction heating unit 560, and the heating roller 566 which is located closely to the exciting coil 561 and is surrounded by the exciting coil 561 is uniformly and efficiently pre-heated by excitation of overcurrent. A recording medium S with a toner image T to be subjected to a fixing step formed thereon is conveyed to a nip portion N between the fixing roller 580 and the pressurizing roller 590. Then, the fixing belt 567 is heated by the heating roller 566 that has been heated at a predetermined temperature by effect of the electromagnetic induction heating unit 560 in a contact portion W1 with the heating roller 566, and the toner image T on the recording medium S is heated to a molten state by the heated fixing belt 567. In this condition, the recording medium S is inserted into a nip portion N formed between the fixing roller 580 and the pressurizing roller 590. The recording medium S inserted into the nip portion N is made contact with the surface of the fixing belt 567 that is linked with rotation of the fixing roller 580 and the pressurizing roller 590 to rotate and is pressed at the time of passing through the nip portion N, thereby a toner image T is fixed on the recording medium S.

Next, the recording medium S with the toner image T fixed thereon passes through between the fixing roller 580 and the pressurizing roller 590 and is peeled off from the fixing belt 567 to be conveyed to a tray (not shown). At that time, the recording medium S is ejected toward the pressurizing roller 590 to prevent the recording medium S from being wound around the fixing belt 567. The fixing belt 567 is cleaned by a cleaning roller (not shown).

Figure 12:
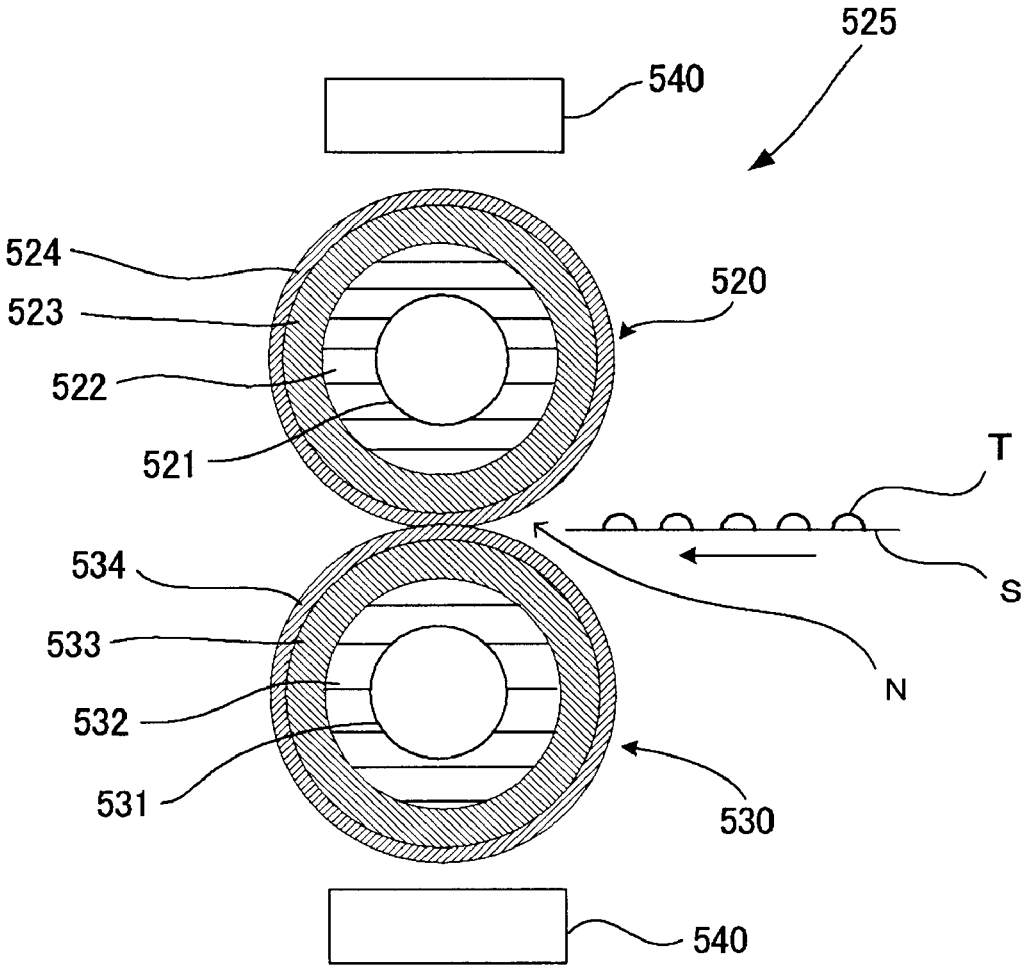
FIG. 12 is a schematic view showing another example of an electromagnetic induction heating type fixing unit in an image forming apparatus of the present invention.

Further, an electromagnetic induction roller type fixing unit 525 as shown in FIG. 12 is a fixing unit equipped with a fixing roller 520 serving as the fixing member, a pressurizing roller 530 that is located so as to contact with the fixing roller 530, and electromagnetic induction heating sources 540 that respectively heat the fixing roller 520 and the pressurizing roller 530 from the outside of the fixing roller 520 and the pressurizing roller 530.

The fixing roller 520 has a cored bar 521, and the surface of the cored bar 521 is covered with a heat resistance elastic layer 522, a heat generating layer 523 and a releasing layer 524 being formed in this order. A pressurizing roller 530 has a cored bar 531, and the surface of the cored bar 531 is covered with a heat resistance elastic layer 532, a heat generating layer 533 and a releasing layer 534 being formed in this order. The releasing layer 524 and the releasing layer 534 are formed of tetrafluoroethylene-perfluoroalkyl vinyl ether (PFA).

The fixing roller 520 and the pressurizing roller 530 are biased by a spring (not shown) and are rotatable formed in a pressure contact state to form a nip portion N.

The electromagnetic induction heating sources 540 are respectively located near the fixing roller 520 and the pressurizing roller 530 and respectively heat the heat generating layer 523 and the heat generating layer 533 by electromagnetic induction.

In the fixing device shown in FIG. 12, the fixing roller 520 and the pressurizing roller 530 are uniformly and efficiently pre-heated by the electromagnetic induction heating source 540. Because the fixing roller 520 and the pressurizing roller 530 are a combination of a roller and another roller, they can easily make the nip portion N have a high-surface pressure.

<Cleaning Step and Cleaning Unit>

The cleaning step is a step in which a residual toner remaining on the surface of the latent electrostatic image bearing member is removed, and the cleaning is preferably carried out by a cleaning unit.

The cleaning the surface of the latent electrostatic image bearing member can be carried out without providing with a leaning unit by providing a developing unit having a developer carrier that makes contact with the latent electrostatic image bearing member and being configured to develop a latent electrostatic image formed on the latent electrostatic image bearing member and to collect a residual toner remaining on the surface of the latent electrostatic image bearing member (cleaning-less method).

The cleaning unit is not particularly limited as long as a residual electrophotographic toner remaining on the electrophotographic photoconductor can be removed by means of the cleaning unit. The cleaner may be suitably selected from among those known in the art. Preferred examples thereof include magnetic brush cleaners, electrostatic brush cleaners, magnetic roller cleaners, blade cleaners, brush cleaners and web cleaners. Of these cleaning units, cleaning blades are particularly preferable in terms of their high-toner removability, compactness and low-cost.

For a material of a rubber blade used for the cleaning blade, for example, urethane rubbers, silicone rubbers, fluorine rubbers, chloroprene rubbers and butadiene rubbers are exemplified. Of these, urethane rubbers are particularly preferable.

Figure 13:
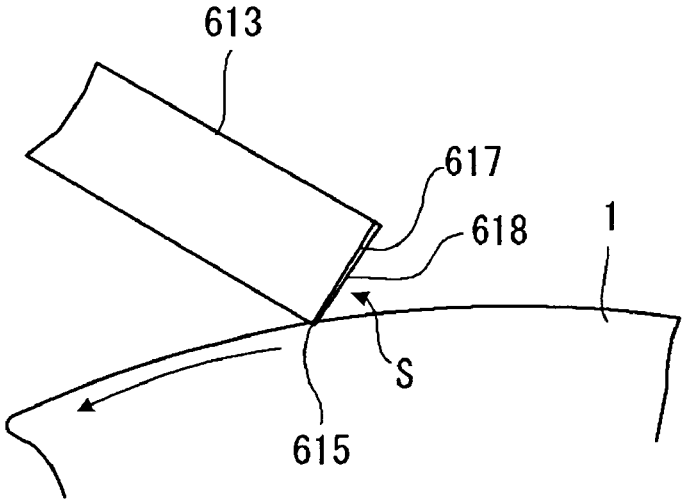
FIG. 13 is a schematic view showing one example of a cleaning blade in an image forming apparatus of the present invention.

Here, FIG. 13 is an enlarged illustration of the proximity of a contact portion 615 between a cleaning blade 613 and a latent electrostatic image bearing member 1 (may be referred to as photoconductor drum 1). The cleaning blade 613 is formed with a toner inhibiting surface 617 which forms, between the cleaning blade 613 and a photoconductor drum 1, a space S that opens from the contact portion 615 toward the upstream of the rotational direction of the photoconductor drum 1, with the surface of the photoconductor drum 1. In this embodiment, the toner inhibiting surface 617 is set so that the space S is formed to have an acute angle from the contact portion 615 to the upstream of the rotational direction of the photoconductor drum 1.

On the toner inhibiting surface 617, as shown in FIG. 13, a coating part 618 is provided as a portion having a high friction coefficient that is highly frictioned by the cleaning blade 613. The coating part 618 is formed with a material having a friction coefficient higher than that of a material used for the cleaning blade 613. Examples of the material having a high-friction coefficient include DLCs (diamond-like carbons). The material having a high-friction coefficient is not particularly limited to DLCs (diamond-like carbons). The coating part 618 is formed in the toner inhibiting surface 617 such that it does not contact with the surface of the photoconductor drum 1.

Note that the cleaning unit is not illustrated in the figure, however, is provided with a toner collecting blade that collects a residual toner scraped by the cleaning blade 613 and a toner collecting coil that transports the residual toner collected by the toner collecting blade to a collection site and may be further provided with other members.

-Image Forming Apparatus Based on Cleaning-less Method-

Figure 14:
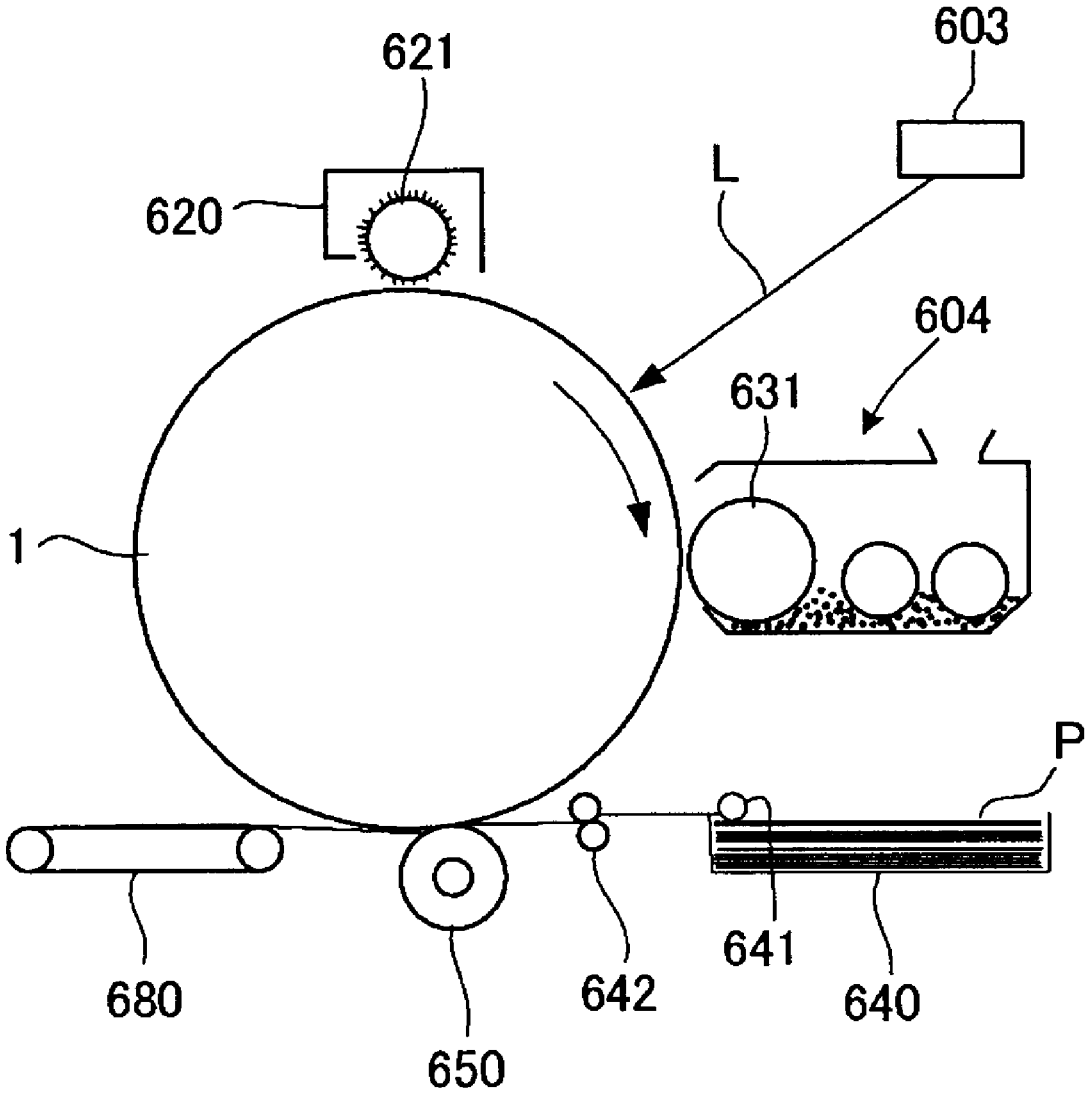
FIG. 14 is a schematic view showing one example of a cleaning-less type image forming apparatus of the present invention.

FIG. 14 is a schematic view showing one example of an image forming apparatus based on cleaning-less method in which a developing unit also serves as a cleaning unit.

In FIG. 14, a reference numeral 1 denotes a photoconductor drum serving as a latent electrostatic image bearing member, a reference numeral 620 denotes a brush charger serving as a contact charging unit, a reference numeral 603 denotes an exposing device serving as an exposing unit, a reference numeral 604 denotes a developing device serving as a developing unit, a reference numeral 640 denotes a sheet feeder cassette, a reference numeral 650 denotes a roller transfer unit, and P denotes a recording medium.

In the cleaning-less image forming apparatus, a residual toner on the photoconductor drum 1 is conveyed to a position of the contact type brush charger 620 making contact with the photoconductor drum 1 by successive rotation of the photoconductor drum 1, is temporarily collected by a magnetic brush (not shown) of the brush charger 621 making contact with the photoconductor drum 1. The collected toner is ejected to the surface of the photoconductor drum 1 again, is ultimately collected by a developer carrier 631 together with the developer into the developing device 604, and is repeatedly used on the photoconductor drum 1 for image formation.

Here, "the developing unit 604 also serves as a cleaning unit" means that a small amount of a residual toner on the photoconductor drum 1 after transfer is collected by effect of a developing bias (an electric potential difference between a direct current voltage applied to the developer carrier 631 and the surface electric potential of the photoconductor drum 1).

In such a cleaning-less image forming apparatus in which a developing unit also serves as a cleaning unit, a transfer residual toner is collected by the developing device 604 and is to be used in the subsequent operation, and therefore, it is greatly advantageous in space-saving because it saves a waste toner, achieves maintenance-free and cleaner-less system and allows for making an image forming apparatus drastically compact.

<Other Steps and Other Units>

The charge eliminating step is a step in which a charge elimination bias is applied to the latent electrostatic image bearing member to remove a charge, and the charging is preferably carrier out by a charge eliminating unit.

The charge eliminating unit is not particularly limited, as long as it can apply a charge elimination bias to the latent electrostatic image bearing member, and may be suitably selected from among conventional charge eliminating devices. Preferred examples thereof include charge eliminating lamps.

The recycling step is a step in which the electrophotographic toner removed in the cleaning step is recycled to the developing unit, and the recycling is preferably carried out by a recycling unit. The recycling unit is not particularly limited, and examples thereof include conventional conveying units.

The controlling step is a step in which the above-noted respective steps are controlled, and the controlling can be preferably carried out by a controlling unit.

The controlling unit is not particularly limited as long as it can control operations of the above-noted respective units, and may be suitably selected in accordance with the intended use. Examples thereof include equipment such as sequencers and computers.

-Image Forming Apparatus and Image Forming Method-

Hereinafter, an aspect in which the image forming method of the present invention is carried out by an image forming apparatus according to the present invention will be explained with reference to FIG. 15. An image forming apparatus 100 shown in FIG. 15 is provided with a photoconductor drum 10 (a latent electrostatic image bearing member 10) as a latent electrostatic image bearing member, a charging roller 20 as a charging unit, an exposure 30 by means of an exposing device as an exposing unit, a developing device 40 as a developing unit, an intermediate transfer member 50, a cleaning blade 60 as a cleaning unit and a charge eliminating lamp 70 as a charge eliminating unit.

The intermediate transfer member 50 is an endless belt and is designed to be movable in the direction indicated by the arrow by tree rollers 51 that are located inside of the intermediate transfer member 50 and respectively span the intermediate transfer member 50. A part of the tree rollers 51 functions as a transfer bias roller that can apply a predetermined transfer bias (primary transfer bias) to the intermediate transfer member 50. Near the intermediate transfer member 50, an intermediate transfer member cleaning blade 90 is located, and a transfer roller 80 serves as the transfer unit which can apply a transfer bias for secondarily transferring a visual image (toner image) onto a recording medium 95 is placed to face the intermediate transfer member 50. Around the intermediate transfer member 50, a corona charger 58 for applying a charge to the visual image on the intermediate transfer member 50 is located in between a contact position between the latent electrostatic image bearing member 10 and the intermediate transfer member 50 and a contact position between the intermediate transfer member 50 and the recording medium 95.

The developing device 40 is composed of a developing belt 41 as a developer carrier, a black developing unit 45K, a yellow developing unit 45Y, a magenta developing unit 45M and a cyan developing unit 45C which are arranged around the developing belt 41. The black developing unit 45K is equipped with a developer container 42K, a developer supplying roller 43K and a developing roller 44K. The yellow developing unit 45Y is provided with a developer container 42Y, a developer supplying roller 43Y and a developing roller 44Y. The magenta developing unit 45M is equipped with a developer container 42M, a developer supplying roller 43M and a developing roller 44M. The cyan developing unit 45C is equipped with a developer container 42C, a developer supplying roller 43C and a developing roller 44C. The developing belt 41 is an endless belt and is rotatably spanned over a plurality of belt rollers, and a part thereof makes contact with the latent electrostatic image bearing member 10.

Figure 15:
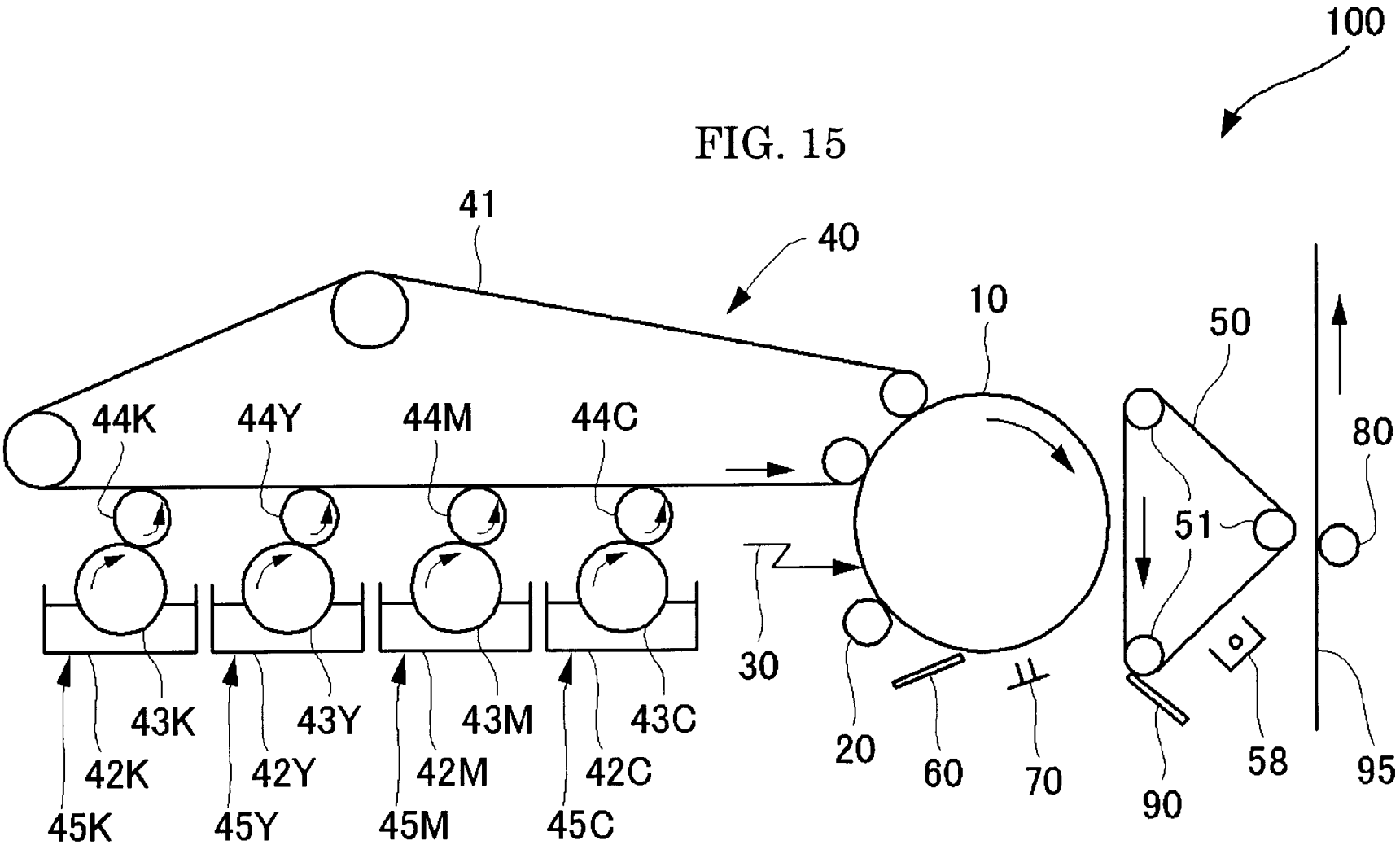
FIG. 15 is a schematic view showing one example of an image forming apparatus of the present invention.

In the image forming apparatus 100 shown in FIG. 15, first, the charging roller 20 uniformly charges the photoconductor drum 10, the exposing device (not shown) imagewisely exposes the surface of the photoconductor drum 10 (exposure 30) to form a latent electrostatic image. The latent electrostatic image formed on the photoconductor drum 10 is developed by supplying a toner from the developing device 40 thereto to form a visible image. The visible image is primarily transferred onto the intermediate transfer member 50 by a voltage applied from the rollers 51 (primary transfer) and further transferred onto the recording medium 95 (secondary transfer). As a result, a transfer image is formed on the recording medium 95. A residual toner remaining on the surface of the latent electrostatic image bearing member 10 is removed by the cleaning blade 60, and a charge remaining on the latent electrostatic image bearing member 10 is once removed by the charge eliminating lamp 70.

Figure 16:
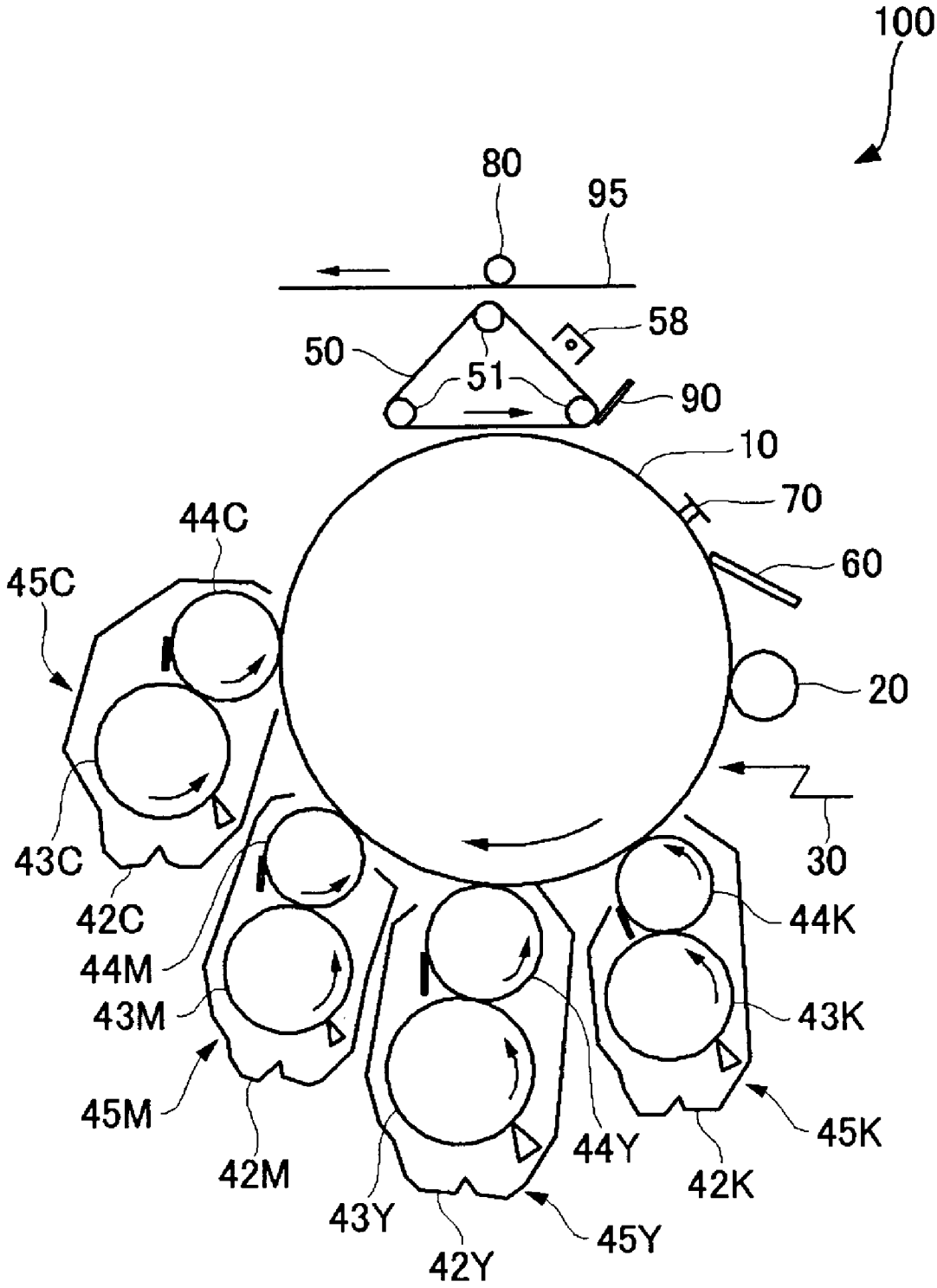
FIG. 16 is a schematic view showing another example of an image forming apparatus of the present invention.

Next, another aspect in which the image forming method of the present invention is carried out by an image forming apparatus of the present invention will be explained with reference to FIG. 16. An image forming apparatus 100 shown in FIG. 16 is not equipped with the developing belt 41 serving as a developer carrier as in the image forming apparatus 100 shown in FIG. 15 and has the same structure and the same operational effects as those of the image forming apparatus 100 shown in FIG. 15, except that a black developing unit 45K, a yellow developing unit 45Y, a magenta developing unit 45M and a cyan developing unit 45C are directly arranged around a latent electrostatic image bearing member 10 so as to face the latent electrostatic image bearing member 10. The same components as shown in FIG. 16 are denoted at the same numerals as shown in FIG. 15.

-Tandem Type Image Forming Apparatus and Image Forming Method-

Figure 17:
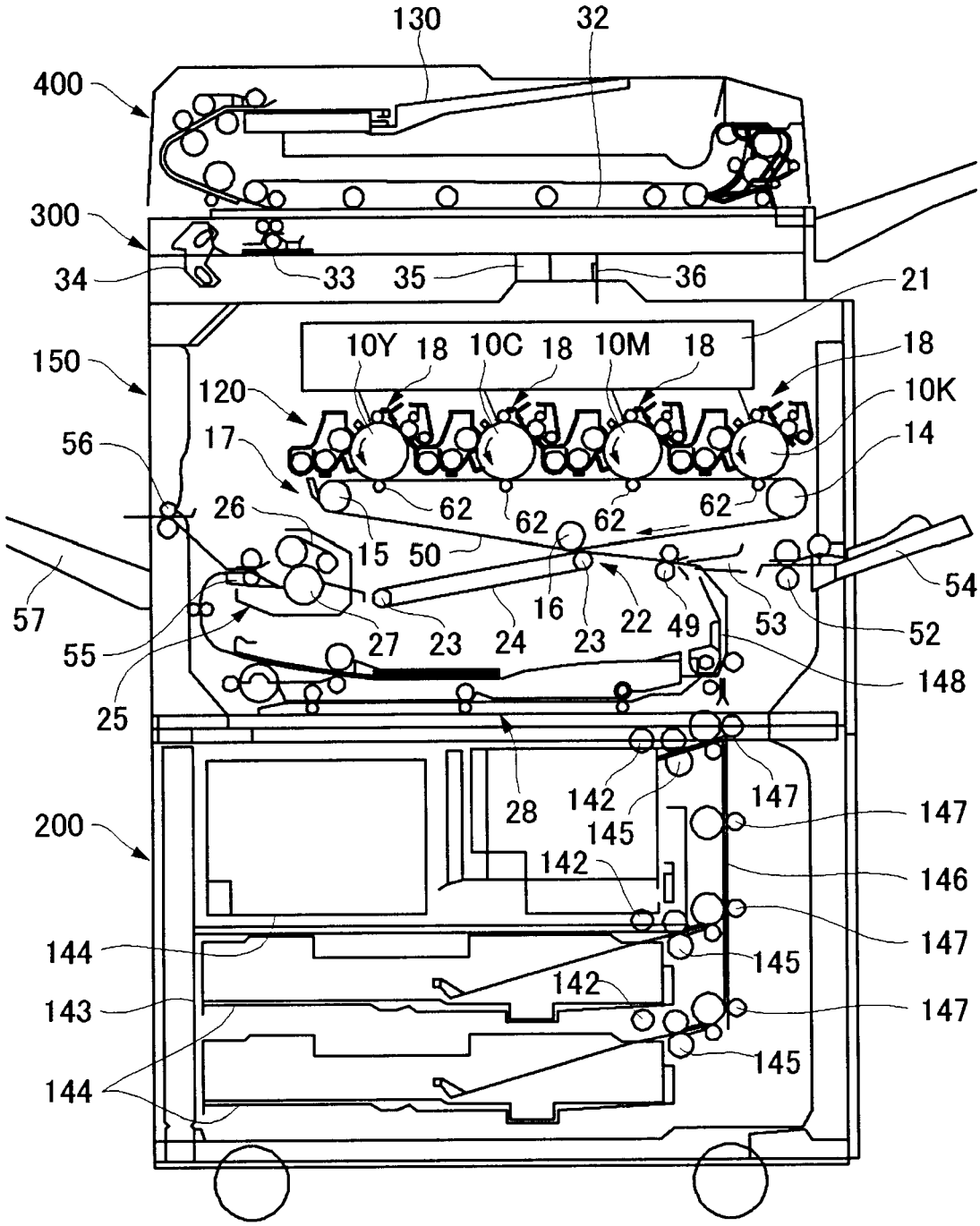
FIG. 17 is a schematic view showing one example of a tandem-type image forming apparatus of the present invention.

A still another aspect in which the image forming method of the present invention is carried out by using an image forming apparatus according to the present invention will be explained with reference to FIG. 17. The tandem type image forming apparatus shown in FIG. 17 is a tandem type color image forming apparatus. The tandem type color image forming apparatus is equipped with a copier main body 150, a sheet feeder table 200, a scanner 300 and an automatic document feeder 400.

The copier main body 150 includes an endless belt intermediate transfer member 50 at its center part. The intermediate transfer member 50 is spanned over three support rollers 14, 15, and 16 and is capable of rotating and moving in a clockwise direction in FIG. 17. An intermediate-transfer-member cleaning unit 17 is capable of removing a residual toner from the intermediate transfer member 50 after image transfer and is placed near the support roller 15. Above the intermediate transfer member 50 spanned between the support rollers of 14 and 15, a tandem type developing unit 120 is placed so that yellow, cyan, magenta, and black image forming units (image forming sections) 18, namely four image forming units (four image forming sections), are arrayed in parallel to face the intermediate transfer member 50 in the moving direction of the intermediate transfer member 50. An exposer 21 is arranged in the vicinity of the tandem type developing unit 120. A secondary transfer unit 22 faces the tandem type developing unit 120 with the interposition of the intermediate transfer member 50. The secondary transfer unit 22 is equipped with an endless belt serving as secondary transferring belt 24 which is spanned over a pair of rollers 23. A recording medium being transported on the secondary transferring belt 24 can make contact with the intermediate transfer member 50. A fixing device 25 is placed on the side of the secondary transfer unit 22.

A sheet reverser 28 is located in the vicinity of the secondary transfer unit 22 and the fixing device 25. The sheet reverser 28 is capable of reversing the recording medium so as to form images on both sides of the recording medium.

Hereinafter, the way of forming a full-color image, i.e. the way a color copy is formed by using the tandem type developing unit 120 will be described. Initially, a document is placed on a document platen 130 of the automatic document feeder (ADF) 400. Alternatively, the automatic document feeder (ADF) 400 is opened, a document is placed on a contact glass 32 of the scanner 300, and the automatic document feeder (ADF) 400 is closed to press the document.

When pushing a start switch (not shown), the document placed on the automatic document feeder 400 is transported onto the contact glass 32. When the document is initially place on the contact glass 32, the scanner 300 is immediately driven to operate a first carriage 33 and a second carriage 34. Light is applied from a light source to the document by action of the first carriage 33, and reflected secondary light from the document is further reflected toward the second carriage 34. The reflected light is further reflected by a mirror of the second carriage 34 and passes through an image-forming lens 35 into a read sensor 36 to thereby read the color document, i.e. color image and to produce black, yellow, magenta and cyan image information.

Figure 18:
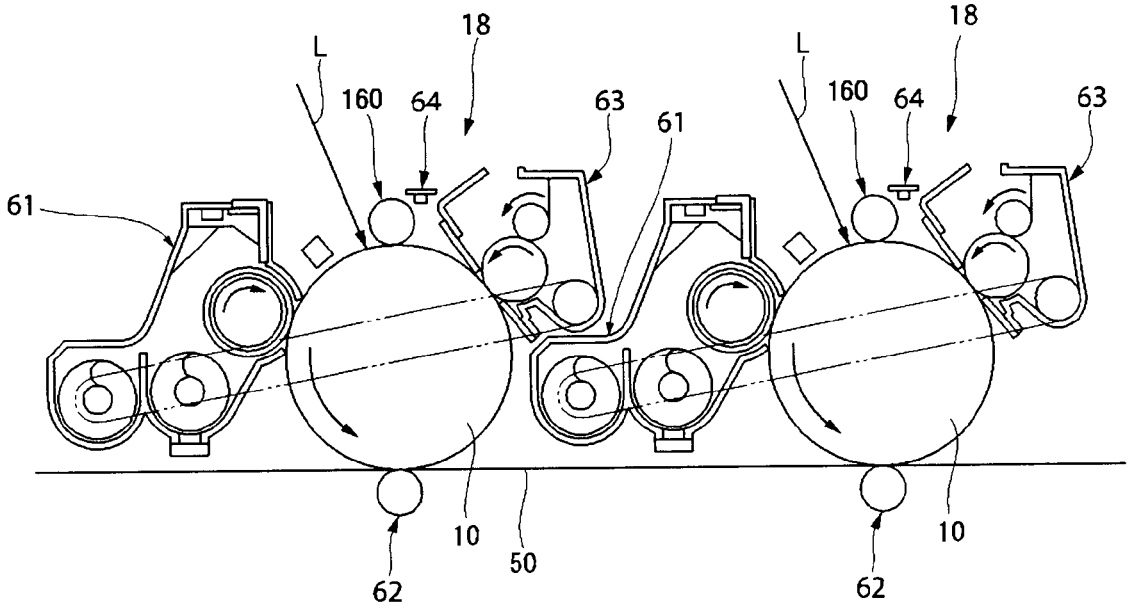
FIG. 18 is an enlarged view of respective image forming sections of the tandem-type image forming apparatus shown in FIG. 17.

Each of the black, yellow, magenta, and cyan image information is transmitted to each of the image forming units 18, i.e. black, yellow, magenta, and cyan image forming units in the tandem type developing unit 120 to thereby form individual toner images in black, yellow, magenta and cyan toner. Specifically, each of the image forming units 18 (black image forming unit, yellow image forming unit, magenta image forming unit and cyan image forming unit) in the tandem type developing unit 120 is equipped with, as shown in FIG. 18, latent electrostatic image bearing members 10 (black latent electrostatic image bearing member 10K, yellow latent electrostatic image bearing member 10Y, magenta latent electrostatic image bearing member 10M and cyan latent electrostatic image bearing member 10C); a charger 60 configured to uniformly charge the latent electrostatic image bearing member 10; an exposer configured to expose the latent electrostatic image bearing member imagewisely corresponding to each color image based on each color image information, which is represented by L in FIG. 18, to form a latent electrostatic image corresponding to each color images on the latent electrostatic image bearing member; an image developing device 61 configured to develop the latent electrostatic image using each color toner, i.e. black toner, yellow toner, magenta toner, and cyan toner to form a toner image which contains each of these color toners; a transfer charger 62 for transferring the toner image onto the intermediate transfer member 50; a cleaning device 63 and a charge-eliminator 64 to thereby respectively form a monochrome image, i.e. a black image, a yellow image, a magenta image and a cyan image based on the respective color image information. The thus formed black image, yellow image, magenta image and cyan image, i.e. the black image formed on the black latent electrostatic image bearing member 10K, the yellow image formed on the yellow latent electrostatic image bearing member 10Y, the magenta image formed on the magenta latent electrostatic image bearing member 10M, and the cyan image formed on the cyan latent electrostatic image bearing member 10C are sequentially transferred (primary transfer) onto the intermediate transfer member 50 which is rotated and shifted by the support rollers 14, 15, and 16. Then, the black image, the yellow image, the magenta image and the cyan image are superimposed on the intermediate transfer member 50 to thereby form a composite color image, i.e. a transferred color image.

In the meanwhile, one of feeder rollers 142 in the feeder table 200 is selectively rotated, sheets or recording media are ejected from one of multiple feeder cassettes 144 in a paper bank 143 and are separated by a separation roller 145 one by one into a feeder path 146, and are transported by transport roller 147 into feeder path 148 in the copier main body 150 and are bumped against a resist roller 49 and stopped. Alternatively, a feeder roller 142 is rotated to eject sheets or recording media on a manual bypass tray 54, the sheets are separated one by one by the separation roller 145 into a manual bypass feeder path 53 and are bumped against the resist roller 49 and stopped. The resist roller 49 is generally grounded, however, may be used under the application of a bias to remove paper dust of sheets.

The resist roller 49 is rotated in synchronization with the movement of the composite color image, i.e. transferred color image on the intermediate transfer member 50 to transport the recording medium into between the intermediate transfer member 50 and the secondary transfer unit 22, and the composite color image, i.e. transferred color image is transferred onto the recording medium by action of the secondary transfer unit 22 (secondary transfer) to thereby transfer the color image to the recording medium. Separately, the intermediate transfer member cleaning device 17 removes a residual toner remaining on the intermediate transfer member 50 after image transfer.

The recording medium bearing the transferred color image is transported by the secondary transfer unit 22 into the fixing device 25, is applied with heat and pressure in the fixing device 25 to fix the composite color image, i.e. transferred color image on the recording medium. The recording medium then changes its direction by action of a switch blade 55 and ejected by an ejecting roller 56 to be stacked on an output tray 57. Alternatively, the recording medium changes its direction by action of the switch blade 55 into the sheet reverser 28, turns therein, is transported again to the transfer position, followed by image formation on the backside of the sheet.

The recording medium bearing images on both sides thereof is ejected through the ejecting roller 56 and then stacked onto the output tray 57.

(Toner Container)

The toner container according to the present invention houses the toner or the developer of the present invention.

The container is not particularly limited and may be suitably selected from among conventional toner containers. For example, a toner container having a toner container main body and a cap is preferably exemplified.

The toner container is not particularly limited as to the size, shape, structure, material and the like and may be suitably selected in accordance with the intended use. For example, as to the shape, a cylindrical shape is preferable. As to the structure, a container is particularly preferable in which a continuous spiral convexoconcave is formed on the inner surface, a toner contained in the container can be moved toward the outlet by rotating the toner container and a part of the spiral portion or the whole thereof has an accordion function.

Material of the toner container main body is not particularly limited. A material that is formable with excellent dimensional precision is preferable. Preferred examples thereof include resins. Among resins, for example, polyester resins, polyethylene resins, polypropylene resins, polystyrene resins, polyvinyl chloride resins, polyacrylic resins, polycarbonate resins, ABS resins, polyacetal resins and the like are preferably exemplified.

The toner container allows for easy storage and easy transportation, is excellent in handleability, detachably mounted to the process cartridge and the image forming apparatus of the present invention and can be preferably used for toner supplement.

(Process Cartridge)

The process cartridge of the present invention has at least a latent electrostatic image bearing member that carries a latent electrostatic image thereon and a developing unit configured to develop the latent electrostatic image carried on the latent electrostatic image bearing member using a toner to form a visible image and further has other units suitably selected in accordance with necessity such as a charging unit, an exposing unit, a transfer unit, a cleaning unit and a charge eliminating unit.

For the toner, the toner of the present invention is used.

The developing unit has at least a developer container that houses the toner or the developer therein and a developer carrier that carries and transports the toner or the developer housed in the developer container and may further have a layer thickness controlling member for controlling a toner layer thickness to be carried on the developer carrier. Specifically, any one of the one-component developing unit and the two-component developing unit which have been explained in the sections of the image forming apparatus and the image forming method can be suitably used.

Further, for the charging unit, exposing unit, transfer unit, cleaning unit and charge eliminating unit, it is possible to selected from those similarly to the respective units explained above in the section of the image forming apparatus and to use them.

The process cartridge can be detachably mounted to various electrophotographic image forming apparatuses, electrophotographic facsimiles and electrophotographic printers, and it is particularly preferable that the process cartridge be detachably mounted to the image forming apparatus of the present invention.

Figure 19:
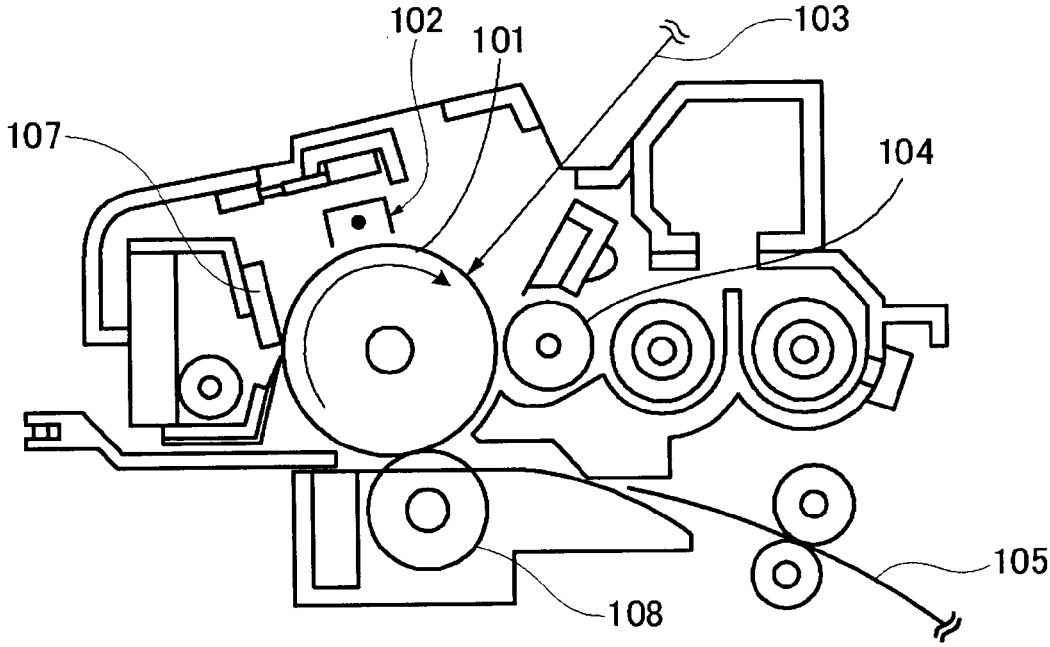
FIG. 19 is a schematic view showing one example of a process cartridge of the present invention.

The process cartridge incorporates, as shown in FIG. 19, a latent electrostatic image bearing member 101, a charging unit 102, a developing unit 104, a transfer unit 108 and a cleaning unit 107 and further has other units in accordance with necessity. In FIG. 19, a reference numeral 103 denotes exposure using an exposing unit, and a reference numeral 105 denotes a recording medium.

Next, in an image forming process using the process cartridge shown in FIG. 19, the latent electrostatic image bearing member 101 goes through charging by the charging unit 102 and exposure 103 by the exposing unit (not shown) while rotating in the direction indicated by the curved arrow, and a latent electrostatic image corresponding to an exposed image is formed of the surface of the latent electrostatic image bearing member 101. The latent electrostatic image is developed by the developing unit 104 to form a visual image, and the obtained visual image is transferred onto the recording medium 105 by the transfer unit 108 to be printed out. Subsequently, the surface of the latent electrostatic image bearing member after the image transfer is cleaned by the cleaning unit 107, and further, a residual charge remaining thereon is eliminated by a charge eliminating unit. The operations stated above are repeated again.

Because the toner of the present invention is used in the image forming apparatus, the image forming method and the process cartridge of the present invention, the image forming apparatus, the image forming method and the process cartridge respectively allow for forming extremely high-quality images for a long period of time without causing a change in color tone and abnormal images such as a reduction in image density and background smear.

EXAMPLES

Hereinafter, the present invention will be further described in detail referring to specific Examples, however, the present invention is not limited to the disclosed Examples.

In the following Examples and Comparative Examples, "softening point of resin", "softening point of rosin", "glass transition temperature (Tg) of resin and rosin" and "acidic value of resin and rosin" were respectively measured as follows.

<Measurement of Softening Point of Resin>

Using a flow tester (CFT-500D, manufactured by Shimadzu Corporation), 1 gram of resin was heated as a sample at a temperature increasing rate of 6° C./min under application of a load of 1.96 MPa using a plunger. The resin sample was extruded from a nozzle of 1 mm in diameter and 1 mm in length, the descent amounts of the plunger of the flow tester to temperatures were plotted, and the temperature at the point in time when the half value of the resin sample flowed out was determined as the softening point of the resin.

<Measurement of Softening Point of Rosin>

(1) Preparation of Sample

Ten grams of rosin was dissolved on a hot plate for 2 hours at a temperature of 170° C. Thereafter, the rosin was naturally cooled down for 1 hour with the lid off under an environmental condition of 25° C. and a relative humidity of 50% and then crushed in a coffee mill (MK-61M, manufactured by Matsushita Electric Industrial Co., Ltd.) for 10 seconds to prepare a sample.

(2) Measurement

Using a flow tester (CFT-500D, manufactured by Shimadzu Corporation), 1 gram of rosin was heated as a sample at a temperature increasing rate of 6° C./min under application of a load of 1.96 MPa using a plunger. The rosin sample was extruded from a nozzle of 1 mm in diameter and 1 mm in length, the descent amounts of the plunger of the flow tester to temperatures were plotted, and the temperature at the point in time when the half value of the rosin sample flowed out was determined as the softening point of the rosin.

<Measurement of Glass Transition Temperature (Tg) of Resin/Rosin>

A measurement sample was weighed 0.01 g to 0.02 g in an aluminum pan. Using a differential scanning calorimetry (DSC210, manufactured by Seiko Electronics Industries Co., Ltd.), the temperature of the sample was increased to 200° C. and then decreased to 0° C. from 200° C. at a temperature decreasing rate of 10° C./min, the temperature of the cooled sample was again increased at a temperature increasing rate of 10° C./min, and the intersection point between an extended line of a base line drawn with the maximum endothermic peak temperature or lower than the maximum endothermic peak temperature and a tangent line showing an maximum angle of inclination from an initial rise point (rising edge) of the endothermic peak temperature to the maximum endothermic peak temperature was determined as the glass transition temperature of the sample.

B. GC (gas chromatography) (HP6890, manufactured by Agilent Co.)
Analysis column: DB-1 (60 m-320 μm-5 μm)
Carrier: helium (He)
Flow rate: 1 mL/min
Inlet temperature: 210° C.
Column head pressure: 34.2 kPa
Injection mode: split
Split ratio: 10:1
Oven temperature conditions: 45° C. (3 min)-10° C./min-280° C. (15 min)

C. MS (mass spectrometry) (HP5973, manufactured by Agilent Co.)
Ionization method: EI (electron ionization) method
Interface temperature: 280° C.
Ion source temperature: 230° C.
Quadruple temperature: 150° C.
Detection mode: scanning 29 m/s to 350 m/s

TABLE 1

| | Hexane acid | Pentane acid | Benzaldehyde | n-hexanal | 2-pentylfuran | Softening point (° C.) | Acid value (mgKOH/g) |
|---|---|---|---|---|---|---|---|
| Purified rosin | $0.6 \times 10^7$ | $0.4 \times 10^7$ | $0.4 \times 10^7$ | $1.6 \times 10^7$ | $1.9 \times 10^7$ | 75.0 | 167 |

<Acidic Value of Resin/Rosin>

The acidic value of resin and rosin was measured based on the method described in JIS K0070. However, only a mixed solvent of acetone and toluene (acetone:toluene=1:1 (volume ratio)) was used for measurement instead of the mixed solvent of ethanol and ether specified in JIS K0070.

Synthesis Example 1

-Purification of Rosin-

Into a 2,000-mL distillation flask of equipped with a fractionating column, a reflux condenser and a receiver, 1,000 g of a tall rosin was added, the content of the flask was distilled under a reduced pressure of 1 kPa, and a distillate collected at a temperature of 195° C. to 250 as the main distillate. Hereinafter, the tall rosin used in purification will be referred to as an unpurified rosin, and the rosin collected as the main distillate will be referred to as a purified rosin.

In a coffee mill (MK-61M, manufactured by Matsushita Electric Industrial Co., Ltd.), 20g of each rosin was crushed for 5 seconds, and the crushed rosin was filtered through a mesh with a pore diameter of 1 mm, and the filtrate was weighed 0.5 g and poured in a head space vial (20 mL). The head space gas was sampled, and impurities in the unpurified rosin and impurities in the purified rosin were analyzed by head space DC-MS method in the following manner. Table 1 shows the analysis results.

<Measurement Conditions for Head Space GC-MS Method>

A. Head space sampler (HP7694, manufactured by Agilent Co.)
Sample temperature: 200° C.
Loop temperature: 200° C.
Transfer line temperature: 200° C.
Sample heating balancing time: 30 min
Vial pressurization gas: helium (He)
Vial pressurization time: 0.3 min
Loop filling time: 0.03 min
Loop balancing time: 0.3 min
Injection time: 1 min Synthesis Example 2

-Synthesis of Polyester Resin-

The alcohol components, terephthalic acid and esterification catalyst shown in the column of Resin H1 in Table 2 were poured into a 5-litter four-necked flask equipped with a nitrogen inlet tube, a dewatering tube, a stirrer and a thermocouple sensor, the components in the flask were subjected to a condensation polymerization reaction in nitrogen atmosphere at 230° C. for 15 hours and then reacted at 230° C. under a pressure of 8.0 kPa for 1 hour. The reactant was cooled down to 180° C., then the purified rosin was poured in the flask, and the components were further reacted at 200° C. for 15 hours. The reactant was cooled down to 180° C. again, then itaconic acid was poured in the flask, and the components were further reacted at 200° C. for 8 hours. The resulting product was cooled down to 180° C., then trimellitic anhydride was poured in the flask, and the temperature of the content of the flask was increased to 210° C. for 2 hours and reacted at 210° C. under a pressure of 10 kPa until a desired softening point to thereby synthesize a polyester resin (Resin H1).

Synthesis Example 3

-Synthesis of Polyester Resin -

The alcohol component, terephthalic acid and esterification catalyst shown in the column of Resin L1 in Table 3 were poured into a 5-litter four-necked flask equipped with a nitrogen inlet tube, a dewatering tube, a stirrer and a thermocouple sensor, the components in the flask were subjected to a condensation polymerization reaction in nitrogen atmosphere at 230° C. for 15 hours and then reacted at 230° C. under a pressure of 8.0 kPa for 1 hour. The reactant was cooled down to 180° C., then the purified rosin was poured in the flask, and the components were further reacted at 200° C. for 15 hours. The reactant was cooled down to 180° C. again, then itaconic acid was poured in the flask, and the temperature of the content of the flask was increased to 210° C. for 2 hours and the content was reacted at 210° C. under a pressure of 10 kPa until a desired softening point to thereby synthesize a polyester resin (Resin L1).

Synthesis Example 4

-Synthesis of Polyester Resin-

The alcohol component, terephthalic acid and esterification catalyst shown in the column of Resin L2 in Table 3 were poured into a 5-litter four-necked flask equipped with a nitrogen inlet tube, a dewatering tube, a stirrer and a thermocouple sensor, the components in the flask were subjected to a condensation polymerization reaction in nitrogen atmosphere at 230° C. for 15 hours and then reacted at 230° C. under a pressure of 8.0 kPa for 1 hour. The reactant was cooled down to 180° C., then itaconic acid was poured in the flask, and the temperature of the content of the flask was increased to 210° C. for 2 hours and the content was reacted at 210° C. under a pressure of 10 kPa until a desired softening point to thereby synthesize a polyester resin (Resin L2).

Synthesis Example 5

-Synthesis of Polyester Resin-

The alcohol components, terephthalic acid and esterification catalyst shown in the columns of Resin H2, Resin H3, Resin H4 and Resin H8 in Table 2 were respectively poured into a 5-litter four-necked flask equipped with a nitrogen inlet tube, a dewatering tube, a rectification column, a stirrer and a thermocouple sensor, the components in the flask were subjected to a condensation polymerization reaction in nitrogen atmosphere at 230° C. for 15 hours and then reacted at 230° C. under a pressure of 8.0 kPa for 1 hour. The reactant was cooled down to 180° C., then trimellitic anhydride was poured in the flask, and the temperature of the content of the flask was increased to 210° C. for 3 hours, the content was reacted under normal pressure of 101.3 kPa for 10 hours and then reacted at 210° C. under a pressure of 20 kPa until a desired softening point to thereby synthesize polyester resins (Resin H2, Resin H3, Resin H4 and Resin H8), respectively.

Synthesis Example 6

-Synthesis of Polyester Resin-

The alcohol components, terephthalic acid and esterification catalyst shown in the columns of Resin H5, Resin H6, Resin L3, Resin L4 and Resin L5 in Table 2 were respectively poured into a 5-litter four-necked flask equipped with a nitrogen inlet tube, a dewatering tube, a rectification column, a stirrer and a thermocouple sensor, the components in the flask were subjected to a condensation polymerization reaction in nitrogen atmosphere at 230° C. for 15 hours and then reacted at 230° C. under a pressure of 20 kPa until a desired softening point to thereby synthesize polyester resins (Resin H5, Resin H6, Resin L3, Resin L4 and Resin L5), respectively.

Synthesis Example 7

-Synthesis of Polyester Resin-

Into a 5 litter four-necked flask equipped with a nitrogen inlet tube, a dewatering tube, a rectification column, a stirrer and a thermocouple sensor, 6 mol of bisphenol A propylene oxide, 4 mol of bisphenol A ethylene oxide, 8 mol of terephthalic acid and 3 mol of trimellitic anhydride were poured, the components were subjected to a condensation polymerization reaction in nitrogen atmosphere at 220° C. for 15 hours and then reacted at 220° C. under a pressure of 20 kPa until a desired softening point to thereby synthesize a polyester resin (Resin L6).

The obtained Resin L6 had a softening point of 106.3° C., a glass transition temperature of 59.0° C. and an acidic value of 21.0 mgKOH/g.

Synthesis Example 8

-Synthesis of Polyester Resin-

Into a 5-litter four-necked flask equipped with a nitrogen inlet tube, a dewatering tube, a rectification column, a stirrer and a thermocouple sensor, 6 mol of bisphenol A propylene oxide, 4 mol of bisphenol A ethylene oxide, 10 mol of fumaric acid and 4 mol of trimellitic anhydride were poured, the components were subjected to a condensation polymerization reaction in nitrogen atmosphere at 220° C. for 15 hours and then reacted at 220° C. under a pressure of 20 kPa until a desired softening point to thereby synthesize a polyester resin (Resin H7).

The obtained Resin H7 had a softening point of 142.5° C., a glass transition temperature of 63.1° C. and an acidic value of 28.1 mgKOH/g.

TABLE 2

| | | Resin No. | | | | | | |
|---|---|---|---|---|---|---|---|---|
| | | Resin H1 | Resin H2 | Resin H3 | Resin H4 | Resin H5 | Resin H6 | Resin H8 |
| Alcohol component | 1,3-propanediol | 228 g (20) | 228 g (20) | — | — | 1,142 g (100) | — | 457 g (40) |
| | 1,2-propanediol | 913 g (80) | 913 g (80) | 913 g (80) | 1,142 g (100) | — | — | 685 g (60) |
| | 2,3-butanediol | — | — | — | — | — | 1,350 g (100) | |
| | glycerin | 276 g (20) | 276 g (20) | 276 g (20) | — | — | — | 276 g (20) |
| Carboxylic acid component | terephthalic acid | 2,117 g (85) | 2,117 g (85) | 1,245 g (50) | 1,743 g (70) | 1,992 g (80) | 1,992 g (80) | 2,117 g (85) |
| | itaconic acid | 195 g (10) | — | — | — | — | — | 195 g (10) |
| | trimellitic anhydride | 144 g (5) | 144 g (5) | 576 g (20) | 288 g (10) | — | — | 144 g (5) |
| | purified rosin | 498 g (10) | — | — | — | — | — | 498 g (10) |

TABLE 2-continued

| | | Resin No. | | | | | | |
|---|---|---|---|---|---|---|---|---|
| | | Resin H1 | Resin H2 | Resin H3 | Resin H4 | Resin H5 | Resin H6 | Resin H8 |
| Esterification catalyst | dibutyltin oxide | — | — | — | — | 0.5 | 0.5 | |
| | tin (II) dioctanate | 0.5 | 0.5 | 0.5 | 0.5 | — | — | 0.5 |
| Properties of polyester resin | Softening point (° C.) | 144.5 | 145.3 | 144.2 | 150.8 | 73.3 | 121.5 | 125.0 |
| | Glass transition temperature (° C.) | 62.5 | 63.2 | 60.8 | 65.3 | 31.1 | 49.9 | 58.2 |
| | Acidic value (mgKOH/g) | 35.0 | 32.3 | 49.4 | 41.7 | 45.2 | 43.6 | 34.2 |

* The value in brackets means a molar ratio between the use amount of alcohol component to the use amount of the carboxylic acid component.
* The use amount of the esterification catalyst is represented with a mass ratio to the 100 parts by mass of the total content of the alcohol component and the carboxylic acid component.

TABLE 3

| | | Resin No. | | | | |
|---|---|---|---|---|---|---|
| | | Resin L1 | Resin L2 | Resin L3 | Resin L4 | Resin L5 |
| Alcohol component | 1,3-propanediol | — | — | — | — | 1,142 g (100) |
| | 1,2-propanediol | 913 g (80) | 913 g (80) | 913 g (80) | 1,142 g (100) | — |
| | 2,3-butanediol | — | — | — | — | — |
| | glycerin | 276 g (20) | 276 g (20) | 276 g (20) | — | — |
| Carboxylic acid component | terephthalic acid | 1,743 g (70) | 1,922 g (80) | 1,922 g (80) | 1,922 g (80) | 1,743 g (70) |
| | itaconic acid | 432 g (15) | 432 g (15) | — | — | — |
| | purified rosin | 1,444 g (29) | — | — | — | — |
| Esterification catalyst | dibutyltin oxide | — | — | — | — | 0.5 |
| | tin (II) dioctanate | 0.5 | 0.5 | 0.5 | 0.5 | — |
| Properties of polyester resin | Softening point (° C.) | 107.0 | 105.3 | 101.6 | 105.0 | 86.2 |
| | Glass transition temperature (° C.) | 58.8 | 57.2 | 56.6 | 58.5 | 40.8 |
| | Acidic value (mgKOH/g) | 38.8 | 35.6 | 40.3 | 30.9 | 35.2 |

* The value in brackets means a molar ratio between the use amount of alcohol component to the use amount of the carboxylic acid component.
* The use amount of the esterification catalyst is represented with a mass ratio to the 100 parts by mass of the total content of the alcohol component and the carboxylic acid component.

Synthesis Example 7

-Synthesis of Aromatic Oxycarboxylic Acid Metal Compound-

In a vessel, 3 mol of 3,5-di-t-butyl salicylate and caustic soda were dissolved in water, and 1.5 mol of ferric chloride ($FeCL_3$) aqueous solution was delivered by drops thereinto while stirring the dissolved solution at 60° C. to obtain a crystal. The crystal was filtered, washed, dried and pulverized to thereby synthesize a dusky black powder (Aromatic Oxycarboxylic Acid Metal Compound 1). The following is the structural formula of the obtained Aromatic Oxycarboxylic Acid Metal Compound 1.

compound 1

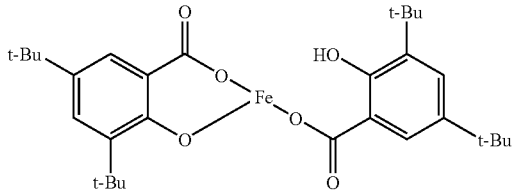

Aromatic oxycarboxylic acid metal

In the structural formula, "t-Bu" represents a tertiary butyl group.

Synthesis Example 8

-Synthesis of Aromatic Oxycarboxylic Acid Metal Compound-

In a vessel, 4 mol of 3,5-di-t-butyl salicylate and caustic soda were dissolved in water, and 1 mol of zirconium chloride ($ZrCl_2$) aqueous solution was delivered by drops thereinto while stirring the dissolved solution at 50° C. to obtain a crystal. The crystal was filtered, washed, dried and pulverized to thereby synthesize a white powder (Aromatic Oxycarboxylic Acid Metal Compound 2). The following is the structural formula of the obtained Aromatic Oxycarboxylic Acid Metal Compound 2.

compound 2

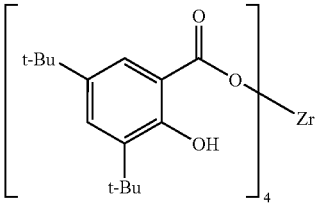

Aromatic oxycarboxylic acid metal

In the structural formula, "t-Bu" represents a tertiary butyl group.

Synthesis Example 9

-Synthesis of Aromatic Oxycarboxylic Acid Metal Compound-

In a vessel, 5 mol of 3,5-di-t-butyl salicylate and caustic soda were dissolved in water, and 4 mol of zirconium oxychloride ($ZrOCl_2.8H_2O$) aqueous solution was delivered by drops thereinto while stirring the dissolved solution at 50° C. to obtain a crystal. The crystal was filtered, washed, dried and pulverized to thereby synthesize a white powder (Aromatic Oxycarboxylic Acid Metal Compound 3). The following is the structural formula of the obtained Aromatic Oxycarboxylic Acid Metal Compound 3.

compound 3

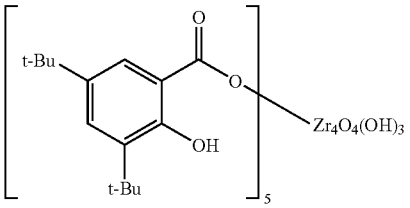

Aromatic oxycarboxylic acid metal

In the structural formula, "t-Bu" represents a tertiary butyl group.

Production Example 1

-Preparation of Masterbatch 1-

A pigment having the following composition, Resin L1 and pure water were mixed at a mixing ratio of 1:1:0.5 (mass ratio) and the mixture was kneaded with two rollers at a temperature of 70° C. Then, the temperature of the two rollers was increased to 120° C. to evaporate water to thereby prepare Masterbatch 1 composed of Cyan Toner Masterbatch 1 (MB-C1), Magenta Toner Masterbatch 1 (MB-M1), Yellow Toner Masterbatch 1 (MB-Y1) and Black Toner Masterbatch 1 (MB-K1).

| | |
|---|---|
| [Formulation of Cyan Toner Masterbatch 1 (MB-C1)] | |
| Resin L1 | 100 parts by mass |
| Cyan pigment (C.I. Pigment blue 15:3) | 100 parts by mass |
| Pure water | 50 parts by mass |
| [Formulation of Magenta Toner Masterbatch 1 (MB-M1)] | |
| Resin L1 | 100 parts by mass |
| Magenta pigment (C.I. Pigment red 122) | 100 parts by mass |
| Pure water | 50 parts by mass |
| [Formulation of Yellow Toner Masterbatch 1 (MB-Y1)] | |
| Resin L1 | 100 parts by mass |
| Yellow pigment (C.I. Pigment yellow 180) | 100 parts by mass |
| Pure water | 50 parts by mass |
| [Formulation of Black Toner Masterbatch 1 (MB-K1)] | |
| Resin L1 | 100 parts by mass |
| Black pigment (carbon black) | 100 parts by mass |
| Pure water | 50 parts by mass |

Production Example 2

-Preparation of Masterbatch 2-

Masterbatch 2 was prepared in the same manner as in Production Example 1 except that Resin L2 was used instead of Resin L1. Masterbatch 2 was composed of Cyan Toner Masterbatch 2 (MB-C2), Magenta Toner Masterbatch 2 (MB-M2), Yellow Toner Masterbatch 2 (MB-Y2) and Black Toner Masterbatch 2 (MB-K2).

Production Example 3

-Preparation of Masterbatch 3-

Masterbatch 3 was prepared in the same manner as in Production Example 1 except that Resin L3 was used instead of Resin L1. Masterbatch 3 was composed of Cyan Toner Masterbatch 3 (MB-C3), Magenta Toner Masterbatch 3 (MB-M3), Yellow Toner Masterbatch 3 (MB-Y3) and Black Toner Masterbatch 3 (MB-K3).

Production Example 4

-Preparation of Masterbatch 4-

Masterbatch 4 was prepared in the same manner as in Production Example 1 except that Resin L4 was used instead of Resin L1. Masterbatch 4 was composed of Cyan Toner Masterbatch 4 (MB-C4), Magenta Toner Masterbatch 4 (MB-M4), Yellow Toner Masterbatch 4 (MB-Y4) and Black Toner Masterbatch 4 (MB-K4).

Production Example 5

-Preparation of Masterbatch 5-

Masterbatch 5 was prepared in the same manner as in Production Example 1 except that Resin L4 was used instead of Resin L1. Masterbatch 5 was composed of Cyan Toner Masterbatch 5 (MB-C5), Magenta Toner Masterbatch 5 (MB-M5), Yellow Toner Masterbatch 5 (MB-Y5) and Black Toner Masterbatch 5 (MB-K5).

Production Example 6

-Preparation of Masterbatch 6-

Masterbatch 6 was prepared in the same manner as in Production Example 1 except that Resin L6 was used instead of Resin L1. Masterbatch 6 was composed of Cyan Toner Masterbatch 6 (MB-C6), Magenta Toner Masterbatch 6 (MB-M6), Yellow Toner Masterbatch 6 (MB-Y6) and Black Toner Masterbatch 6 (MB-K6).

TABLE 4

| | | | Resin formulation | | Pigment formulation | | Amount of |
|---|---|---|---|---|---|---|---|
| | | | Resin | Use amount (part by mass) | Pigment | Use amount (part by mass) | pure water (part by mass) |
| Masterbatch 1 | Cyan | MB-C1 | Resin L1 | 100 | C.I. Pigment blue 15:3 | 100 | 50 |
| | Magenta | MB-M1 | Resin L1 | 100 | C.I. Pigment red 122 | 100 | 50 |
| | Yellow | MB-Y1 | Resin L1 | 100 | C.I. Pigment yellow 180 | 100 | 50 |
| | Black | MB-K1 | Resin L1 | 100 | Carbon black | 100 | 50 |
| Masterbatch 2 | Cyan | MB-C2 | Resin L2 | 100 | C.I. Pigment blue 15:3 | 100 | 50 |
| | Magenta | MB-M2 | Resin L2 | 100 | C.I. Pigment red 122 | 100 | 50 |
| | Yellow | MB-Y2 | Resin L2 | 100 | C.I. Pigment yellow 180 | 100 | 50 |
| | Black | MB-K2 | Resin L2 | 100 | Carbon black | 100 | 50 |
| Masterbatch 3 | Cyan | MB-C3 | Resin L3 | 100 | C.I. Pigment blue 15:3 | 100 | 50 |
| | Magenta | MB-M3 | Resin L3 | 100 | C.I. Pigment red 122 | 100 | 50 |
| | Yellow | MB-Y3 | Resin L3 | 100 | C.I. Pigment yellow 180 | 100 | 50 |
| | Black | MB-K3 | Resin L3 | 100 | Carbon black | 100 | 50 |
| Masterbatch 4 | Cyan | MB-C4 | Resin L4 | 100 | C.I. Pigment blue 15:3 | 100 | 50 |
| | Magenta | MB-M4 | Resin L4 | 100 | C.I. Pigment red 122 | 100 | 50 |
| | Yellow | MB-Y4 | Resin L4 | 100 | C.I. Pigment yellow 180 | 100 | 50 |
| | Black | MB-K4 | Resin L4 | 100 | Carbon black | 100 | 50 |
| Masterbatch 5 | Cyan | MB-C5 | Resin L5 | 100 | C.I. Pigment blue 15:3 | 100 | 50 |
| | Magenta | MB-M5 | Resin L5 | 100 | C.I. Pigment red 122 | 100 | 50 |
| | Yellow | MB-Y5 | Resin L5 | 100 | C.I. Pigment yellow 180 | 100 | 50 |
| | Black | MB-K5 | Resin L5 | 100 | Carbon black | 100 | 50 |
| Masterbatch 6 | Cyan | MB-C6 | Resin L6 | 100 | C.I. Pigment blue 15:3 | 100 | 50 |
| | Magenta | MB-M6 | Resin L6 | 100 | C.I. Pigment red 122 | 100 | 50 |
| | Yellow | MB-Y6 | Resin L6 | 100 | C.I. Pigment yellow 180 | 100 | 50 |
| | Black | MB-K6 | Resin L6 | 100 | Carbon black | 100 | 50 |

Example 1

-Preparation of Toner 1-

Toner 1 composed of Cyan Toner 1, Magenta Toner 1, Yellow Toner 1 and Black Toner 1 was prepared as follows.

-Preparation of Cyan Toner 1-

A Cyan Toner Formulation 1 having the following composition was preliminarily mixed using a HENSCHEL MIXER (FM10B, manufactured by Mitsui Miike Kakoki K.K.) and then was melt-kneaded at a temperature of 100° C. to 130° C. using a biaxial kneader (PCM-30, manufactured by IKEGAI LTD.). The obtained kneaded product was cooled down to room temperature and then coarsely crushed using a hammer mill so as to have particle diameters of 200 μm to 400 μm. Subsequently, the coarsely crushed product was pulverized using a ultrasonic jet pulverizer (LABO-JET, manufactured by Nippon Pneumatic Manufacturing Co., Ltd.) and the pulverized product was classified using an airflow classifier (MDS-I, manufactured by Nippon Pneumatic Manufacturing Co., Ltd.) to thereby prepare a toner base particle.

Next, 1.0 part by mass of an additive (HDK-2000, manufactured by Clariant Japan K.K.) was added to 100 parts by mass of the toner base particle in a HENSCHEL MIXER, then stirred and mixed therein, thereby preparing Cyan Toner 1.

| [Cyan Toner Formulation 1] | |
|---|---|
| Resin H2 as polyester resin (A) | 50 parts by mass |
| Resin L5 as polyester resin (B) | 42 parts by mass |
| Cyan Toner Masterbatch 5 (MB-C5) | 16 parts by mass |
| De-free fatty acid carnauba wax (WA03, manufactured by TOAGOSEI CO., LTD.) | 3 parts by mass |

-continued

| [Cyan Toner Formulation 1] | |
|---|---|
| Charge controlling agent (Aromatic Oxycarboxylic Acid Metal Compound 1 synthesized in Synthesis Example 7) | 1 part by mass |

-Preparation of Magenta Toner 1-

Magenta Toner 1 was prepared in the same manner as in the Cyan Toner 1 production method except that the Cyan Toner Formulation 1 was changed to a Magenta Toner Formulation 1 having the following composition.

| [Magenta Toner Formulation 1] | |
|---|---|
| Resin H2 as polyester resin (A) | 50 parts by mass |
| Resin L5 as polyester resin (B) | 40 parts by mass |
| Magenta Toner Masterbatch 5 (MB-M5) | 20 parts by mass |
| De-free fatty acid carnauba wax (WA03, manufactured by TOAGOSEI CO., LTD.) | 3 parts by mass |
| Charge controlling agent (Aromatic Oxycarboxylic Acid Metal Compound 1 synthesized in Synthesis Example 7) | 1 part by mass |

-Preparation of Yellow Toner 1-

Yellow Toner 1 was prepared in the same manner as in the Cyan Toner 1 production method except that the Cyan Toner Formulation 1 was changed to a Yellow Toner Formulation 1 having the following composition.

| [Yellow Toner Formulation 1] | |
|---|---|
| Resin H2 as polyester resin (A) | 50 parts by mass |
| Resin L5 as polyester resin (B) | 40 parts by mass |
| Yellow Toner Masterbatch 5 (MB-Y5) | 20 parts by mass |
| De-free fatty acid carnauba wax (WA03, manufactured by TOAGOSEI CO., LTD.) | 3 parts by mass |
| Charge controlling agent (Aromatic Oxycarboxylic Acid Metal Compound 1 synthesized in Synthesis Example 7) | 1 part by mass |

-Preparation of Black Toner 1-

Black Toner 1 was prepared in the same manner as in the Cyan Toner 1 production method except that the Cyan Toner Formulation 1 was changed to a Black Toner Formulation 1 having the following composition.

| [Black Toner Formulation 1] | |
|---|---|
| Resin H2 as polyester resin (A) | 50 parts by mass |
| Resin L5 as polyester resin (B) | 42 parts by mass |
| Black Toner Masterbatch 5 (MB-K5) | 16 parts by mass |
| De-free fatty acid carnauba wax (WA03, manufactured by TOAGOSEI CO., LTD.) | 3 parts by mass |
| Charge controlling agent (Aromatic Oxycarboxylic Acid Metal Compound 1 synthesized in Synthesis Example 7) | 1 part by mass |

Example 2

-Preparation of Toner 2-

Toner 2 composed of Cyan Toner 2, Yellow Toner 2, Magenta Toner 2 and Black Toner 2 was prepared in the same manner as in Example 1 except that the respective toner formulations were changed to the following toner formulations.

| [Cyan Toner Formulation 2] | |
|---|---|
| Resin H6 as polyester resin (A) | 50 parts by mass |
| Resin L2 as polyester resin (B) | 42 parts by mass |
| Cyan Toner Masterbatch 2 (MB-C2) | 16 parts by mass |
| De-free fatty acid carnauba wax (WA03, manufactured by TOAGOSEI CO., LTD.) | 3 parts by mass |
| Charge controlling agent (Aromatic Oxycarboxylic Acid Metal Compound 1 synthesized in Synthesis Example 7) | 1 part by mass |

| [Magenta Toner Formulation 2] | |
|---|---|
| Resin H6 as polyester resin (A) | 50 parts by mass |
| Resin L2 as polyester resin (B) | 40 parts by mass |
| Magenta Toner Masterbatch 2 (MB-M2) | 20 parts by mass |
| De-free fatty acid carnauba wax (WA03, manufactured by TOAGOSEI CO., LTD.) | 3 parts by mass |
| Charge controlling agent (Aromatic Oxycarboxylic Acid Metal Compound 1 synthesized in Synthesis Example 7) | 1 part by mass |

-continued

| [Yellow Toner Formulation 2] | |
|---|---|
| Resin H6 as polyester resin (A) | 50 parts by mass |
| Resin L2 as polyester resin (B) | 40 parts by mass |
| Yellow Toner Masterbatch 2 (MB-Y2) | 20 parts by mass |
| De-free fatty acid carnauba wax (WA03, manufactured by TOAGOSEI CO., LTD.) | 3 parts by mass |
| Charge controlling agent (Aromatic Oxycarboxylic Acid Metal Compound 1 synthesized in Synthesis Example 7) | 1 part by mass |

| [Black Toner Formulation 2] | |
|---|---|
| Resin H6 as polyester resin (A) | 50 parts by mass |
| Resin L2 as polyester resin (B) | 42 parts by mass |
| Black Toner Masterbatch 2 (MB-K2) | 16 parts by mass |
| De-free fatty acid carnauba wax (WA03, manufactured by TOAGOSEI CO., LTD.) | 3 parts by mass |
| Charge controlling agent (Aromatic Oxycarboxylic Acid Metal Compound 1 synthesized in Synthesis Example 7) | 1 part by mass |

Example 3

-Preparation of Toner 3-

Toner 3 composed of Cyan Toner 3, Yellow Toner 3, Magenta Toner 3 and Black Toner 3 was prepared in the same manner as in Example 1 except that the respective toner formulations were changed to the following toner formulations.

| [Cyan Toner Formulation 3] | |
|---|---|
| Resin H2 as polyester resin (A) | 50 parts by mass |
| Resin L2 as polyester resin (B) | 42 parts by mass |
| Cyan Toner Masterbatch 2 (MB-C2) | 16 parts by mass |
| De-free fatty acid carnauba wax (WA03, manufactured by TOAGOSEI CO., LTD.) | 3 parts by mass |
| Charge controlling agent (Aromatic Oxycarboxylic Acid Metal Compound 1 synthesized in Synthesis Example 7) | 1 part by mass |

| [Magenta Toner Formulation 3] | |
|---|---|
| Resin H2 as polyester resin (A) | 50 parts by mass |
| Resin H2 as polyester resin (B) | 40 parts by mass |
| Magenta Toner Masterbatch 2 (MB-M2) | 20 parts by mass |
| De-free fatty acid carnauba wax (WA03, manufactured by TOAGOSEI CO., LTD.) | 3 parts by mass |
| Charge controlling agent (Aromatic Oxycarboxylic Acid Metal Compound 1 synthesized in Synthesis Example 7) | 1 part by mass |

| [Yellow Toner Formulation 3] | |
|---|---|
| Resin H2 as polyester resin (A) | 50 parts by mass |
| Resin H2 as polyester resin (B) | 40 parts by mass |
| Yellow Toner Masterbatch 2 (MB-Y2) | 20 parts by mass |
| De-free fatty acid carnauba wax (WA03, manufactured by TOAGOSEI CO., LTD.) | 3 parts by mass |
| Charge controlling agent (Aromatic Oxycarboxylic Acid Metal Compound 1 synthesized in Synthesis Example 7) | 1 part by mass |

| [Black Toner Formulation 3] | |
|---|---|
| Resin H2 as polyester resin (A) | 50 parts by mass |
| Resin L2 as polyester resin (B) | 42 parts by mass |
| Black Toner Masterbatch 2 (MB-K2) | 16 parts by mass |
| De-free fatty acid carnauba wax (WA03, manufactured by TOAGOSEI CO., LTD.) | 3 parts by mass |

-continued

| | |
|---|---|
| Charge controlling agent (Aromatic Oxycarboxylic Acid Metal Compound 1 synthesized in Synthesis Example 7) | 1 part by mass |

Example 4

-Preparation of Toner 4-

Toner 4 composed of Cyan Toner 4, Yellow Toner 4, Magenta Toner 4 and Black Toner 4 was prepared in the same manner as in Example 1 except that the respective toner formulations were changed to the following toner formulations.

[Cyan Toner Formulation 4]

| | |
|---|---|
| Resin H3 as polyester resin (A) | 50 parts by mass |
| Resin L3 as polyester resin (B) | 42 parts by mass |
| Cyan Toner Masterbatch 3 (MB-C3) | 16 parts by mass |
| De-free fatty acid carnauba wax (WA03, manufactured by TOAGOSEI CO., LTD.) | 3 parts by mass |
| Charge controlling agent (Aromatic Oxycarboxylic Acid Metal Compound 1 synthesized in Synthesis Example 7) | 1 part by mass |

[Magenta Toner Formulation 4]

| | |
|---|---|
| Resin H3 as polyester resin (A) | 50 parts by mass |
| Resin L3 as polyester resin (B) | 40 parts by mass |
| Magenta Toner Masterbatch 3 (MB-M3) | 20 parts by mass |
| De-free fatty acid carnauba wax (WA03, manufactured by TOAGOSEI CO., LTD.) | 3 parts by mass |
| Charge controlling agent (Aromatic Oxycarboxylic Acid Metal Compound 1 synthesized in Synthesis Example 7) | 1 part by mass |

[Yellow Toner Formulation 4]

| | |
|---|---|
| Resin H3 as polyester resin (A) | 50 parts by mass |
| Resin L3 as polyester resin (B) | 40 parts by mass |
| Yellow Toner Masterbatch 3 (MB-Y3) | 20 parts by mass |
| De-free fatty acid carnauba wax (WA03, manufactured by TOAGOSEI CO., LTD.) | 3 parts by mass |
| Charge controlling agent (Aromatic Oxycarboxylic Acid Metal Compound 1 synthesized in Synthesis Example 7) | 1 part by mass |

[Black Toner Formulation 4]

| | |
|---|---|
| Resin H3 as polyester resin (A) | 50 parts by mass |
| Resin L3 as polyester resin (B) | 42 parts by mass |
| Black Toner Masterbatch 3 (MB-K3) | 16 parts by mass |
| De-free fatty acid carnauba wax (WA03, manufactured by TOAGOSEI CO., LTD.) | 3 parts by mass |
| Charge controlling agent (Aromatic Oxycarboxylic Acid Metal Compound 1 synthesized in Synthesis Example 7) | 1 part by mass |

Example 5

-Preparation of Toner 5-

Toner 5 composed of Cyan Toner 5, Yellow Toner 5, Magenta Toner 5 and Black Toner 5 was prepared in the same manner as in Example 1 except that the respective toner formulations were changed to the following toner formulations.

[Cyan Toner Formulation 5]

| | |
|---|---|
| Resin H4 as polyester resin (A) | 50 parts by mass |
| Resin L4 as polyester resin (B) | 42 parts by mass |
| Cyan Toner Masterbatch 4 (MB-C4) | 16 parts by mass |
| De-free fatty acid carnauba wax (WA03, manufactured by TOAGOSEI CO., LTD.) | 3 parts by mass |
| Charge controlling agent (Aromatic Oxycarboxylic Acid Metal Compound 1 synthesized in Synthesis Example 7) | 1 part by mass |

[Magenta Toner Formulation 5]

| | |
|---|---|
| Resin H4 as polyester resin (A) | 50 parts by mass |
| Resin L4 as polyester resin (B) | 50 parts by mass |
| Magenta Toner Masterbatch 4 (MB-M4) | 20 parts by mass |
| De-free fatty acid carnauba wax (WA03, manufactured by TOAGOSEI CO., LTD.) | 3 parts by mass |
| Charge controlling agent (Aromatic Oxycarboxylic Acid Metal Compound 1 synthesized in Synthesis Example 7) | 1 part by mass |

[Yellow Toner Formulation 5]

| | |
|---|---|
| Resin H4 as polyester resin (A) | 50 parts by mass |
| Resin L4 as polyester resin (B) | 40 parts by mass |
| Yellow Toner Masterbatch 4 (MB-Y4) | 20 parts by mass |
| De-free fatty acid carnauba wax (WA03, manufactured by TOAGOSEI CO., LTD.) | 3 parts by mass |
| Charge controlling agent (Aromatic Oxycarboxylic Acid Metal Compound 1 synthesized in Synthesis Example 7) | 1 part by mass |

[Black Toner Formulation 5]

| | |
|---|---|
| Resin H4 as polyester resin (A) | 50 parts by mass |
| Resin L4 as polyester resin (B) | 42 parts by mass |
| Black Toner Masterbatch 4 (MB-K4) | 16 parts by mass |
| De-free fatty acid carnauba wax (WA03, manufactured by TOAGOSEI CO., LTD.) | 3 parts by mass |
| Charge controlling agent (Aromatic Oxycarboxylic Acid Metal Compound 1 synthesized in Synthesis Example 7) | 1 part by mass |

Example 6

-Preparation of Toner 6-

Toner 6 composed of Cyan Toner 6, Yellow Toner 6, Magenta Toner 6 and Black Toner 6 was prepared in the same manner as in Example 1 except that the respective toner formulations were changed to the following toner formulations.

[Cyan Toner Formulation 6]

| | |
|---|---|
| Resin H1 as polyester resin (A) | 50 parts by mass |
| Resin L1 as polyester resin (B) | 42 parts by mass |
| Cyan Toner Masterbatch 1 (MB-C1) | 16 parts by mass |
| De-free fatty acid carnauba wax (WA03, manufactured by TOAGOSEI CO., LTD.) | 3 parts by mass |
| Charge controlling agent (Aromatic Oxycarboxylic Acid Metal Compound 1 synthesized in Synthesis Example 7) | 1 part by mass |

[Magenta Toner Formulation 6]

| | |
|---|---|
| Resin H1 as polyester resin (A) | 50 parts by mass |
| Resin L1 as polyester resin (B) | 40 parts by mass |
| Magenta Toner Masterbatch 1 (MB-M1) | 20 parts by mass |
| De-free fatty acid carnauba wax (WA03, manufactured by TOAGOSEI CO., LTD.) | 3 parts by mass |

-continued

| | |
|---|---|
| Charge controlling agent (Aromatic Oxycarboxylic Acid Metal Compound 1 synthesized in Synthesis Example 7) | 1 part by mass |

[Yellow Toner Formulation 6]

| | |
|---|---|
| Resin H1 as polyester resin (A) | 50 parts by mass |
| Resin L1 as polyester resin (B) | 40 parts by mass |
| Yellow Toner Masterbatch 1 (MB-Y1) | 20 parts by mass |
| De-free fatty acid carnauba wax (WA03, manufactured by TOAGOSEI CO., LTD.) | 3 parts by mass |
| Charge controlling agent (Aromatic Oxycarboxylic Acid Metal Compound 1 synthesized in Synthesis Example 7) | 1 part by mass |

[Black Toner Formulation 6]

| | |
|---|---|
| Resin H1 as polyester resin (A) | 50 parts by mass |
| Resin L1 as polyester resin (B) | 42 parts by mass |
| Black Toner Masterbatch 1 (MB-K1) | 16 parts by mass |
| De-free fatty acid carnauba wax (WA03, manufactured by TOAGOSEI CO., LTD.) | 3 parts by mass |
| Charge controlling agent (Aromatic Oxycarboxylic Acid Metal Compound 1 synthesized in Synthesis Example 7) | 1 part by mass |

Example 7

-Preparation of Toner 7-

Toner 7 composed of Cyan Toner 7, Yellow Toner 7, Magenta Toner 7 and Black Toner 7 was prepared in the same manner as in Example 1 except that the respective toner formulations were changed to the following toner formulations.

[Cyan Toner Formulation 7]

| | |
|---|---|
| Resin H1 as polyester resin (A) | 50 parts by mass |
| Resin L1 as polyester resin (B) | 42 parts by mass |
| Cyan Toner Masterbatch 1 (MB-C1) | 16 parts by mass |
| De-free fatty acid carnauba wax (WA03, manufactured by TOAGOSEI CO., LTD.) | 3 parts by mass |
| Charge controlling agent (Aromatic Oxycarboxylic Acid Metal Compound 2 synthesized in Synthesis Example 8) | 1 part by mass |

[Magenta Toner Formulation 7]

| | |
|---|---|
| Resin H1 as polyester resin (A) | 50 parts by mass |
| Resin L1 as polyester resin (B) | 40 parts by mass |
| Magenta Toner Masterbatch 1 (MB-M1) | 20 parts by mass |
| De-free fatty acid carnauba wax (WA03, manufactured by TOAGOSEI CO., LTD.) | 3 parts by mass |
| Charge controlling agent (Aromatic Oxycarboxylic Acid Metal Compound 2 synthesized in Synthesis Example 8) | 1 part by mass |

[Yellow Toner Formulation 7]

| | |
|---|---|
| Resin H1 as polyester resin (A) | 50 parts by mass |
| Resin L1 as polyester resin (B) | 40 parts by mass |
| Yellow Toner Masterbatch 1 (MB-Y1) | 20 parts by mass |
| De-free fatty acid carnauba wax (WA03, manufactured by TOAGOSEI CO., LTD.) | 3 parts by mass |
| Charge controlling agent (Aromatic Oxycarboxylic Acid Metal Compound 2 synthesized in Synthesis Example 8) | 1 part by mass |

[Black Toner Formulation 7]

| | |
|---|---|
| Resin H1 as polyester resin (A) | 50 parts by mass |
| Resin L1 as polyester resin (B) | 42 parts by mass |
| Black Toner Masterbatch 1 (MB-K1) | 16 parts by mass |
| De-free fatty acid carnauba wax (WA03, manufactured by TOAGOSEI CO., LTD.) | 3 parts by mass |

-continued

| | |
|---|---|
| Charge controlling agent (Aromatic Oxycarboxylic Acid Metal Compound 2 synthesized in Synthesis Example 8) | 1 part by mass |

Example 8

-Preparation of Toner 8-

Toner 8 composed of Cyan Toner 8, Yellow Toner 8, Magenta Toner 8 and Black Toner 8 was prepared in the same manner as in Example 1 except that the respective toner formulations were changed to the following toner formulations.

[Cyan Toner Formulation 8]

| | |
|---|---|
| Resin H1 as polyester resin (A) | 50 parts by mass |
| Resin L1 as polyester resin (B) | 42 parts by mass |
| Cyan Toner Masterbatch 1 (MB-C1) | 16 parts by mass |
| De-free fatty acid carnauba wax (WA03, manufactured by TOAGOSEI CO., LTD.) | 3 parts by mass |
| Charge controlling agent (Aromatic Oxycarboxylic Acid Metal Compound 3 synthesized in Synthesis Example 9) | 1 part by mass |

[Magenta Toner Formulation 8]

| | |
|---|---|
| Resin H1 as polyester resin (A) | 50 parts by mass |
| Resin L1 as polyester resin (B) | 40 parts by mass |
| Magenta Toner Masterbatch 1 (MB-M1) | 20 parts by mass |
| De-free fatty acid carnauba wax (WA03, manufactured by TOAGOSEI CO., LTD.) | 3 parts by mass |
| Charge controlling agent (Aromatic Oxycarboxylic Acid Metal Compound 3 synthesized in Synthesis Example 9) | 1 part by mass |

[Yellow Toner Formulation 8]

| | |
|---|---|
| Resin H1 as polyester resin (A) | 50 parts by mass |
| Resin L1 as polyester resin (B) | 40 parts by mass |
| Yellow Toner Masterbatch 1 (MB-Y1) | 20 parts by mass |
| De-free fatty acid carnauba wax (WA03, manufactured by TOAGOSEI CO., LTD.) | 3 parts by mass |
| Charge controlling agent (Aromatic Oxycarboxylic Acid Metal Compound 3 synthesized in Synthesis Example 9) | 1 part by mass |

[Black Toner Formulation 8]

| | |
|---|---|
| Resin H1 as polyester resin (A) | 50 parts by mass |
| Resin L1 as polyester resin (B) | 42 parts by mass |
| Black Toner Masterbatch 1 (MB-K1) | 16 parts by mass |
| De-free fatty acid carnauba wax (WA03, manufactured by TOAGOSEI CO., LTD.) | 3 parts by mass |
| Charge controlling agent (Aromatic Oxycarboxylic Acid Metal Compound 3 synthesized in Synthesis Example 9) | 1 part by mass |

Comparative Example 1

-Preparation of Toner 9-

Toner 9 composed of Cyan Toner 9, Yellow Toner 9, Magenta Toner 9 and Black Toner 9 was prepared in the same manner as in Example 1 except that the respective toner formulations were changed to the following toner formulations.

| [Cyan Toner Formulation 9] | |
|---|---|
| Resin H6 as polyester resin (A) | 50 parts by mass |
| Resin L5 as polyester resin (B) | 42 parts by mass |
| Cyan Toner Masterbatch 5 (MB-C5) | 16 parts by mass |
| De-free fatty acid carnauba wax (WA03, manufactured by TOAGOSEI CO., LTD.) | 3 parts by mass |
| Charge controlling agent (Aromatic Oxycarboxylic Acid Metal Compound 1 synthesized in Synthesis Example 7) | 1 part by mass |

| [Magenta Toner Formulation 9] | |
|---|---|
| Resin H6 as polyester resin (A) | 50 parts by mass |
| Resin L5 as polyester resin (B) | 40 parts by mass |
| Magenta Toner Masterbatch 5 (MB-M5) | 20 parts by mass |
| De-free fatty acid carnauba wax (WA03, manufactured by TOAGOSEI CO., LTD.) | 3 parts by mass |
| Charge controlling agent (Aromatic Oxycarboxylic Acid Metal Compound 1 synthesized in Synthesis Example 7) | 1 part by mass |

| [Yellow Toner Formulation 9] | |
|---|---|
| Resin H6 as polyester resin (A) | 50 parts by mass |
| Resin L5 as polyester resin (B) | 40 parts by mass |
| Yellow Toner Masterbatch 5 (MB-Y5) | 20 parts by mass |
| De-free fatty acid carnauba wax (WA03, manufactured by TOAGOSEI CO., LTD.) | 3 parts by mass |
| Charge controlling agent (Aromatic Oxycarboxylic Acid Metal Compound 1 synthesized in Synthesis Example 7) | 1 part by mass |

| [Black Toner Formulation 9] | |
|---|---|
| Resin H6 as polyester resin (A) | 50 parts by mass |
| Resin L5 as polyester resin (B) | 42 parts by mass |
| Black Toner Masterbatch 5 (MB-K5) | 16 parts by mass |
| De-free fatty acid carnauba wax (WA03, manufactured by TOAGOSEI CO., LTD.) | 3 parts by mass |
| Charge controlling agent (Aromatic Oxycarboxylic Acid Metal Compound 1 synthesized in Synthesis Example 7) | 1 part by mass |

Comparative Example 2

-Preparation of Toner 10-

Toner 10 composed of Cyan Toner 10, Yellow Toner 10, Magenta Toner 10 and Black Toner 10 was prepared in the same manner as in Example 1 except that the respective toner formulations were changed to the following toner formulations.

| [Cyan Toner Formulation 10] | |
|---|---|
| Resin H2 as polyester resin (A) | 50 parts by mass |
| Resin L5 as polyester resin (B) | 42 parts by mass |
| Cyan Toner Masterbatch 5 (MB-C5) | 16 parts by mass |
| De-free fatty acid carnauba wax (WA03, manufactured by TOAGOSEI CO., LTD.) | 3 parts by mass |

| [Magenta Toner Formulation 10] | |
|---|---|
| Resin H2 as polyester resin (A) | 50 parts by mass |
| Resin L5 as polyester resin (B) | 40 parts by mass |
| Magenta Toner Masterbatch 5 (MB-M5) | 20 parts by mass |
| De-free fatty acid carnauba wax (WA03, manufactured by TOAGOSEI CO., LTD.) | 3 parts by mass |

| [Yellow Toner Formulation 10] | |
|---|---|
| Resin H2 as polyester resin (A) | 50 parts by mass |
| Resin L5 as polyester resin (B) | 40 parts by mass |
| Yellow Toner Masterbatch 5 (MB-Y5) | 20 parts by mass |
| De-free fatty acid carnauba wax (WA03, manufactured by TOAGOSEI CO., LTD.) | 3 parts by mass |

-continued

| [Black Toner Formulation 10] | |
|---|---|
| Resin H2 as polyester resin (A) | 50 parts by mass |
| Resin L5 as polyester resin (B) | 42 parts by mass |
| Black Toner Masterbatch 5 (MB-K5) | 16 parts by mass |
| De-free fatty acid carnauba wax (WA03, manufactured by TOAGOSEI CO., LTD.) | 3 parts by mass |

Comparative Example 3

-Preparation of Toner 11-

Toner 11 composed of Cyan Toner 11, Yellow Toner 11, Magenta Toner 11 and Black Toner 11 was prepared in the same manner as in Example 1 except that the respective toner formulations were changed to the following toner formulations.

| [Cyan Toner Formulation 11] | |
|---|---|
| Resin H1 as polyester resin (A) | 50 parts by mass |
| Resin L1 as polyester resin (B) | 42 parts by mass |
| Cyan Toner Masterbatch 1 (MB-C1) | 16 parts by mass |
| De-free fatty acid carnauba wax (WA03, manufactured by TOAGOSEI CO., LTD.) | 3 parts by mass |

| [Magenta Toner Formulation 11] | |
|---|---|
| Resin H1 as polyester resin (A) | 50 parts by mass |
| Resin L1 as polyester resin (B) | 40 parts by mass |
| Magenta Toner Masterbatch 1 (MB-M1) | 20 parts by mass |
| De-free fatty acid carnauba wax (WA03, manufactured by TOAGOSEI CO., LTD.) | 3 parts by mass |

| [Yellow Toner Formulation 11] | |
|---|---|
| Resin H1 as polyester resin (A) | 50 parts by mass |
| Resin L1 as polyester resin (B) | 40 parts by mass |
| Yellow Toner Masterbatch 1 (MB-Y1) | 20 parts by mass |
| De-free fatty acid carnauba wax (WA03, manufactured by TOAGOSEI CO., LTD.) | 3 parts by mass |

| [Black Toner Formulation 11] | |
|---|---|
| Resin H1 as polyester resin (A) | 50 parts by mass |
| Resin L1 as polyester resin (B) | 42 parts by mass |
| Black Toner Masterbatch 1 (MB-K1) | 16 parts by mass |
| De-free fatty acid carnauba wax (WA03, manufactured by TOAGOSEI CO., LTD.) | 3 parts by mass |

Comparative Example 4

-Preparation of Toner 12-

Toner 12 composed of Cyan Toner 12, Yellow Toner 12, Magenta Toner 12 and Black Toner 12 was prepared in the same manner as in Example 1 except that the respective toner formulations were changed to the following toner formulations.

| [Cyan Toner Formulation 12] | |
|---|---|
| Resin H2 as polyester resin (A) | 50 parts by mass |
| Resin L5 as polyester resin (B) | 42 parts by mass |
| Cyan Toner Masterbatch 5 (MB-C5) | 16 parts by mass |
| De-free fatty acid carnauba wax (WA03, manufactured by TOAGOSEI CO., LTD.) | 3 parts by mass |
| Charge controlling agent (3,5-di-t-butyl zinc (II) salicylate compound (BONTRON E-84, manufactured by Orient Chemical Industries, Ltd.) | 1 part by mass |

-continued

[Magenta Toner Formulation 12]

| | |
|---|---|
| Resin H2 as polyester resin (A) | 50 parts by mass |
| Resin L5 as polyester resin (B) | 40 parts by mass |
| Magenta Toner Masterbatch 5 (MB-M5) | 20 parts by mass |
| De-free fatty acid carnauba wax (WA03, manufactured by TOAGOSEI CO., LTD.) | 3 parts by mass |
| Charge controlling agent (3,5-di-t-butyl zinc (II) salicylate compound (BONTRON E-84, manufactured by Orient Chemical Industries, Ltd.) | 1 part by mass |

[Yellow Toner Formulation 12]

| | |
|---|---|
| Resin H2 as polyester resin (A) | 50 parts by mass |
| Resin L5 as polyester resin (B) | 40 parts by mass |
| Yellow Toner Masterbatch 5 (MB-Y5) | 20 parts by mass |
| De-free fatty acid carnauba wax (WA03, manufactured by TOAGOSEI CO., LTD.) | 3 parts by mass |
| Charge controlling agent (3,5-di-t-butyl zinc (II) salicylate compound (BONTRON E-84, manufactured by Orient Chemical Industries, Ltd.) | 1 part by mass |

[Black Toner Formulation 12]

| | |
|---|---|
| Resin H2 as polyester resin (A) | 50 parts by mass |
| Resin L5 as polyester resin (B) | 42 parts by mass |
| Black Toner Masterbatch 5 (MB-K5) | 16 parts by mass |
| De-free fatty acid carnauba wax (WA03, manufactured by TOAGOSEI CO., LTD.) | 3 parts by mass |
| Charge controlling agent (3,5-di-t-butyl zinc (II) salicylate compound (BONTRON E-84, manufactured by Orient Chemical Industries, Ltd.) | 1 part by mass |

Comparative Example 5

-Preparation of Toner 13-

Toner 13 composed of Cyan Toner 13, Yellow Toner 13, Magenta Toner 13 and Black Toner 13 was prepared in the same manner as in Example 1 except that the respective toner formulations were changed to the following toner formulations

[Cyan Toner Formulation 13]

| | |
|---|---|
| Resin H1 as polyester resin (A) | 50 parts by mass |
| Resin L1 as polyester resin (B) | 42 parts by mass |
| Cyan Toner Masterbatch 1 (MB-C1) | 16 parts by mass |
| De-free fatty acid carnauba wax (WA03, manufactured by TOAGOSEI CO., LTD.) | 3 parts by mass |
| Charge controlling agent (3,5-di-t-butyl zinc (II) salicylate compound (BONTRON E-84, manufactured by Orient Chemical Industries, Ltd.) | 1 part by mass |

[Magenta Toner Formulation 13]

| | |
|---|---|
| Resin H1 as polyester resin (A) | 50 parts by mass |
| Resin L1 as polyester resin (B) | 40 parts by mass |
| Magenta Toner Masterbatch 1 (MB-M1) | 20 parts by mass |
| De-free fatty acid carnauba wax (WA03, manufactured by TOAGOSEI CO., LTD.) | 3 parts by mass |
| Charge controlling agent (3,5-di-t-butyl zinc (II) salicylate compound (BONTRON E-84, manufactured by Orient Chemical Industries, Ltd.) | 1 part by mass |

[Yellow Toner Formulation 13]

| | |
|---|---|
| Resin H1 as polyester resin (A) | 50 parts by mass |
| Resin L1 as polyester resin (B) | 40 parts by mass |
| Yellow Toner Masterbatch 1 (MB-Y1) | 20 parts by mass |
| De-free fatty acid carnauba wax (WA03, manufactured by TOAGOSEI CO., LTD.) | 3 parts by mass |
| Charge controlling agent (3,5-di-t-butyl zinc (II) salicylate compound (BONTRON E-84, manufactured by Orient Chemical Industries, Ltd.) | 1 part by mass |

-continued

[Black Toner Formulation 13]

| | |
|---|---|
| Resin H1 as polyester resin (A) | 50 parts by mass |
| Resin L1 as polyester resin (B) | 42 parts by mass |
| Black Toner Masterbatch 1 (MB-K1) | 16 parts by mass |
| De-free fatty acid carnauba wax (WA03, manufactured by TOAGOSEI CO., LTD.) | 3 parts by mass |
| Charge controlling agent (3,5-di-t-butyl zinc (II) salicylate compound (BONTRON E-84, manufactured by Orient Chemical Industries, Ltd.) | 1 part by mass |

Comparative Example 6

-Preparation of Toner 14-

Toner 14 composed of Cyan Toner 14, Yellow Toner 14, Magenta Toner 14 and Black Toner 14 was prepared in the same manner as in Example 1 except that the respective toner formulations were changed to the following toner formulations.

[Cyan Toner Formulation 14]

| | |
|---|---|
| Resin H5 as polyester resin (A) | 50 parts by mass |
| Resin L2 as polyester resin (B) | 42 parts by mass |
| Cyan Toner Masterbatch 2 (MB-C2) | 16 parts by mass |
| De-free fatty acid carnauba wax (WA03, manufactured by TOAGOSEI CO., LTD.) | 3 parts by mass |
| Charge controlling agent (Aromatic Oxycarboxylic Acid Metal Compound 1 synthesized in Synthesis Example 7) | 1 part by mass |

[Magenta Toner Formulation 14]

| | |
|---|---|
| Resin H5 as polyester resin (A) | 50 parts by mass |
| Resin L2 as polyester resin (B) | 40 parts by mass |
| Magenta Toner Masterbatch 2 (MB-M2) | 20 parts by mass |
| De-free fatty acid carnauba wax (WA03, manufactured by TOAGOSEI CO., LTD.) | 3 parts by mass |
| Charge controlling agent (Aromatic Oxycarboxylic Acid Metal Compound 1 synthesized in Synthesis Example 7) | 1 part by mass |

[Yellow Toner Formulation 14]

| | |
|---|---|
| Resin H5 as polyester resin (A) | 50 parts by mass |
| Resin L2 as polyester resin (B) | 40 parts by mass |
| Yellow Toner Masterbatch 2 (MB-Y2) | 20 parts by mass |
| De-free fatty acid carnauba wax (WA03, manufactured by TOAGOSEI CO., LTD.) | 3 parts by mass |
| Charge controlling agent (Aromatic Oxycarboxylic Acid Metal Compound 1 synthesized in Synthesis Example 7) | 1 part by mass |

[Black Toner Formulation 14]

| | |
|---|---|
| Resin H5 as polyester resin (A) | 50 parts by mass |
| Resin L2 as polyester resin (B) | 42 parts by mass |
| Black Toner Masterbatch 2 (MB-K2) | 16 parts by mass |
| De-free fatty acid carnauba wax (WA03, manufactured by TOAGOSEI CO., LTD.) | 3 parts by mass |
| Charge controlling agent (Aromatic Oxycarboxylic Acid Metal Compound 1 synthesized in Synthesis Example 7) | 1 part by mass |

Comparative Example 7

-Preparation of Toner 15-

Toner 15 composed of Cyan Toner 15, Yellow Toner 15, Magenta Toner 15 and Black Toner 15 was prepared in the same manner as in Example 1 except that the respective toner formulations were changed to the following toner formulations.

[Cyan Toner Formulation 15]

| | |
|---|---|
| Resin H7 as polyester resin (A) | 50 parts by mass |
| Resin L6 as polyester resin (B) | 42 parts by mass |
| Cyan Toner Masterbatch 6 (MB-C6) | 16 parts by mass |
| De-free fatty acid carnauba wax (WA03, manufactured by TOAGOSEI CO., LTD.) | 3 parts by mass |
| Charge controlling agent (Aromatic Oxycarboxylic Acid Metal Compound 1 synthesized in Synthesis Example 7) | 1 part by mass |

[Magenta Toner Formulation 15]

| | |
|---|---|
| Resin H7 as polyester resin (A) | 50 parts by mass |
| Resin L6 as polyester resin (B) | 40 parts by mass |
| Magenta Toner Masterbatch 6 (MB-M6) | 20 parts by mass |
| De-free fatty acid carnauba wax (WA03, manufactured by TOAGOSEI CO., LTD.) | 3 parts by mass |
| Charge controlling agent (Aromatic Oxycarboxylic Acid Metal Compound 1 synthesized in Synthesis Example 7) | 1 part by mass |

[Yellow Toner Formulation 15]

| | |
|---|---|
| Resin H7 as polyester resin (A) | 50 parts by mass |
| Resin L6 as polyester resin (B) | 40 parts by mass |
| Yellow Toner Masterbatch 6 (MB-Y6) | 20 parts by mass |
| De-free fatty acid carnauba wax (WA03, manufactured by TOAGOSEI CO., LTD.) | 3 parts by mass |
| Charge controlling agent (Aromatic Oxycarboxylic Acid Metal Compound 1 synthesized in Synthesis Example 7) | 1 part by mass |

[Black Toner Formulation 15]

| | |
|---|---|
| Resin H7 as polyester resin (A) | 50 parts by mass |
| Resin L6 as polyester resin (B) | 42 parts by mass |
| Black Toner Masterbatch 6 (MB-K6) | 16 parts by mass |
| De-free fatty acid carnauba wax (WA03, manufactured by TOAGOSEI CO., LTD.) | 3 parts by mass |
| Charge controlling agent (Aromatic Oxycarboxylic Acid Metal Compound 1 synthesized in Synthesis Example 7) | 1 part by mass |

Comparative Example 8

-Preparation of Toner 16-

Toner 16 composed of Cyan Toner 16, Yellow Toner 16, Magenta Toner 16 and Black Toner 16 was prepared in the same manner as in Example 1 except that the respective toner formulations were changed to the following toner formulations.

[Cyan Toner Formulation 16]

| | |
|---|---|
| Resin H8 as polyester resin (A) | 50 parts by mass |
| Resin L5 as polyester resin (B) | 42 parts by mass |
| Cyan Toner Masterbatch 5 (MB-C5) | 16 parts by mass |
| De-free fatty acid carnauba wax (WA03, manufactured by TOAGOSEI CO., LTD.) | 3 parts by mass |
| Charge controlling agent (Aromatic Oxycarboxylic Acid Metal Compound 1 synthesized in Synthesis Example 7) | 1 part by mass |

[Magenta Toner Formulation 16]

| | |
|---|---|
| Resin H8 as polyester resin (A) | 50 parts by mass |
| Resin L5 as polyester resin (B) | 40 parts by mass |
| Magenta Toner Masterbatch 5 (MB-M5) | 20 parts by mass |
| De-free fatty acid carnauba wax (WA03, manufactured by TOAGOSEI CO., LTD.) | 3 parts by mass |
| Charge controlling agent (Aromatic Oxycarboxylic Acid Metal Compound 1 synthesized in Synthesis Example 7) | 1 part by mass |

-continued

[Yellow Toner Formulation 16]

| | |
|---|---|
| Resin H8 as polyester resin (A) | 50 parts by mass |
| Resin L5 as polyester resin (B) | 40 parts by mass |
| Yellow Toner Masterbatch 5 (MB-Y5) | 20 parts by mass |
| De-free fatty acid carnauba wax (WA03, manufactured by TOAGOSEI CO., LTD.) | 3 parts by mass |
| Charge controlling agent (Aromatic Oxycarboxylic Acid Metal Compound 1 synthesized in Synthesis Example 7) | 1 part by mass |

[Black Toner Formulation 16]

| | |
|---|---|
| Resin H8 as polyester resin (A) | 50 parts by mass |
| Resin L5 as polyester resin (B) | 42 parts by mass |
| Black Toner Masterbatch 5 (MB-K5) | 16 parts by mass |
| De-free fatty acid carnauba wax (WA03, manufactured by TOAGOSEI CO., LTD.) | 3 parts by mass |
| Charge controlling agent (Aromatic Oxycarboxylic Acid Metal Compound 1 synthesized in Synthesis Example 7) | 1 part by mass |

Next, the weight average particle diameter ($D_4$) of the obtained Toner 1 to Toner 16 prepared in Examples 1 to 8 and Comparative Examples 1 to 8 was measured as follows. Further, a difference in softening point (ΔTm) between the used polyester resin (A) and the used polyester resin (B), i.e., a difference between Tm (A) and Tm (B), was determined. Tables 5-A, 5-B, 6-A and 6-B show the measurement results.

<Weight Average Particle Diameter of Toner>

The weight average particle diameter ($D_4$) of each of the prepared toners was measured by using a particle sizer (MULTISIZER III, manufactured by Beckman Coulter Co.) with an aperture diameter of 100 μm, and each of the toners was analyzed using analysis software (Beckman COULTER MULTISIZER 3 Version 3.51). Specifically, to a 100-mL glass beaker, 0.5 mL of a 10% by mass surfactant (alkylbenzene sulfonate, NEOGEN SC-A, manufactured by Dai-ichi Kogyo Seiyaku Co., Ltd.) was added, the each of the obtained toners was added thereto, and the components were stirred with a microspatula. Next, 80 mL of ion exchange water was added thereto. The obtained dispersion liquid was dispersed using a ultrasonic dispersing device (W-113MK-II, manufactured by HONDA ELECTRONICS CO., LTD.) for 10 minutes. The weight average particle diameter of the dispersion liquid was determined using the MULTISIZER III. As a measurement solution, ISOTON III manufactured by Beckman Coulter Co. was used. In the measurement, the toner sample dispersion liquid was delivered by drops so that the concentration indicated by a measuring device was 8% by mass±2% by mass. It is important that the concentration of the toner sample dispersion liquid is set to 8% by mass±2% by mass from the perspective of measurement repeatability of particle diameter. When the concentration is within the range, the weight average particle diameter of the sample can be measured causing no measurement error.

For channels, the following 13 channels were used, and particles having a particle diameter of 2.00 μm to less than 40.30 μm were intended to be measured. A channel of 2.00 μm to less than 2.52 μm; a channel of 2.52 μm to less than 3.17 μm; a channel of 3.17 μm to less than 4.00 μm; a channel of 4.00 μm to less than 5.04 μm; a channel of 5.04 μm to less than 6.35 μm; a channel of 6.35 μm to less than 8.00 μm; a channel of 8.00 μm to less than 10.08 μm; a channel of 10.08 μm to less than 12.70 μm; a channel of 12.70 μm to less than 16.00 μm; a channel of 16.00 μm to less than 20.20 μm; a channel of 20.20 μm to less than 25.40 μm; a channel of 25.40 μm to less than 32.00 μm and a channel of 32.00 μm to less than 40.30 μm.

The weight of each of the toner samples was measured and the weight distribution was calculated. The weight average particle diameter ($D_4$) of the toner sample was determined from the obtained weight distribution.

TABLE 5-A

| | | | Formulation | | | | | Physical properties | |
|---|---|---|---|---|---|---|---|---|---|
| | Toner | | Polyester (A) | Polyester (B) | Masterbatch | Wax | Charge controlling agent | $D_4$ (μm) | ΔTm (° C.) |
| Ex. 1 | Toner 1 | Cyan | Resin H2 (50) | Resin L5 (42) | MB-C5 (16) | WA03 (3) | Compound 1 (1) | 6.2 | 59.1 |
| | | Magenta | Resin H2 (50) | Resin L5 (40) | MB-M5 (20) | WA03 (3) | Compound 1 (1) | 6.2 | |
| | | Yellow | Resin H2 (50) | Resin L5 (40) | MB-Y5 (20) | WA03 (3) | Compound 1 (1) | 6.2 | |
| | | Black | Resin H2 (50) | Resin L5 (42) | MB-K5 (16) | WA03 (3) | Compound 1 (1) | 6.1 | |
| Ex. 2 | Toner 2 | Cyan | Resin H6 (50) | Resin L2 (42) | MB-C2 (16) | WA03 (3) | Compound 1 (1) | 6.2 | 16.2 |
| | | Magenta | Resin H6 (50) | Resin L2 (40) | MB-M2 (20) | WA03 (3) | Compound 1 (1) | 6.2 | |
| | | Yellow | Resin H6 (50) | Resin L2 (40) | MB-Y2 (20) | WA03 (3) | Compound 1 (1) | 6.2 | |
| | | Black | Resin H6 (50) | Resin L2 (42) | MB-K2 (16) | WA03 (3) | Compound 1 (1) | 6.2 | |
| Ex. 3 | Toner 3 | Cyan | Resin H2 (50) | Resin L2 (42) | MB-C2 (16) | WA03 (3) | Compound 1 (1) | 6.1 | 40.0 |
| | | Magenta | Resin H2 (50) | Resin L2 (40) | MB-M2 (20) | WA03 (3) | Compound 1 (1) | 6.1 | |
| | | Yellow | Resin H2 (50) | Resin L2 (40) | MB-Y2 (20) | WA03 (3) | Compound 1 (1) | 6.2 | |
| | | Black | Resin H2 (50) | Resin L2 (42) | MB-K2 (16) | WA03 (3) | Compound 1 (1) | 6.2 | |
| Ex. 4 | Toner 4 | Cyan | Resin H3 (50) | Resin L3 (42) | MB-C3 (16) | WA03 (3) | Compound 1 (1) | 6.2 | 42.6 |
| | | Magenta | Resin H3 (50) | Resin L3 (40) | MB-M3 (20) | WA03 (3) | Compound 1 (1) | 6.3 | |
| | | Yellow | Resin H3 (50) | Resin L3 (40) | MB-Y3 (20) | WA03 (3) | Compound 1 (1) | 6.2 | |
| | | Black | Resin H3 (50) | Resin L3 (42) | MB-K3 (16) | WA03 (3) | Compound 1 (1) | 6.2 | |

* The value in brackets is part(s) by mass.

TABLE 5-B

| | | | Formulation | | | | | Physical properties | |
|---|---|---|---|---|---|---|---|---|---|
| | Toner | | Polyester (A) | Polyester (B) | Masterbatch | Wax | Charge controlling agent | $D_4$ (μm) | ΔTm (° C.) |
| Ex. 5 | Toner 5 | Cyan | Resin H4 (50) | Resin L4 (42) | MB-C4 (16) | WA03 (3) | Compound 1 (1) | 6.2 | 45.8 |
| | | Magenta | Resin H4 (50) | Resin L4 (40) | MB-M4 (20) | WA03 (3) | Compound 1 (1) | 6.2 | |
| | | Yellow | Resin H4 (50) | Resin L4 (40) | MB-Y4 (20) | WA03 (3) | Compound 1 (1) | 6.2 | |
| | | Black | Resin H4 (50) | Resin L4 (42) | MB-K4 (16) | WA03 (3) | Compound 1 (1) | 6.1 | |
| Ex. 6 | Toner 6 | Cyan | Resin H1 (50) | Resin L1 (42) | MB-C1 (16) | WA03 (3) | Compound 1 (1) | 6.2 | 37.5 |
| | | Magenta | Resin H1 (50) | Resin L1 (40) | MB-M1 (20) | WA03 (3) | Compound 1 (1) | 6.2 | |
| | | Yellow | Resin H1 (50) | Resin L1 (40) | MB-Y1 (20) | WA03 (3) | Compound 1 (1) | 6.2 | |
| | | Black | Resin H1 (50) | Resin L1 (42) | MB-K1 (16) | WA03 (3) | Compound 1 (1) | 6.2 | |
| Ex. 7 | Toner 7 | Cyan | Resin H1 (50) | Resin L1 (42) | MB-C1 (16) | WA03 (3) | Compound 2 (1) | 6.1 | 37.5 |
| | | Magenta | Resin H1 (50) | Resin L1 (40) | MB-M1 (20) | WA03 (3) | Compound 2 (1) | 6.3 | |
| | | Yellow | Resin H1 (50) | Resin L1 (40) | MB-Y1 (20) | WA03 (3) | Compound 2 (1) | 6.3 | |
| | | Black | Resin H1 (50) | Resin L1 (42) | MB-K1 (16) | WA03 (3) | Compound 2 (1) | 6.2 | |
| Ex. 8 | Toner 8 | Cyan | Resin H1 (50) | Resin L1 (42) | MB-C1 (16) | WA03 (3) | Compound 3 (1) | 6.3 | 37.5 |
| | | Magenta | Resin H1 (50) | Resin L1 (40) | MB-M1 (20) | WA03 (3) | Compound 3 (1) | 6.3 | |
| | | Yellow | Resin H1 (50) | Resin L1 (40) | MB-Y1 (20) | WA03 (3) | Compound 3 (1) | 6.2 | |
| | | Black | Resin H1 (50) | Resin L1 (42) | MB-K1 (16) | WA03 (3) | Compound 3 (1) | 6.2 | |

* The value in brackets is part(s) by mass.

TABLE 6-A

| | | | Formulation | | | | | Physical properties | |
|---|---|---|---|---|---|---|---|---|---|
| | Toner | | Polyester (A) | Polyester (B) | Masterbatch | Wax | Charge controlling agent | $D_4$ (μm) | ΔTm (° C.) |
| Compara. Ex. 1 | Toner 9 | Cyan | Resin H6 (50) | Resin L5 (42) | MB-C5 (16) | WA03 (3) | Compound 1 (1) | 6.2 | 35.3 |
| | | Magenta | Resin H6 (50) | Resin L5 (40) | MB-M5 (20) | WA03 (3) | Compound 1 (1) | 6.2 | |
| | | Yellow | Resin H6 (50) | Resin L5 (40) | MB-Y5 (20) | WA03 (3) | Compound 1 (1) | 6.2 | |
| | | Black | Resin H6 (50) | Resin L5 (42) | MB-K5 (16) | WA03 (3) | Compound 1 (1) | 6.2 | |
| Compara. Ex. 2 | Toner 10 | Cyan | Resin H2 (50) | Resin L5 (42) | MB-C5 (16) | WA03 (3) | Not used | 6.1 | 59.1 |
| | | Magenta | Resin H2 (50) | Resin L5 (40) | MB-M5 (20) | WA03 (3) | Not used | 6.2 | |
| | | Yellow | Resin H2 (50) | Resin L5 (40) | MB-Y5 (20) | WA03 (3) | Not used | 6.1 | |
| | | Black | Resin H2 (50) | Resin L5 (42) | MB-K5 (16) | WA03 (3) | Not used | 6.1 | |
| Compara. Ex. 3 | Toner 11 | Cyan | Resin H1 (50) | Resin L1 (42) | MB-C1 (16) | WA03 (3) | Not used | 6.2 | 37.5 |
| | | Magenta | Resin H1 (50) | Resin L1 (40) | MB-M1 (20) | WA03 (3) | Not used) | 6.2 | |

TABLE 6-A-continued

| | | | Formulation | | | | | Physical properties | |
|---|---|---|---|---|---|---|---|---|---|
| | | Toner | Polyester (A) | Polyester (B) | Masterbatch | Wax | Charge controlling agent | $D_4$ (μm) | ΔTm (° C.) |
| | | Yellow | Resin H1 (50) | Resin L1 (40) | MB-Y1 (20) | WA03 (3) | Not used | 6.2 | |
| | | Black | Resin H1 (50) | Resin L1 (42) | MB-K1 (16) | WA03 (3) | Not used | 6.2 | |
| Compara. | Toner | Cyan | Resin H2 (50) | Resin L5 (42) | MB-C5 (16) | WA03 (3) | E-84 (1) | 6.1 | 59.1 |
| Ex. 4 | 12 | Magenta | Resin H2 (50) | Resin L5 (40) | MB-M5 (20) | WA03 (3) | E-84 (1) | 6.2 | |
| | | Yellow | Resin H2 (50) | Resin L5 (40) | MB-Y5 (20) | WA03 (3) | E-84 (1) | 6.2 | |
| | | Black | Resin H2 (50) | Resin L5 (42) | MB-K5 (16) | WA03 (3) | E-84 (1) | 6.2 | |

* The value in brackets is part(s) by mass.

TABLE 6-B

| | | | Formulation | | | | | Physical properties | |
|---|---|---|---|---|---|---|---|---|---|
| | | Toner | Polyester (A) | Polyester (B) | Masterbatch | Wax | Charge controlling agent | $D_4$ (μm) | ΔTm (° C.) |
| Compara. | Toner | Cyan | Resin H1 (50) | Resin L1 (42) | MB-C1 (16) | WA03 (3) | E-84 (1) | 6.3 | 37.5 |
| Ex. 5 | 13 | Magenta | Resin H1 (50) | Resin L1 (40) | MB-M1 (20) | WA03 (3) | E-84 (1) | 6.1 | |
| | | Yellow | Resin H1 (50) | Resin L1 (40) | MB-Y1 (20) | WA03 (3) | E-84 (1) | 6.1 | |
| | | Black | Resin H1 (50) | Resin L1 (42) | MB-K1 (16) | WA03 (3) | E-84 (1) | 6.3 | |
| Compara. | Toner | Cyan | Resin H5 (50) | Resin L2 (42) | MB-C2 (16) | WA03 (3) | Compound 1 (1) | 6.2 | 32.0 |
| Ex. 6 | 14 | Magenta | Resin H5 (50) | Resin L2 (40) | MB-M2 (20) | WA03 (3) | Compound 1 (1) | 6.2 | |
| | | Yellow | Resin H5 (50) | Resin L2 (40) | MB-Y2 (20) | WA03 (3) | Compound 1 (1) | 6.2 | |
| | | Black | Resin H5 (50) | Resin L2 (42) | MB-K2 (16) | WA03 (3) | Compound 1 (1) | 6.3 | |
| Compara. | Toner | Cyan | Resin H7 (50) | Resin L6 (42) | MB-C6 (16) | WA03 (3) | Compound 1 (1) | 6.2 | 36.2 |
| Ex. 7 | 15 | Magenta | Resin H7 (50) | Resin L6 (40) | MB-M6 (20) | WA03 (3) | Compound 1 (1) | 6.2 | |
| | | Yellow | Resin H7 (50) | Resin L6 (40) | MB-Y6 (20) | WA03 (3) | Compound 1 (1) | 6.2 | |
| | | Black | Resin H7 (50) | Resin L6 (42) | MB-K6 (16) | WA03 (3) | Compound 1 (1) | 6.3 | |
| Compara. | Toner | Cyan | Resin H8 (50) | Resin L5 (42) | MB-C5 (16) | WA03 (3) | Compound 1 (1) | 6.2 | 38.8 |
| Ex. 8 | 16 | Magenta | Resin H8 (50) | Resin L5 (40) | MB-M5 (20) | WA03 (3) | Compound 1 (1) | 6.2 | |
| | | Yellow | Resin H8 (50) | Resin L5 (40) | MB-Y5 (20) | WA03 (3) | Compound 1 (1) | 6.2 | |
| | | Black | Resin H8 (50) | Resin L5 (42) | MB-K5 (16) | WA03 (3) | Compound 1 (1) | 6.3 | |

* The value in brackets is part(s) by mass.

-Preparation of Carrier A-

Carrier A to be used in a two-component developer was prepared as follows.

A coating material having the following composition was dispersed using a stirrer for 10 minutes to prepare a coating solution. The coating solution was poured to and 5,000 parts by mass of a core material (Mn ferrite particle, mass average particle diameter=35 μm) was placed in a coating device equipped with a rotatable bottom plate and stirring blades in a fluidized bed while forming a swirling flow, thereby coating the core material with the coating solution. The obtained coated material was baked in an electric furnace at 250° C. for 2 hours to thereby prepare Carrier A.

| [Composition of Coating Material] | |
|---|---|
| Toluene | 450 parts by mass |
| Silicone resin (SR2400, nonvolatile part: 50% by mass, manufactured by DOW CORNING TORAY SILICONE CO., LTD.) | 450 parts by mass |
| Aminosilane (SH6020, manufactured by DOW CORNING TORAY SILICONE CO., LTD.) | 10 parts by mass |
| Carbon black | 10 parts by mass |

-Evaluation of Toner Physical Properties-

Next, with respect to the Toner 1 to Toner 16 obtained in Examples 1 to 8 and Comparative Examples 1 to 8, the pulverizability, heat resistance/storage stability, charge rising property and chargeability at the time of deterioration of toner were evaluated. Table 7 shows the evaluation results.

-Measurement of Pulverizability-

Each of the melt-kneaded products shown in Tables 5-A, 5-B, 6-A and 6-B was coarsely crushed using a hammer mill so as to have particle diameters of 200 μm to 400 μm. The crushed product was weighed 10.00 g, pulverized in a mill mixer (MM-I, manufactured by Hitachi Living Systems Co.) for 30 seconds and filtered through a mesh of 30 in size (pore diameter: 500 μm). Mass (g) (A) of the resin that did not get through the mesh was weighed with accuracy, the residual ratio was determined from the following Expression (i), and the process was repeated three times. The results were averaged out, and the average residual ratio was regarded as an indicator of pulverizability of the toner. The pulverizability of the toner was evaluated based on the following evaluation criteria. The lower the average value of the residual ratio is, the more excellent in pulverizability the toner is.

$$\text{Residual ratio}=[(A)/\text{mass of unpulverized toner (10.00 g)}]\times 100 \qquad \text{Expression (i)}$$

[Evaluation Criteria]

A: The residual value was less than 5%.

B: The residual value was 5% to less than 10%.

C: The residual value was 10% to less than 15%.

D: The residual value was 15% to less than 20%.

E: The residual value was 20% or more.

<Heat Resistance/Storage Stability>

The heat resistance/storage stability of the toner was measured using a penetrator (manufactured by The Institute of Japanese Union of Scientists and Engineers Co., Ltd.). Specifically, each of the toners was weighed 10 g and placed in a 30-mL glass screw vial under the environmental conditions of 20° C. to 25° C. and relative humidity of 40% to 60%, and the lid of the vial was closed. The glass vial with the toner contained therein was tapped against the desk top 100 times and then left intact in a thermostatic chamber with the temperature set at 50° C. for 24 hours. Thereafter, the penetration of the toner was measured using the penetrator, and the heat resistance/storage stability of the toner was evaluated based on the following evaluation criteria. The larger penetration value is, the more excellent in heat resistance/storage stability the toner is.

[Evaluation Criteria]

A: The penetration value was 30 mm or more.
B: The penetration value was 20 mm to 29 mm.
C: The penetration value was 15 mm to 19 mm.
D: The penetration value was 8 mm to 14 mm.
E: The penetration value was 7 mm or less.

<Charge Rising Property>

In a 20-mL polyvinyl container, 0.6 g of each of the prepared toners and 9.4 g of the prepared Carrier A were placed and then stirred for 30 seconds using a tubular mixer (T2F, manufactured by Willy A. Bachofen AG) at 100 rpm to prepare a two-component developer. The charge amount (μC/g) of the obtained two-component developer was determined using "Q/M meter" (manufactured by Epping GmbH). The Q/M meter was set as follows: a stainless-steel mesh (the mesh size: 400), soft-blow pressure: 1,050 V, and suction time: 90 seconds. The charge amount was determined from the following Expression (ii). Under the above-noted conditions, the higher the charge amount the more excellent in charge rising property the toner is.

Charge amount (μC/g)=Total electrical quantity (μC/g) after the suction time for 90 seconds/Suctioned toner amount (g) Expression (ii)

[Evaluation Criteria]

A: The charge amount was 30 μC/g or more.
B: The charge amount was 22 μC/g to less than 30 μC/g.
C: The charge amount was 15 μC/g to less than 22 μC/g.
D: The charge amount was 8 μC/g to less than 15 μC/g.
E: The charge amount was less than 8 μC/g.

<Chargeability at the Time of Deterioration of Toner>

In a 20-mL polyvinyl container, 0.6 g of each of the prepared toners and 9.4 g of the prepared Carrier A were placed and then stirred for 90 minutes using a tubular mixer (T2F, manufactured by Willy A. Bachofen AG) at 100 rpm to prepare a two-component developer. The charge amount determined at this point in time was regarded as $Q_{90}$. The charge amount (μC/g) of the obtained two-component developer was determined using "Q/M meter" (manufactured by Epping GmbH). The Q/M meter was set as follows: a stainless-steel mesh (the mesh size: 400), soft-blow pressure: 1,050 V, and suction time: 90 seconds. The charge amount was determined from the above-noted Expression (ii). The charge amount of the two-component developer was determined in the same manner as the above-noted method except that the developer was stirred in the tabular mixer at 100 rpm for 10 minutes. The charge amount determined at this point in time was regarded as $Q_{90}$. As an indicator of chargeability at the time of deterioration of toner, a charge decrease rate at the time of deterioration of toner was determined from the following Expression (iii). The lower the charge decrease rate is, the higher charge stability can be obtained to deterioration of toner.

Charge decrease rate (%)=$Q_{90}$(μC/g)/$Q_{10}$(μC/g). Expression (iii)

[Evaluation Criteria]

A: The charge decrease rate was 90% or more.
B: The charge decrease rate was 80% to less than 90%.
C: The charge decrease rate was 65% to less than 80%.
D: The charge decrease rate was 45% to less than 65%.
E: The charge decrease rate was less than 45%.

TABLE 7

| | Toner | Pulverizability | Heat resistance/ storage stability | Charge rising property | Charge-ability at the time of deterioration of toner |
|---|---|---|---|---|---|
| Ex. 1 | Toner 1 | B | C | B | B |
| Ex. 2 | Toner 2 | B | C | B | B |
| Ex. 3 | Toner 3 | A | A | B | B |
| Ex. 4 | Toner 4 | A | B | B | B |
| Ex. 5 | Toner 5 | A | B | A | A |
| Ex. 6 | Toner 6 | A | A | B | B |
| Ex. 7 | Toner 7 | A | A | B | B |
| Ex. 8 | Toner 8 | A | A | A | A |
| Compara. Ex. 1 | Toner 9 | C | E | C | C |
| Compara. Ex. 2 | Toner 10 | B | B | E | E |
| Compara. Ex. 3 | Toner 11 | A | A | D | E |
| Compara. Ex. 4 | Toner 12 | B | B | D | D |
| Compara. Ex. 5 | Toner 13 | A | A | D | D |
| Compara. Ex. 6 | Toner 14 | B | E | C | C |
| Compara. Ex. 7 | Toner 15 | B | C | C | E |
| Compara. Ex. 8 | Toner 16 | C | E | B | D |

Examples 9 to 16 and Comparative Examples 9 to 16

-Image Formation and Evaluation-

Figure 20:
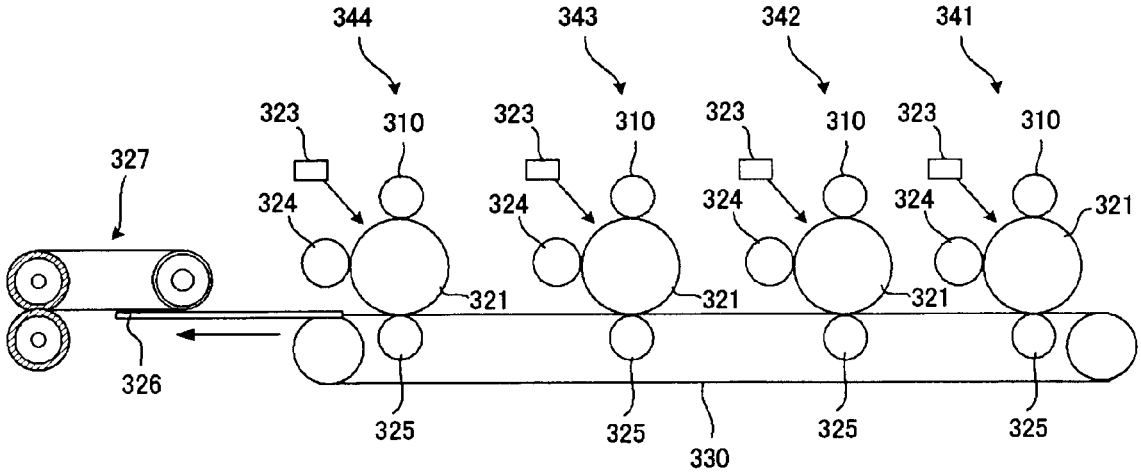
FIG. 20 is a schematic view showing the image forming apparatus (evaluation system A) used in the Examples of the present invention.

An image forming apparatus (evaluation system A) shown in FIG. 20 was filled with each of the prepared toners to carry out image formation. Various physical properties of each of the toners were evaluated as follows. Table 8 shows the evaluation results.

<Evaluation System A>

The image forming apparatus (evaluation system A) shown in FIG. 20 is a tandem type image forming apparatus based on direct transfer method, in which contact charging process, one-component developing process, direct transfer process, cleaner-less process and internal-heating belt fixing method are employed.

The image forming apparatus (evaluation system A) shown in FIG. 20 uses a contact type charging roller as the charging unit 310 as shown in FIG. 1 and uses a one-component developing device as the developing device 324 as shown in FIG. 5. In the developing device, cleaner-less process allowing for collecting a residual toner was employed. As the fixing unit 327, a belt fixing device as shown in FIG. 9 was used, and the fixing device uses a halogen lamp as heat source of the heating roller. In FIG. 20, a reference numeral 330 denotes a conveyance belt.

In an image forming section 341 in the image forming apparatus (evaluation system A) shown in FIG. 20, around a photoconductor drum 321, a charging unit 310, an exposing unit 323, a developing unit 324 and a transfer unit 325 are arranged. The photoconductor drum 321 in the image forming section 341 goes through a charging step by the charging unit 310 and an exposing step by the exposing unit 323 while rotating to form a latent electrostatic image corresponding to an exposed image on the surface thereof. The latent electrostatic image is developed using a yellow toner at the developing unit 324 to form a visible image of the yellow toner on the photoconductor drum 321. The yellow toner visible image is transferred onto a recording medium 326 by the transfer unit 325 and then a residual toner remaining on the photoconductor drum 321 is collected by the developing unit 324. Similarly to the yellow toner, by individual image forming sections 342, 343 and 344, visual images of magenta toner, cyan toner and black toner are superimposed on the recording medium 326, and a color image formed on the recording medium 326 is fixed by the fixing unit 327.

<Low-temperature Fixing Property>

Using the evaluation system A, a solid image with an toner adhesion amount of 0.85 mg/cm$^2$±0.1 mg/cm$^2$ was formed on a transfer sheet of heavy paper (copy paper <135>, manufactured by NBS Ricoh Co., Ltd.), and the image was fixed while changing the temperature of the fixing belt. On the surface of the obtained fixed image, the image was written using an image analysis equipment (AD-401, manufactured by Ueshima Seisakusho Co., Ltd.) equipped with a ruby needle (tip radius: 260 μmR to 320 μmR, tip angle: 60 degrees) under a load of 50g. The image surface was scrubbed strongly with a fiber (HANICOT #440, manufactured by Haniron K.K. 5 times. The temperature of the fixing belt at which there was little image exfoliation was determined as the fixing lower limit temperature to thereby evaluate the low-temperature fixing property based on the following criteria. The solid image was formed on the transfer sheet at a position of 3.0 cm from the edge in the paper-passing direction.

[Evaluation Criteria]

A: The fixing lower limit temperature was 125° C. or less.

B: The fixing lower limit temperature was 126° C. to 135° C.

C: The fixing lower limit temperature was 136° C. to 145° C.

D: The fixing lower limit temperature was 146° C. to 155° C.

E: The fixing lower limit temperature was 156° C. or more.

<Hot-offset Resistance>

Using the evaluation system A, a solid image with an toner adhesion amount of 0.85 mg/cm$^2$±0.1 mg/cm$^2$ was formed on a transfer sheet of regular paper (Type 6200, manufactured by Ricoh Co., Ltd.), and the image was fixed while changing the temperature of the fixing belt to thereby perform a fixing test. Presence or absence of hot-offset was visually checked. The upper limit temperature at which no hot-offset occurred was determined as the fixing upper limit temperature, and the hot-offset resistance was evaluated based on the following criteria. The solid image was formed on the transfer sheet at a position of 3.0 cm from the edge in the paper-passing direction.

[Evaluation Criteria]

A: The fixing upper limit temperature was 230° C. or more.

B: The fixing upper limit temperature was 210° C. to less than 230°.

C: The fixing upper limit temperature was 190° C. to less than 210°.

D: The fixing upper limit temperature was 180° C. to less than 190°.

E: The fixing upper limit temperature was less than 180° C.

<Initial Image>

The image quality of the toner in the initial stage was evaluated as follows. An image evaluation chart was output in full-color mode, and a change in color tone, background smear, image density and presence or absence of thinned image were evaluated. Presence or absence of abnormal image and the image quality were visually checked and ranked in the following five levels.

[Evaluation Criteria]

A: No abnormal image was observed, and the toner was excellent.

B: A slight difference in color tone (color tint), a slight change in image density and background smear were observed as compared to the original image, however, the toner was excellent and there would be no problem in practical use.

C: A slight change in color tone (color tint), a slight change in image density and background smear were observed.

D: A change in color tone (color tint), a change in image density and background smear were clearly observed, and there would cause problems in practical use.

E: A change in color tone (color tint), a change in image density and background smear were severe, and it was impossible to obtain a normal image.

<Temporal Stability>

After outputting an image chart with an image area of 80% (image area in each color: 20%) in full-color mode using the evaluation system A, the output image was evaluated in the same manner as in the evaluation of initial image and compared to the initial image, to thereby evaluate the temporal stability based on the following criteria.

[Evaluation Criteria]

A: No abnormal image was observed, and the toner was excellent.

B: As compared to the initial image, a slight difference in color tone (color tint), a slight change in image density and background smear were observed, however, the toner was on the level where there would be no problem under normal temperature and humidity environments.

C: As compared to the initial image, a slight change in color tone (color tint), a slight change in image density and background smear were observed.

D: As compared to the initial image, a change in color tone (color tint), a change in image density and background smear were clearly observed, and there would cause problems in practical use.

E: As compared to the initial image, a change in color tone (color tint), a change in image density and background smear were severe, and it was impossible to obtain a normal image.

Example 17

Figure 21:
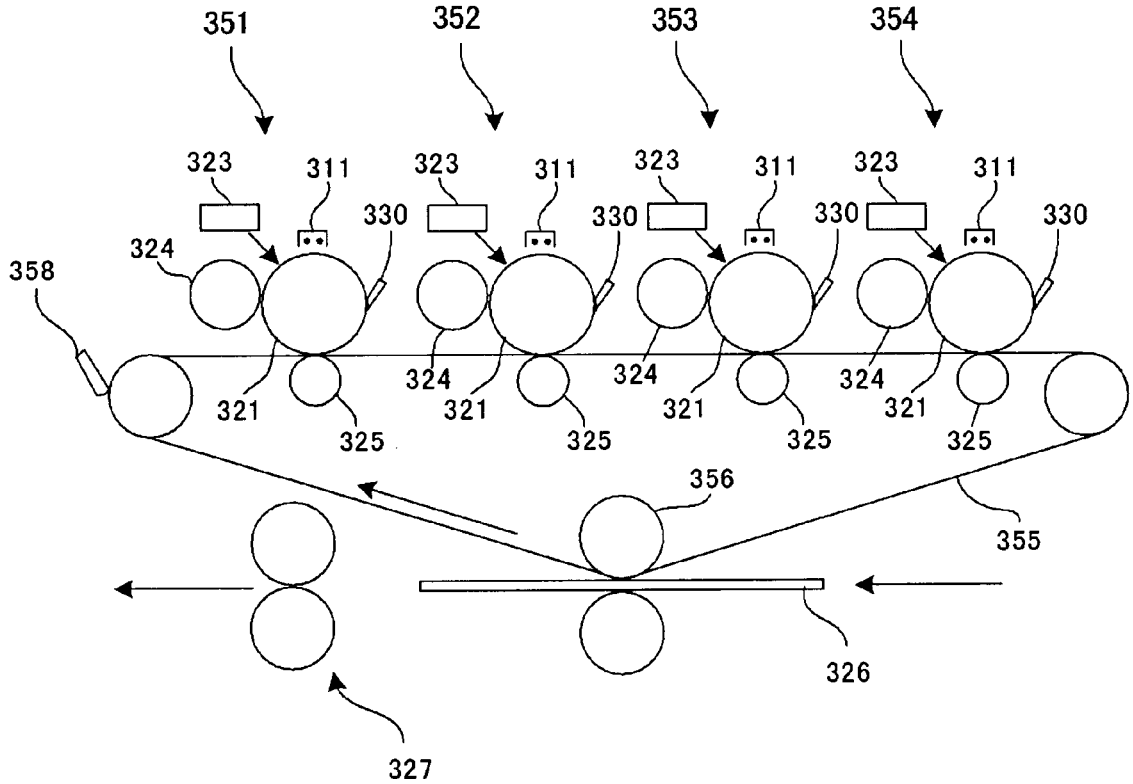
FIG. 21 is a schematic view showing the image forming apparatus (evaluation system B) used in the Examples of the present invention.

A two-component developer was prepared using Toner 8 in the following manner, and various physical properties of the toner were evaluated in the same manner as in Example 16 an image forming apparatus (evaluation system B) as shown in FIG. 21 explained below was used instead of the evaluation system A. Table 8 shows the evaluation results.

-Preparation of Two-Component Developer-

For a carrier used in the tow-component developer, the prepared carrier A stated above (ferrite carrier having an average particle diameter of 35 μm, which was coated with a silicone resin of 0.5 μm in average thickness) was used. Seven parts by mass of the each of the toners was used to 100 parts by mass of the carrier, and the toner and the carrier were placed in a tubular mixer (manufactured by Willy A. Bachofen AG) in which the vessel tumbled over for stirring the content therein to thereby uniformly mix the toner and the carrier at 48 rpm for 3 minutes and charge the two-component developer. In Example 17, 200g of the carrier A and 14g of each of the toner were placed in a 500-mL ointment bottle and mixed.

-Image Formation and Evaluation-

An image forming apparatus (evaluation system B) shown in FIG. 21 was filled with the thus prepared two-component developer to carry out image formation. Various physical properties of each of the toners were evaluated in the same manner as evaluated with the evaluation system A. Table 8 shows the evaluation criteria.

<Evaluation System B>

The image forming apparatus (evaluation system B) shown in FIG. 21 is a tandem type image forming apparatus based on indirect transfer method, in which non-contact charging process, one-component developing process, secondary transfer method, blade cleaning process and external-heating roller fixing method are employed.

The image forming apparatus (evaluation system B) shown in FIG. 21 uses a non-contact corona charger as the charging unit 311 as shown in FIG. 3 and uses a two-component developing device as the developing device 324 as shown in FIG. 6. As the cleaning unit 330, a cleaning blade as shown in FIG. 10 is used. As the fixing unit 327, a roller fixing device of electromagnetic induction heating type as shown in FIG. 12 was used.

using a yellow toner at the developing unit 324 to form a visible image of the yellow toner on the photoconductor drum 321. The yellow toner visible image is transferred to an intermediate transfer belt 355 by the primary transfer unit 325, and a residual yellow toner remaining on the photoconductor drum 321 is removed by the cleaning unit 330. Similarly to the yellow toner, by individual image forming sections 352, 353 and 354, visual images of magenta toner, cyan toner and black toner are superimposed on the intermediate transfer belt 355, a color image formed on the intermediate transfer belt is transferred onto a recording medium 326, and a toner remaining on the intermediate transfer belt 355 was removed by an intermediate transfer belt cleaning unit 358. The color image forming on the recording medium 326 is fixed by the fixing unit 327.

Comparative Example 17

-Image Formation and Evaluation-

A two-component developer was prepared using Toner 11 in the same manner as in Example 17, the image forming apparatus (evaluation system B) shown in FIG. 21 was filled with the two-component developer, and various physical properties of the toner were evaluated in the same manner as in Example 17. Table 8 shows the evaluation results.

TABLE 8

| | Toner | Evaluation system | Low-temperature fixing property | Hot-offset Resistance | Image quality at initial stage | Temporal stability |
|---|---|---|---|---|---|---|
| Ex. 9 | Toner 1 | A | A | B | B | B |
| Ex. 10 | Toner 2 | A | B | C | B | B |
| Ex. 11 | Toner 3 | A | B | A | A | B |
| Ex. 12 | Toner 4 | A | B | B | A | B |
| Ex. 13 | Toner 5 | A | B | B | A | B |
| Ex. 14 | Toner 6 | A | A | A | A | B |
| Ex. 15 | Toner 7 | A | A | A | A | B |
| Ex. 16 | Toner 8 | B | A | A | A | B |
| Ex. 17 | Toner 8 | B | A | A | A | A |
| Compara. Ex. 9 | Toner 9 | A | C | E | C | E |
| Compara. Ex. 10 | Toner 10 | A | A | B | B | E |
| Compara. Ex. 11 | Toner 11 | A | A | A | B | D |
| Compara. Ex. 12 | Toner 12 | A | A | B | B | E |
| Compara. Ex. 13 | Toner 13 | A | A | A | B | D |
| Compara. Ex. 14 | Toner 14 | A | B | E | C | E |
| Compara. Ex. 15 | Toner 15 | A | C | C | B | E |
| Compara. Ex. 16 | Toner 16 | A | B | E | B | D |
| Compara. Ex. 17 | Toner 11 | B | A | A | B | D |

In an image forming section 351 in the image forming apparatus (evaluation system B) shown in FIG. 21, around a photoconductor drum 321, a charging unit 311, an exposing unit 323, a developing unit 324, a primary transfer unit 325 and a cleaning unit 330 are arranged. The photoconductor drum 321 in the image forming section 351 goes through a charging step by the charging unit 310 and an exposing step by the exposing unit 323 while rotating to form a latent electrostatic image corresponding to an exposed image on the surface thereof. The latent electrostatic image is developed The toner of the present invention is excellent in all the properties of low-temperature fixing property, offset resistance, storage stability, charge rising property, charge stability with time and pulverizability and can be suitably used in electrophotographic image forming apparatuses, electrophotographic image forming methods, developers, toner containers and process cartridges.

Because the image forming apparatus, the image forming method and the process cartridge of the present invention respectively use the toner of the present invention and allow for forming extremely high-quality images over a long period of time without substantially causing a change in color tone and abnormal images such as reduction in image density and background smear, they can be widely used in, for example, laser printers, direct digital photoengraving machines, full-color copiers based on a direct or indirect electrophotographic multi-color image developing method, full-color laser printers and full-color regular paper facsimiles and the like.

What is claimed is:

1. A toner, comprising:

a binder resin, a colorant, and a charge controlling agent, wherein the charge controlling agent comprises an aromatic oxycarboxylic acid metal compound having a trivalent or more central metal, the binder resin comprises a polyester resin (A) having a softening point Tm (A) of 120° C. to 160° C. and a polyester resin (B) having a softening point Tm (B) of 80° C. to less than 120° C., and at least any one of the polyester resins (A) and (B) contains 1,2-propane diol at a content of 65 mol% or more in a divalent alcohol component and can be obtained by condensation polymerizing an alcohol component substantially composed of only an aliphatic alcohol with a carboxylic acid component.

2. The toner according to claim 1, wherein the aromatic oxycarboxylic acid metal compound is represented by the following General Formula (1), General Formula (1)

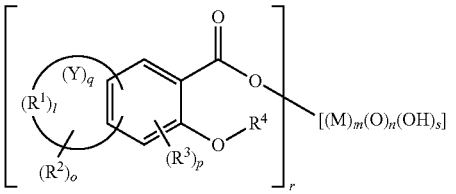

where, $R^1$ represents any one of a carbon atom, a methine group and a methylene group, the methine group and the methylene group may respectively contain a hetero atom selected from N, S and P; "Y" represents a ring structure linked by saturated bond(s) or unsaturated bond(s); $R^2$ and $R^3$ respectively represent a hydrogen atom, a halogen atom, a hydroxyl group, a nitro group, a nitroso group, a sulfonyl group, a cyano group, an alkyl group, alkenyl group, an alkoxy group, an aryl group, an aryloxy group, an aralkyl group, an aralkyloxy group, an amino group, a carboxyl group and a carbonyl group, and when "o" and "p" are respectively an integer of 1 or more, $R^2$ and $R^3$ may be the same to each other or different from each other, and $R^2$ and $R^3$ may be further substituted by a substituent group; $R^4$ represents any one of a hydrogen atom and an alkyl group; "1" is zero or an integer of 3 to 12; "m" is an integer of 1 to 20; "n" is zero or an integer of 1 to 20; "o" is zero or an integer of 1 to 4; "p" is zero or an integer of 1 to 4; "q" is zero or an integer of 1 to 3; "r" is an integer of 1 to 20; "s" is zero or an integer of 1 to 20; and "M" is a trivalent or more central metal.

3. The toner according to claim 1, wherein the central metal is iron.

4. The toner according to claim 1, wherein the central metal is zirconium.

5. The toner according to claim 1, wherein the content of the aliphatic alcohol in the alcohol component is 90 mol% or more.

6. The toner according to claim 1, wherein the alcohol component contained in at least any one of the polyester resins (A) and (B) further comprises glycerine.

7. The toner according to claim 1, wherein the alcohol component contained in the polyester resin (A) further comprises 1,3-propane diol.

8. The toner according to claim 1, wherein the carboxylic acid component contained in at least any one of the polyester resins (A) and (B) comprises an aliphatic dicarboxylic acid compound having 2 to 4 carbon atoms.

9. The toner according to claim 1, wherein the carboxylic acid component contained in at least any one of the polyester resins (A) and (B) comprises a purified rosin.

10. The toner according to claim 1, wherein the mass ratio of the polyester resin (A) to the polyester resin (B) [(A)/(B)] is 1/9 to 9/1.

11. The toner according to claim 1, wherein the difference in softening point (Tm) between the polyester resin (A) and the polyester resin (B) [Tm (A)−Tm (B)] is 10° C. or more.

12. An image forming apparatus, comprising:

a latent electrostatic image bearing member, a charging unit configured to charge the surface of the latent electrostatic image bearing member, an exposing unit configured to expose the charged surface of the latent electrostatic image bearing member to form a latent electrostatic image, a developing unit configured to develop the latent electrostatic image using a toner to form a visible image, a transfer unit configured to transfer the visible image onto a recording medium, and a fixing unit configured to fix the transferred image on the recording medium, wherein the toner comprises a binder resin, a colorant and a charge controlling agent, wherein the charge controlling agent comprises an aromatic oxycarboxylic acid metal compound having a trivalent or more central metal, the binder resin comprises a polyester resin (A) having a softening point Tm (A) of 120° C. to 160° C. and a polyester resin (B) having a softening point Tm (B) of 80° C. to less than 120° C., and at least any one of the polyester resins (A) and (B) contains 1,2-propane diol at a content of 65 mol% or more in a divalent alcohol component and can be obtained by condensation polymerizing an alcohol component substantially composed of only an aliphatic alcohol with a carboxylic acid component.

13. The image forming apparatus according to claim 12, wherein the charging unit is configured to charge the surface of the latent electrostatic image bearing member in non-contact with the latent electrostatic image bearing member.

14. The image forming apparatus according to claim 12, wherein the charging unit is configured to charge the surface of the latent electrostatic image bearing member in contact with the latent electrostatic image bearing member.

15. The image forming apparatus according to claim 12, wherein the developing unit comprises a magnetic field generating unit fixed inside the developing unit and a developer carrier that carries a two-component developer composed of a magnetic carrier and the toner on the surface of the developing unit, and the developing unit is rotatable.

16. The image forming apparatus according to claim 12, wherein the developing unit comprises a developer carrier to which the toner is supplied and a layer thickness controlling member that forms a toner-thin layer on the surface thereof.

17. The image forming apparatus according to claim 12, wherein a plurality of image forming sections are arranged, each of which comprises at least a latent electrostatic image bearing member, a charging unit, a developing unit and a transfer unit, and the transfer unit is configured to sequentially transfer visual images formed on each of the respective latent electrostatic image bearing members onto a recording medium whose surface moves so as to pass a transfer position that faces the respective latent electrostatic image bearing members.

18. The image forming apparatus according to claim 12, wherein the transfer unit comprises an intermediate transfer member on which a visible image formed on the latent electrostatic image bearing member is primarily transferred and a secondary transfer unit configured to secondarily transfer the visible image carried by the intermediate transfer member onto a recording medium.

19. An image forming method, comprising:

charging the surface of a latent electrostatic image bearing member, exposing the charged surface of the latent electrostatic image bearing member to form a latent electrostatic image, developing the latent electrostatic image using a toner to form a visible image, transferring the visible image onto a recording medium, and fixing the transferred image on the recording medium, wherein the toner comprises a binder resin, a colorant and a charge controlling agent, wherein the charge controlling agent comprises an aromatic oxycarboxylic acid metal compound having a trivalent or more central metal, the binder resin comprises a polyester resin (A) having a softening point Tm (A) of 120° C. to 160° C. and a polyester resin (B) having a softening point Tm (B) of 80° C. to less than 120° C., and at least any one of the polyester resins (A) and (B) contains 1,2-propane diol at a content of 65 mol% or more in a divalent alcohol component and can be obtained by condensation polymerizing an alcohol component substantially composed of only an aliphatic alcohol with a carboxylic acid component.

20. A process cartridge detachably mountable to an image forming apparatus main body, comprising:

a latent electrostatic image bearing member, and a developing unit configured to develop a latent electrostatic image formed on the latent electrostatic image bearing member using a toner to form a visible image, wherein the toner comprises a binder resin, a colorant and a charge controlling agent, wherein the charge controlling agent comprises an aromatic oxycarboxylic acid metal compound having a trivalent or more central metal, the binder resin comprises a polyester resin (A) having a softening point Tm (A) of 120° C. to 160° C. and a polyester resin (B) having a softening point Tm (B) of 80° C. to less than 120° C., and at least any one of the polyester resins (A) and (B) contains 1,2-propane diol at a content of 65 mol% or more in a divalent alcohol component and can be obtained by condensation polymerizing an alcohol component substantially composed of only an aliphatic alcohol with a carboxylic acid component.

21. The toner according to claim 1, comprising an aromatic oxycarboxylic acid site in the aromatic oxycarboxylic acid metal compound, wherein said aromatic oxycarboxylic acid site is represented by Formula (2), Formula (2)

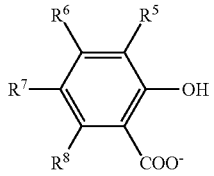

wherein $R^5$, $R^6$, $R^7$ and $R^8$ respectively represent a hydrogen atom, a straight chain alkyl group having 1 to 18 carbon atoms, a branched alkyl group having 1 to 18 carbon atoms or an aryl group, and $R^5$, $R^6$, $R^7$ and $R^8$ may be the same to each other or different from each other.

22. The toner according to claim 21, wherein $R^5$ and $R^6$, $R^6$ and $R^7$, $R^7$ and $R^8$ may be respectively linked to each other to form an aromatic ring that may have a substituent group or an aliphatic ring that may have a substituent group.

23. The toner according to claim 1, wherein the aromatic oxycarboxylic acid site is selected from the group consisting of

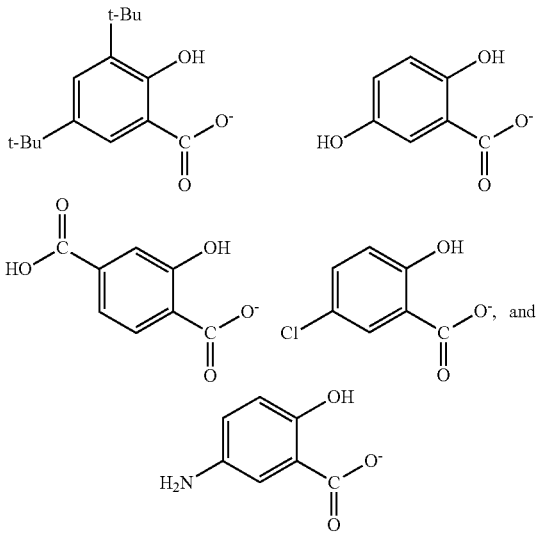

wherein t-Bu represents a tertiary butyl group.

* * * * *